US007609256B2

(12) United States Patent
Morita

(10) Patent No.: US 7,609,256 B2
(45) **Date of Patent: *Oct. 27, 2009**

(54) POWER SUPPLY CIRCUIT, DISPLAY DRIVER, ELECTRO-OPTICAL DEVICE, ELECTRONIC INSTRUMENT, AND METHOD OF CONTROLLING POWER SUPPLY CIRCUIT

(75) Inventor: Akira Morita, Suwa (JP)

(73) Assignee: Seiko Epson Corporation (JP)

( * ) Notice: Subject to any disclaimer, the term of this patent is extended or adjusted under 35 U.S.C. 154(b) by 701 days.

This patent is subject to a terminal disclaimer.

(21) Appl. No.: 11/313,172

(22) Filed: Dec. 20, 2005

(65) Prior Publication Data

US 2006/0132419 A1 Jun. 22, 2006

(30) Foreign Application Priority Data

Dec. 21, 2004 (JP) ..... 2004-369591

(51) Int. Cl.
*G09G 5/00* (2006.01)

(52) U.S. Cl. ..... 345/211; 345/94

(58) Field of Classification Search ..... 345/87, 345/94, 98, 204, 211–215
See application file for complete search history.

(56) References Cited

U.S. PATENT DOCUMENTS 5,298,914 A * 3/1994 Yamazaki ..... 345/103
6,456,267 B1 * 9/2002 Sato et al. ..... 345/92
6,492,970 B1 * 12/2002 Furuhashi et al. ..... 345/94
6,762,565 B2 7/2004 Kudo et al.
6,898,096 B2 * 5/2005 Endo et al. ..... 363/147
6,940,481 B2 * 9/2005 Konno et al. ..... 345/96
6,975,298 B2 * 12/2005 Koyama et al. ..... 345/98
7,078,864 B2 7/2006 Kudo et al.
7,154,332 B2 * 12/2006 Tsuchi ..... 330/255
7,205,969 B2 * 4/2007 Song ..... 345/87

(Continued)

FOREIGN PATENT DOCUMENTS

JP 11-015444 1/1999

(Continued)

*Primary Examiner*—Richard Hjerpe
*Assistant Examiner*—Tom V Sheng
(74) *Attorney, Agent, or Firm*—Harness, Dickey & Pierce, P.L.C.

(57) ABSTRACT

A power supply circuit including: a high-potential-side voltage generation circuit which generates a high-potential-side voltage; a low-potential-side voltage generation circuit which generates a low-potential-side voltage; and a switch circuit which alternately supplies the high-potential-side voltage and the low-potential-side voltage to the common electrode as a common electrode voltage. The power supply circuit performs supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value generated based on grayscale data for the number of dots of one scan line. The total value is a value obtained by sequentially adding a converted voltage value obtained by converting each piece of the grayscale data for the number of dots of one scan line according to a given grayscale characteristic.

47 Claims, 39 Drawing Sheets

U.S. PATENT DOCUMENTS

| | | | | |
|---|---|---|---|---|
| 7,317,442 | B2 * | 1/2008 | Nakai et al. | 345/100 |
| 7,342,562 | B2 * | 3/2008 | Kawase et al. | 345/87 |
| 7,420,533 | B2 * | 9/2008 | Yun | 345/96 |
| 2004/0145583 | A1 | 7/2004 | Morita | |
| 2006/0007095 | A1 | 1/2006 | Kudo et al. | |
| 2006/0132418 | A1 * | 6/2006 | Morita | 345/98 |
| 2006/0158412 | A1 * | 7/2006 | Morita | 345/94 |
| 2006/0158413 | A1 * | 7/2006 | Morita | 345/94 |

FOREIGN PATENT DOCUMENTS

| | | |
|---|---|---|
| JP | 11-288255 | 10/1999 |
| JP | 2000-276111 | 10/2000 |
| JP | 2002-366114 | 12/2002 |
| JP | 2004-184840 | 7/2004 |

* cited by examiner

FIG.11

| GRAYSCALE | | VOLTAGE | CONVERTED VOLTAGE VALUE | |
|---|---|---|---|---|
| DECIMAL | BINARY | | DECIMAL | BINARY |
| 0 | 0000 | 5.00 | 63 | 111111 |
| 1 | 0001 | 4.00 | 51 | 110011 |
| 2 | 0010 | 3.50 | 44 | 101100 |
| 3 | 0011 | 3.15 | 40 | 101000 |
| 4 | 0100 | 2.95 | 37 | 100101 |
| 5 | 0101 | 2.75 | 35 | 100011 |
| 6 | 0110 | 2.60 | 33 | 100001 |
| 7 | 0111 | 2.50 | 32 | 100000 |
| 8 | 1000 | 2.40 | 30 | 011110 |
| 9 | 1001 | 2.25 | 28 | 011100 |
| 10 | 1010 | 2.05 | 26 | 011010 |
| 11 | 1011 | 1.85 | 23 | 010111 |
| 12 | 1100 | 1.60 | 20 | 010100 |
| 13 | 1101 | 1.20 | 15 | 001111 |
| 14 | 1110 | 0.70 | 8 | 001000 |
| 15 | 1111 | 0.00 | 0 | 000000 |

(1) $TOTAL1 = CR_1 + CG_1 + CB_1 + CR_2 + CG_2 + CB_2 + CR_3 + \cdots + CR_{240} + CG_{240} + CB_{240}$ (2) $TOTAL2 = UR_1 + UG_1 + UB_1 + UR_2 + UG_2 + UB_2 + UR_3 + \cdots + UR_{240} + UG_{240} + UB_{240}$ (3) $TOTAL3 = MR_1 + MG_1 + MB_1 + MR_2 + MG_2 + MB_2 + MR_3 + \cdots + MR_{240} + MG_{240} + MB_{240}$

FIG.30

| LINE VALUE | TRP1 | TRP2 | TRN1 | TRN2 | VREFN1 VREFN2 | OFFSET | CK |
|---|---|---|---|---|---|---|---|
| 0 | OFF | OFF | ON | ON | OFF | OFF | 1/2 |
| 4 | OFF | OFF | ON | ON | OFF | OFF | 1/2 |
| 8 | OFF | OFF | ON | OFF | OFF | OFF | 1 |
| 12 | OFF | OFF | ON | OFF | ON | OFF | 1 |
| 16 | OFF | OFF | OFF | ON | ON | OFF | 1 |
| 20 | OFF | OFF | OFF | ON | ON | OFF | 1 |
| 24 | OFF | OFF | OFF | ON | ON | OFF | 1 |
| 28 | OFF | OFF | OFF | OFF | OFF | ON | 1 |
| 32 | OFF | OFF | OFF | OFF | OFF | ON | 1 |
| 36 | OFF | OFF | OFF | OFF | ON | ON | 1 |
| 40 | OFF | ON | OFF | OFF | ON | ON | 1 |
| 44 | OFF | ON | OFF | OFF | ON | OFF | 1 |
| 48 | ON | OFF | OFF | OFF | ON | OFF | 1 |
| 52 | ON | OFF | OFF | OFF | ON | OFF | 1 |
| 56 | ON | ON | OFF | OFF | ON | OFF | 1 |
| 60 | ON | ON | OFF | OFF | ON | OFF | 1 |
| 63 | ON | ON | OFF | OFF | ON | OFF | 1 |

FIG.31

| LINE VALUE | TRP1 | | TRN1 | | VREFN1 | | OFFSET | |
|---|---|---|---|---|---|---|---|---|
| | ON | OFF | ON | OFF | ON | OFF | ON | OFF |
| 0 | 0 | 0 | 0 | 0 | 0 | 0 | 0 | 0 |
| 4 | 0 | 0 | 0 | 0 | 0 | 0 | 0 | 0 |
| 8 | 0 | 0 | 0 | 0 | 0 | 2 | 0 | 0 |
| 12 | 0 | 0 | 0 | 0 | 0 | 4 | 0 | 0 |
| 16 | 0 | 0 | 0 | 0 | 0 | 6 | 0 | 0 |
| 20 | 0 | 0 | 0 | 0 | 0 | 7 | 0 | 0 |
| 24 | 0 | 0 | 0 | 0 | 0 | 0 | 0 | 2 |
| 28 | 0 | 0 | 0 | 0 | 0 | 0 | 0 | 4 |
| 32 | 0 | 0 | 0 | 0 | 0 | 6 | 0 | 6 |
| 36 | 0 | 0 | 0 | 0 | 0 | 7 | 0 | 7 |
| 40 | 0 | 0 | 0 | 2 | 2 | 6 | 0 | 0 |
| 44 | 0 | 0 | 0 | 4 | 4 | 7 | 0 | 0 |
| 48 | 0 | 2 | 0 | 0 | 2 | 7 | 0 | 0 |
| 52 | 0 | 4 | 0 | 0 | 4 | 7 | 0 | 0 |
| 56 | 0 | 5 | 0 | 2 | 5 | 9 | 0 | 0 |
| 60 | 0 | 6 | 0 | 4 | 6 | 9 | 0 | 0 |
| 63 | 0 | 7 | 0 | 7 | 7 | 9 | 0 | 0 |

FIG.34

| | VOLTAGE CHANGE PERIOD | GRAYSCALE OUTPUT PERIOD |
|---|---|---|
| LINE VALUE | PRECEDING LINE VALUE | PRESENT LINE VALUE + f (PRECEDING LINE VALUE) |

POWER SUPPLY CIRCUIT, DISPLAY DRIVER, ELECTRO-OPTICAL DEVICE, ELECTRONIC INSTRUMENT, AND METHOD OF CONTROLLING POWER SUPPLY CIRCUIT

Japanese Patent Application No. 2004-369591, filed on Dec. 21, 2004, is hereby incorporated by reference in its entirety.

BACKGROUND OF THE INVENTION

The present invention relates to a power supply circuit, a display driver, an electro-optical device, an electronic instrument, and a method of controlling a power supply circuit.

As a liquid crystal display (LCD) panel (display panel in a broad sense) used in an electronic instrument such as a portable telephone, a simple matrix type LCD panel and an active matrix type LCD panel using a switch element such as a thin film transistor (hereinafter abbreviated as "TFT") have been known.

The simple matrix type LCD panel easily reduces power consumption in comparison with the active matrix type LCD panel. However, it is difficult to increase the number of colors and display a video in the simple matrix type LCD panel. The active matrix type LCD panel is suitable for increasing the number of colors and displaying a video. However, it is difficult to reduce power consumption of the active matrix type LCD panel.

In recent years, an increase in the number of colors and display of a video have been increasingly demanded for a portable electronic instrument such as a portable telephone in order to display a high-quality image. Therefore, the active matrix type LCD panel has been widely used instead of the simple matrix type LCD panel.

The simple matrix type LCD panel or the active matrix type LCD panel is driven so that the voltage applied to a liquid crystal forming a pixel is alternately changed. As such an alternating drive method, a line inversion drive and a field inversion drive (frame inversion drive) have been known. In the line inversion drive, the polarity of the voltage applied to the liquid crystal is reversed in units of one or more scan lines. In the field inversion drive, the polarity of the voltage applied to the liquid crystal is reversed in field (frame) units.

The voltage level applied to a pixel electrode forming a pixel can be decreased by changing a common electrode voltage (common voltage) supplied to a common electrode opposite to the pixel electrode corresponding to inversion drive timing.

The inversion drive increases power consumption since an electric charge is repeatedly charged and discharged. JP-A-2004-184840 discloses a technology of reducing power consumption by reutilizing an electric charge discharged from a data line of the LCD panel.

However, the load of the common electrode of the LCD panel is almost constant, and the power supply capability of a power supply circuit which supplies the common electrode voltage is determined taking into consideration the maximum value of the amount of electric charge to be charged and discharged. Therefore, unnecessary power consumption occurs when the power supply capability is not required.

In recent years, an increase in resolution and grayscale of the LCD panel has been demanded. Therefore, an accurate and high drive capability is required so that current consumption is increased. Therefore, the image quality of the LCD panel is affected by only a small change in voltage level or the like, whereby a horizontal crosstalk problem or the like occurs.

Along with an increase in grayscale of the LCD panel, grayscale characteristics vary depending on the LCD panel, so that a complicated process is required to display a desired image. Therefore, it is important to display a desired image corresponding to various grayscale characteristics.

SUMMARY

According to a first aspect of the invention, there is provided a power supply circuit which supplies voltage to a common electrode which is opposite to a pixel electrode, an electro-optical substance being interposed between the common electrode and the pixel electrode, the power supply circuit comprising:

a high-potential-side voltage generation circuit which generates a high-potential-side voltage supplied to the common electrode;

a low-potential-side voltage generation circuit which generates a low-potential-side voltage supplied to the common electrode; and a switch circuit which alternately supplies the high-potential-side voltage and the low-potential-side voltage to the common electrode as a common electrode voltage, wherein the power supply circuit performs supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value generated based on grayscale data for the number of dots of one scan line, each dot corresponding to voltage applied to the pixel electrode; and wherein the total value is a value obtained by sequentially adding a converted voltage value obtained by converting each piece of the grayscale data for the number of dots of one scan line according to a given grayscale characteristic.

According to a second aspect of the invention, there is provided a power supply circuit which supplies voltage to a common electrode which is opposite to a pixel electrode, an electro-optical substance being interposed between the common electrode and the pixel electrode, the power supply circuit comprising:

a circuit which alternately supplies a high-potential-side voltage and a low-potential-side voltage to the common electrode, wherein the power supply circuit performs supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value generated based on grayscale data for the number of dots of one scan line, each dot corresponding to voltage applied to the pixel electrode; and wherein the total value is a value obtained by sequentially adding a converted voltage value obtained by converting each piece of the grayscale data for the number of dots of one scan line according to a given grayscale characteristic.

According to a third aspect of the invention, there is provided a display driver comprising:

a voltage value conversion circuit which generates a converted voltage value obtained by converting grayscale data of each dot corresponding to voltage applied to a pixel electrode according to a given grayscale characteristic;

a total value calculation circuit which generates a total value based on the converted voltage values for the number of dots of one scan line;

a driver circuit which supplies a drive voltage corresponding to the grayscale data to a data line electrically connected to the pixel electrode; and any of the above-described power supply circuits which performs the supply capability control by using the total value generated by the total value calculation circuit.

According to a fourth aspect of the invention, there is provided an electro-optical device comprising:

a plurality of scan lines;

a plurality of data lines;

a plurality of pixel electrodes, each of the pixel electrodes being specified by one of the scan lines and one of the data lines;

a common electrode which is opposite to the pixel electrodes, an electro-optical substance being interposed between the common electrode and the pixel electrodes;

a data driver which drives the data lines; and any of the above-described power supply circuits which alternately supplies the high-potential-side voltage and the low-potential-side voltage to the common electrode.

According to a fifth aspect of the invention, there is provided an electronic instrument comprising any of the above-described power supply circuits.

According to a sixth aspect of the invention, there is provided a method of controlling a power supply circuit including a high-potential-side voltage generation circuit and a low-potential-side voltage generation circuit, the high-potential-side voltage generation circuit generating a high-potential-side voltage to be supplied to a common electrode which is opposite to a pixel electrode, an electro-optical substance being interposed between the common electrode and the pixel electrode, the low-potential-side voltage generation circuit generating a low-potential-side voltage to be supplied to the common electrode, and the method comprising:

converting each piece of grayscale data for the number of dots of one scan line into a converted voltage value according to a given grayscale characteristic, each dot corresponding to voltage applied to the pixel electrode;

changing at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value obtained by sequentially adding the converted voltage value; and alternately supplying the high-potential-side voltage and the low-potential-side voltage to the common electrode.

BRIEF DESCRIPTION OF THE SEVERAL VIEWS OF THE DRAWING

FIG. 11 is illustrative of an example of the operation of a voltage value conversion circuit.

FIG. 30 shows an example of a power supply capability setting register.

FIG. 31 shows another example of a power supply capability setting register.

FIG. 34 shows an example of a line value in each period supplied from a data driver.

DETAILED DESCRIPTION OF THE EMBODIMENT

Figure 1:
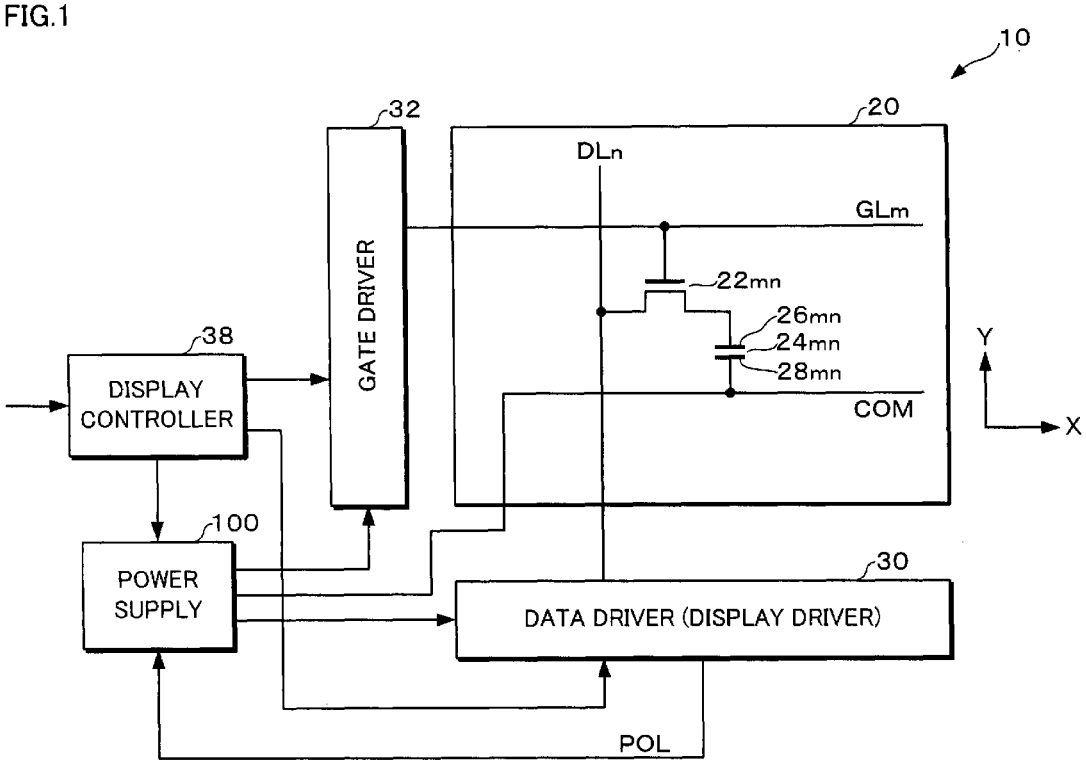
FIG. 1 is a block diagram showing a configuration example of a liquid crystal display device to which a power supply circuit according to one embodiment of the invention is applied.

The invention may provide a power supply circuit, a display driver, an electro-optical device, an electronic instrument, and a method of controlling a power supply circuit which enable to supply voltage to a common electrode according to grayscale characteristics while consuming a small amount of power without affecting the image quality.

According to one embodiment of the invention, there is provided a power supply circuit which supplies voltage to a common electrode which is opposite to a pixel electrode, an electro-optical substance being interposed between the common electrode and the pixel electrode, the power supply circuit comprising:

a high-potential-side voltage generation circuit which generates a high-potential-side voltage supplied to the common electrode;

a low-potential-side voltage generation circuit which generates a low-potential-side voltage supplied to the common electrode; and a switch circuit which alternately supplies the high-potential-side voltage and the low-potential-side voltage to the common electrode as a common electrode voltage, wherein the power supply circuit performs supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value generated based on grayscale data for the number of dots of one scan line, each dot corresponding to voltage applied to the pixel electrode; and wherein the total value is a value obtained by sequentially adding a converted voltage value obtained by converting each piece of the grayscale data for the number of dots of one scan line according to a given grayscale characteristic.

In this embodiment, the common electrode to which the voltage is supplied is capacitively coupled with the pixel electrode. The transmissivity is changed corresponding to the voltage between the common electrode and the pixel electrode. Therefore, a change in the voltage between the common electrode and the pixel electrode affects the image quality as the number of grayscales is increased.

In this embodiment, at least one of the current drive capability and the output voltage level for supplying the high-potential-side voltage and the low-potential-side voltage of the common electrode voltage is changed. Since the total value obtained by sequentially adding the converted voltage value obtained by converting each piece of grayscale data for the number of dots of one scan line according to the grayscale characteristics can be associated with the voltage applied to the pixel electrode, at least one of the current drive capability and the output voltage level is controlled corresponding to the total value. Therefore, it is unnecessary to determine the common electrode voltage supply capability taking into consideration the maximum value of the amount of electric charge which must be charged into or discharged from the common electrode. Therefore, this embodiment prevents occurrence of a situation in which unnecessary power consumption occurs when a high voltage supply capability is not required. This enables provision of a power supply circuit which can accurately set the common electrode voltage according to the grayscale characteristics at low power consumption.

The power supply circuit may comprise:

a first conductivity type first auxiliary transistor to which a high-potential-side power supply voltage of the high-potential-side voltage generation circuit is supplied at a source and which is electrically connected to an output of the switch circuit at a drain, wherein the supply capability control is performed by controlling a gate voltage of the first auxiliary transistor corresponding to the total value.

Since the capability of setting the high-potential-side voltage of the common electrode voltage can be increased corresponding to the total value, unnecessary current consumption can be reduced.

The power supply circuit may comprise:

a second conductivity type second auxiliary transistor to which a low-potential-side power supply voltage of the low-potential-side voltage generation circuit is supplied at a source and which is electrically connected to an output of the switch circuit at a drain, wherein the supply capability control is performed by controlling a gate voltage of the second auxiliary transistor corresponding to the total value.

Since the capability of setting the low-potential-side voltage of the common electrode voltage can be increased corresponding to the total value, unnecessary current consumption can be reduced.

In this power supply circuit, the high-potential-side voltage generation circuit may include a first operational amplifier which outputs the high-potential-side voltage based on a high-potential-side input voltage.

In this power supply circuit, the supply capability control may be performed by changing at least one of current drive capability and a slew rate of the first operational amplifier according to the total value.

In this power supply circuit, the supply capability control may be performed by changing the high-potential-side input voltage according to the total value.

In this power supply circuit, the supply capability control may be performed by stopping or limiting an operating current of the first operational amplifier and electrically connecting an input and an output of the first operational amplifier according to the total value.

Since the capability of generating the high-potential-side voltage of the common electrode voltage can be changed corresponding to the total value, unnecessary current consumption can be reduced.

The power supply circuit may comprise:

a first charge-pump circuit which generates a high-potential-side power supply voltage of the high-potential-side voltage generation circuit by a charge-pump operation in synchronization with a first charge clock signal, wherein the supply capability control is performed by stopping the first charge clock signal or reducing frequency of the first charge clock signal according to the total value.

Since an accurate high-potential-side power supply voltage can be generated while consuming power only when the accuracy of the voltage level of the high-potential-side power supply voltage is necessary, unnecessary current consumption can be reduced.

In this power supply circuit, the low-potential-side voltage generation circuit may include a second operational amplifier which outputs the low-potential-side voltage based on a low-potential-side input voltage.

In this power supply circuit, the supply capability control may be performed by changing at least one of current drive capability and a slew rate of the second operational amplifier according to the total value.

In this power supply circuit, the supply capability control may be performed by changing the low-potential-side input voltage according to the total value.

In this power supply circuit, the supply capability control may be performed by stopping or limiting an operating current of the second operational amplifier and electrically connecting an input and an output of the second operational amplifier according to the total value.

In this embodiment, the capability of generating the low-potential-side voltage of the common electrode voltage can be changed corresponding to the total value, so that unnecessary current consumption can be reduced.

The power supply circuit may comprise:

a second charge-pump circuit which generates a low-potential-side power supply voltage of the low-potential-side voltage generation circuit by a charge-pump operation in synchronization with a second charge clock signal, wherein the supply capability control is performed by stopping the second charge clock signal or reducing frequency of the second charge clock signal according to the total value.

Since an accurate low-potential-side power supply voltage can be generated while consuming power only when the accuracy of the voltage level of the low-potential-side power supply voltage is necessary, unnecessary current consumption can be reduced.

According to one embodiment of the invention, there is provided a power supply circuit which supplies voltage to a common electrode which is opposite to a pixel electrode, an electro-optical substance being interposed between the common electrode and the pixel electrode, the power supply circuit comprising:

a circuit which alternately supplies a high-potential-side voltage and a low-potential-side voltage to the common electrode, wherein the power supply circuit performs supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value generated based on grayscale data for the number of dots of one scan line, each dot corresponding to voltage applied to the pixel electrode; and wherein the total value is a value obtained by sequentially adding a converted voltage value obtained by converting each piece of the grayscale data for the number of dots of one scan line according to a given grayscale characteristic.

In this embodiment, since the total value obtained by sequentially adding the converted voltage value obtained by converting each piece of grayscale data for the number of dots of one scan line according to the grayscale characteristics can be associated with the voltage applied to the pixel electrode, the supply capability of common electrode voltage is controlled corresponding to the total value. Therefore, the common electrode voltage supply capability can be determined without taking into consideration the maximum value of the amount of electric charge which must be charged into or discharged from the common electrode. Therefore, it is possible to prevent occurrence of a situation in which unnecessary power consumption occurs when a high voltage supply capability is not required. This enables provision of a power supply circuit which can accurately set the common electrode voltage according to the grayscale characteristics at low power consumption.

In this power supply circuit, the supply capability control may be performed in a period determined based on the total value.

In this power supply circuit, the supply capability control may be performed according to an amount of change between the total value in a present horizontal scan period and the total value in a horizontal scan period immediately before the present horizontal scan period, instead of the total value.

In this power supply circuit, the supply capability control may be performed in a period corresponding to the amount of change between the total value in the present horizontal scan period and the total value in the horizontal scan period immediately before the present horizontal scan period.

In this power supply circuit, when performing a field inversion drive in which polarity of the common electrode voltage is changed based on a given reference potential in units of one vertical scan period, the amount of change may be calculated based on a value obtained by subtracting the total value in the horizontal scan period immediately before the present horizontal scan period from the total value in the present horizontal scan period; and when performing a line inversion drive in which polarity of the common electrode voltage is changed based on a given reference potential in units of one horizontal scan period, the amount of change may be calculated based on a value obtained by adding the total value in the present horizontal scan period and a correction value corresponding to the total value.

This enables to provide a power supply circuit which can drive the common electrode by an optimum voltage supply capability corresponding to the type of polarity inversion drive.

In this power supply circuit, when the grayscale data of each dot is j bits (j is an integer greater than one), the total value may be a value obtained by sequentially adding a converted voltage value obtained by converting higher-order k-bit data ($k<j$, k is a natural number) of each piece of the grayscale data for the number of dots of one scan line according to the given grayscale characteristic.

In this power supply circuit, k may be one.

In this power supply circuit, when the value obtained by sequentially adding the converted voltage value is p bits (p is an integer greater than one), the total value may be a value indicated by higher-order q bits (q<p, q is a natural number) of the value obtained by sequentially adding the converted grayscale data.

This makes it possible to evaluate the load of the common electrode by using the total value calculated by using a more simplified configuration. Therefore, a power supply circuit which can reduce power consumption without increasing the scale can be provided.

In this power supply circuit, the number of bits of the grayscale data may be smaller than the number of bits of data indicating the converted voltage value.

Since the converted voltage value can be more finely specified, the converted voltage value can be accurately set according to the grayscale characteristics. The supply of the common electrode voltage can be controlled by using the accurately set converted voltage value.

According to one embodiment of the invention, there is provided a display driver comprising:

a voltage value conversion circuit which generates a converted voltage value obtained by converting grayscale data of each dot corresponding to voltage applied to a pixel electrode according to a given grayscale characteristic;

a total value calculation circuit which generates a total value based on the converted voltage values for the number of dots of one scan line;

a driver circuit which supplies a drive voltage corresponding to the grayscale data to a data line electrically connected to the pixel electrode; and any of the above-described power supply circuits which performs the supply capability control by using the total value generated by the total value calculation circuit.

In this embodiment, a display driver including a power supply circuit which supplies voltage to the common electrode according to the grayscale characteristics while consuming a small amount of power without affecting the image quality can be provided.

According to one embodiment of the invention, there is provided an electro-optical device comprising:

a plurality of scan lines;

a plurality of data lines;

a plurality of pixel electrodes, each of the pixel electrodes being specified by one of the scan lines and one of the data lines;

a common electrode which is opposite to the pixel electrodes, an electro-optical substance being interposed between the common electrode and the pixel electrodes;

a data driver which drives the data lines; and any of the above-described power supply circuits which alternately supplies the high-potential-side voltage and the low-potential-side voltage to the common electrode.

In this embodiment, an electro-optical device including a power supply circuit which supplies voltage to the common electrode according to the grayscale characteristics while consuming a small amount of power without affecting the image quality can be provided.

According to one embodiment of the invention, there is provided an electronic instrument comprising any of the above-described power supply circuits.

In this embodiment, an electronic instrument including a power supply circuit which supplies voltage to the common electrode according to the grayscale characteristics while consuming a small amount of power without affecting the image quality can be provided.

According to one embodiment of the invention, there is provided a method of controlling a power supply circuit including a high-potential-side voltage generation circuit and a low-potential-side voltage generation circuit, the high-potential-side voltage generation circuit generating a high-potential-side voltage to be supplied to a common electrode which is opposite to a pixel electrode, an electro-optical substance being interposed between the common electrode and the pixel electrode, the low-potential-side voltage generation circuit generating a low-potential-side voltage to be supplied to the common electrode, and the method comprising:

converting each piece of grayscale data for the number of dots of one scan line into a converted voltage value according to a given grayscale characteristic, each dot corresponding to voltage applied to the pixel electrode;

changing at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit according to a total value obtained by sequentially adding the converted voltage value; and alternately supplying the high-potential-side voltage and the low-potential-side voltage to the common electrode.

In this method of controlling a power supply circuit, at least one of the current drive capability of the high-potential-side voltage generation circuit, the output voltage level of the high-potential-side voltage generation circuit, the current drive capability of the low-potential-side voltage generation circuit, and the output voltage level of the low-potential-side voltage generation circuit may be changed in a period determined based on the total value.

In this method of controlling a power supply circuit, at least one of the current drive capability of the high-potential-side voltage generation circuit, the output voltage level of the high-potential-side voltage generation circuit, the current drive capability of the low-potential-side voltage generation circuit, and the output voltage level of the low-potential-side voltage generation circuit may be changed according to an amount of change between the total value in a present horizontal scan period and the total value in a horizontal scan period immediately before the present horizontal scan period.

In this method of controlling a power supply circuit, at least one of the current drive capability of the high-potential-side voltage generation circuit, the output voltage level of the high-potential-side voltage generation circuit, the current drive capability of the low-potential-side voltage generation circuit, and the output voltage level of the low-potential-side voltage generation circuit may be changed in a period corresponding to the amount of change between the total value in the present horizontal scan period and the total value in the horizontal scan period immediately before the present horizontal scan period.

In this method of controlling a power supply circuit, when performing a field inversion drive in which polarity of the common electrode voltage is changed based on a given reference potential in units of one vertical scan period, the amount of change may be calculated based on a value obtained by subtracting the total value in the horizontal scan period immediately before the present horizontal scan period from the total value in the present horizontal scan period; and when performing a line inversion drive in which polarity of the common electrode voltage is changed based on a given reference potential in units of at least one horizontal scan period, the amount of change may be calculated based on a value obtained by adding the total value in the present horizontal scan period and a correction value corresponding to the total value.

In this method of controlling a power supply circuit, when the grayscale data of each dot is j bits (j is an integer greater than one), the total value may be a value obtained by sequentially adding a converted voltage value obtained by converting higher-order k-bit data (k<j, k is a natural number) of each piece of the grayscale data for the number of dots of one scan line according to the given grayscale characteristic.

In this method of controlling a power supply circuit, k may be one.

In this method of controlling a power supply circuit, when the value obtained by sequentially adding the converted voltage value is p bits (p is an integer greater than one), the total value may be a value indicated by higher-order q bits (q<p, q is a natural number) of the value obtained by sequentially adding the converted grayscale data.

In this method of controlling a power supply circuit, the number of bits of the grayscale data may be smaller than the number of bits of data indicating the converted voltage value.

These embodiments of the invention will be described in detail below, with reference to the drawings. Note that the embodiments described below do not in any way limit the scope of the invention laid out in the claims herein. In addition, not all of the elements of the embodiments described below should be taken as essential requirements of the invention.

1. Liquid Crystal Display Device

FIG. 1 shows an outline of a configuration of an active matrix type liquid crystal display device to which a power supply circuit according to one embodiment of the invention is applied.

A liquid crystal display device 10 includes an LCD panel (display panel in a broad sense; electro-optical device in a broader sense) 20. The LCD panel 20 is formed on a glass substrate, for example. A plurality of scan lines (gate lines) GL1 to GLM (M is an integer greater than one), arranged in a direction Y and extending in a direction X, and a plurality of data lines (source lines) DL1 to DLN (N is an integer greater than one), arranged in the direction X and extending in the direction Y, are disposed on the glass substrate. A pixel area (pixel) is provided corresponding to the intersecting position of the scan line GLm ($1 \leqq m \leqq M$, m is an integer; hereinafter the same) and the data line DLn ($1 \leqq n \leqq N$, n is an integer; hereinafter the same). A thin film transistor (hereinafter abbreviated as "TFT") 22 nm is disposed in the pixel area.

A gate of the TFT 22*mn* is connected with the scan line GLm. A source of the TFT 22*mn* is connected with the data line DLn. A drain of the TFT 22*mn* is connected with a pixel electrode 26*mn*. A liquid crystal (electro-optical substance in a broad sense) is sealed between the pixel electrode 26*mn* and a common electrode 28*mn* (common electrode COM) opposite to the pixel electrode 26*mn* so that a liquid crystal capacitor (liquid crystal element in a broad sense) 24*mn* is formed. The transmissivity of the pixel changes corresponding to the voltage applied between the pixel electrode 26*mn* and the common electrode 28*mn*. A common electrode voltage VCOM is supplied to the common electrode 28*mn*.

The LCD panel 20 is formed by attaching a first substrate, on which the pixel electrode and the TFT are formed, to a second substrate, on which the common electrode is formed, and sealing a liquid crystal as the electro-optical substance between the substrates, for example.

The liquid crystal display device 10 includes a data driver (display driver in a broad sense) 30. The data driver 30 drives the data lines DL1 to DLN of the LCD panel 20 based on grayscale data.

The liquid crystal display device 10 may include a gate driver (display driver in a broad sense) 32. The gate driver 32 sequentially drives (scans) the scan lines GL1 to GLM of the LCD panel 20 within one vertical scan period.

The liquid crystal display device 10 includes a power supply circuit 100. The power supply circuit 100 generates voltages necessary for driving the data lines, and supplies the generated voltages to the data driver 30. The power supply circuit 100 generates power supply voltages VDD and VSS necessary for the data driver 30 to drive the data lines and voltages for a logic section of the data driver 30, for example. The power supply circuit 100 also generates a voltage necessary for driving (scanning) the scan lines, and supplies the generated voltage to the gate driver 32.

The power supply circuit 100 also generates the common electrode voltage VCOM. Specifically, the power supply circuit 100 outputs the common electrode voltage VCOM, which alternately changes between a high-potential-side voltage VCOMH and a low-potential-side voltage VCOML in synchronization with the timing of a polarity inversion signal POL generated by the data driver 30, to the common electrode of the LCD panel 20. The common electrode of each pixel is set at the same potential, for example. In FIG. 1, the common electrode of each pixel is illustrated as the common electrode COM.

The liquid crystal display device 10 may include a display controller 38. The display controller 38 controls the data driver 30, the gate driver 32, and the power supply circuit 100 according to the content set by a host (not shown) such as a central processing unit (hereinafter abbreviated as "CPU"). For example, the display controller 38 sets the operation mode, the polarity inversion drive, and the polarity inversion timing of the data driver 30 and the gate driver 32, and supplies a vertical synchronization signal and a horizontal synchronization signal generated therein to the data driver 30 and the data driver 32.

In FIG. 1, the liquid crystal display device 10 is configured to include the power supply circuit 100 and the display controller 38. However, at least one of the power supply circuit 100 and the display controller 38 may be provided outside the liquid crystal display device 10. Or, the liquid crystal display device 10 may be configured to include the host.

The data driver 30 may include at least one of the gate driver 32 and the power supply circuit 100.

Figure 2:
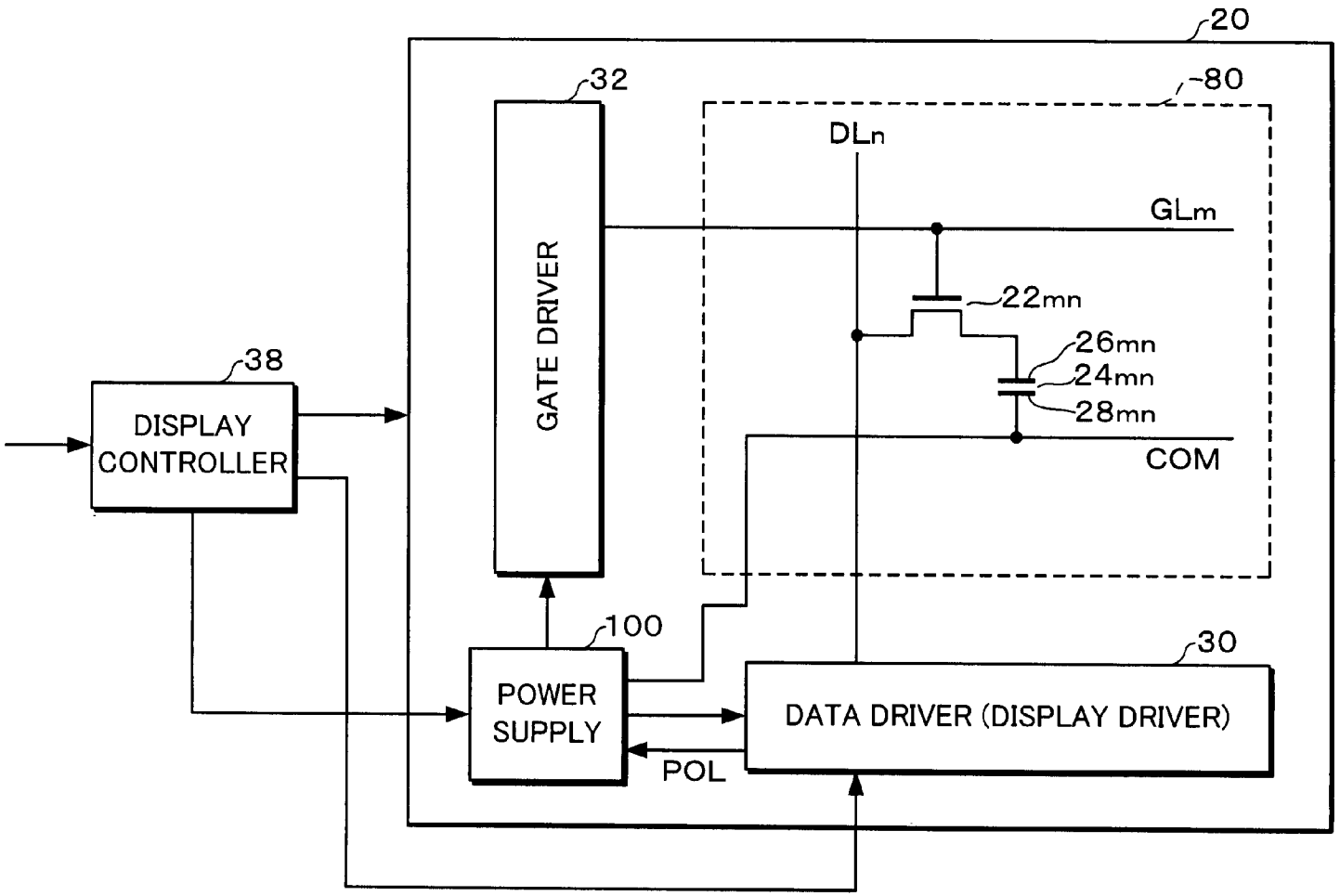
FIG. 2 is a block diagram showing another configuration example of the liquid crystal display device shown in FIG. 1.

Some or all of the data driver 30, the gate driver 32, the display controller 38, and the power supply circuit 100 may be formed on the glass substrate on which the LCD panel 20 is formed. In FIG. 2, the data driver 30, the gate driver 32, and the power supply circuit 100 are formed on the LCD panel 20. Accordingly, the LCD panel 20 may be configured to include a plurality of scan lines, a plurality of data lines, a pixel electrode specified by one of the scan lines and one of the data lines, a common electrode opposite to the pixel electrode through an electro-optical substance, a scan driver which scans the scan lines, a data driver which drives the data lines, and a power supply circuit which supplies a common electrode voltage to the common electrode. A plurality of pixels are formed in a pixel formation region 80 of the LCD panel 20.

1.1 Polarity Inversion Drive Method

When driving a liquid crystal, an electric charge stored in the liquid crystal capacitor must be periodically discharged from the viewpoint of durability of the liquid crystal and contrast. In the liquid crystal display device 10, the polarity of the voltage applied to the liquid crystal is reversed in a given cycle by using a polarity inversion drive. The polarity inversion drive method is divided into a field inversion drive and a line inversion drive depending on the type of polarity inversion cycle, for example.

The field inversion drive utilizes a method in which the polarity of the voltage applied to the liquid crystal is reversed in field units (in units of one vertical scan period). The line inversion drive utilizes a method in which the polarity of the voltage applied to the liquid crystal is reversed in line units (in units of one or more horizontal scan periods). In the line inversion drive, the polarity of the voltage applied to the liquid crystal is reversed in a frame cycle in each line.

Figure 3A:
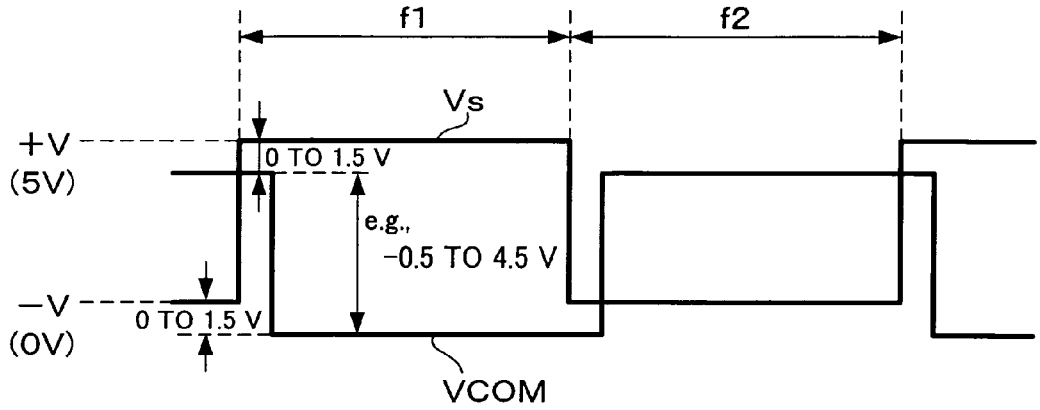
FIGS. 3A and 3B are diagrams illustrative of a polarity inversion drive.
Figure 3B:
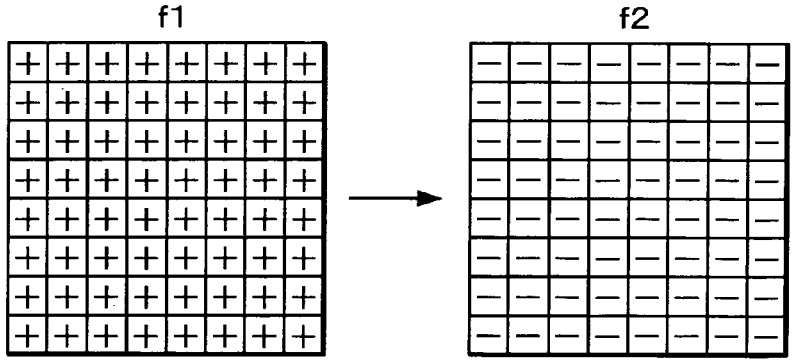

FIGS. 3A and 3B are diagrams illustrative of the operation of the field inversion drive. FIG. 3A schematically shows waveforms of the voltage supplied to the data line and the common electrode voltage VCOM in the field inversion drive. FIG. 3B schematically shows the polarity of the voltage applied to the liquid crystal corresponding to each pixel in units of one vertical scan period when performing the field inversion drive.

In the field inversion drive, the polarity of the voltage supplied to the data line is reversed in units of one vertical scan period, as shown in FIG. 3A. Specifically, a voltage Vs supplied to the source of the TFT connected with the data line is set at "+V" in a frame f1 and is set at "−V" in the subsequent frame f2. The polarity of the common electrode voltage VCOM supplied to the common electrode opposite to the pixel electrode connected with the drain electrode of the TFT is also reversed in synchronization with the polarity inversion timing of the voltage supplied to the data line.

Since the difference in voltage between the pixel electrode and the common electrode is applied to the liquid crystal, the polarity of the voltage is reversed in the frame f1 and the frame f2, as shown in FIG. 3B.

Figure 4A:
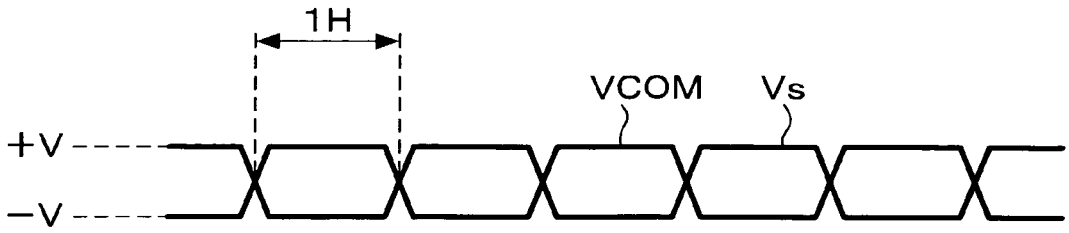
FIGS. 4A and 4B are diagrams illustrative of a polarity inversion drive.
Figure 4B:
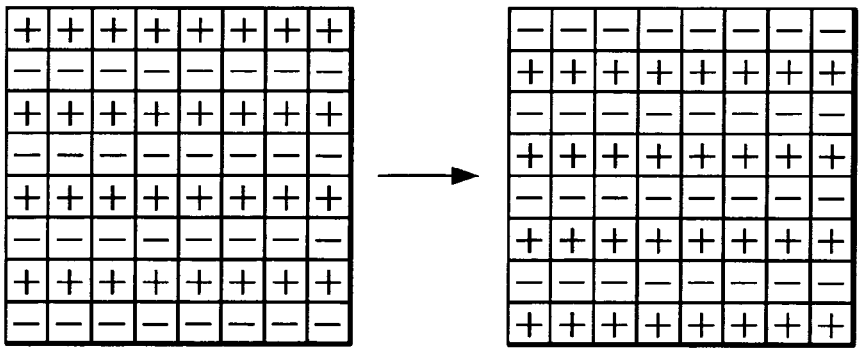

FIGS. 4A and 4B are diagrams illustrative of the operation of the line inversion drive. FIG. 4A schematically shows waveforms of the voltage supplied to the data line and the common electrode voltage VCOM in the line inversion drive. FIG. 4B schematically shows the polarity of the voltage applied to the liquid crystal corresponding to each pixel in units of one vertical scan period when performing the line inversion drive.

In the line inversion drive, the polarity of the voltage supplied to the data line is reversed in units of one horizontal scan period (1H) and in units of one vertical scan period, as shown in FIG. 4A. Specifically, the voltage Vs supplied to the source of the TFT connected with the data line is set at "+V" in 1H (one horizontal scan period) in the frame f1 and is set at "−V" in the next 1H.

In FIGS. 3A and 4A, the voltage applied to the liquid crystal is reversed by a common inversion drive which changes the voltage level of the common electrode voltage VCOM.

Figure 5:
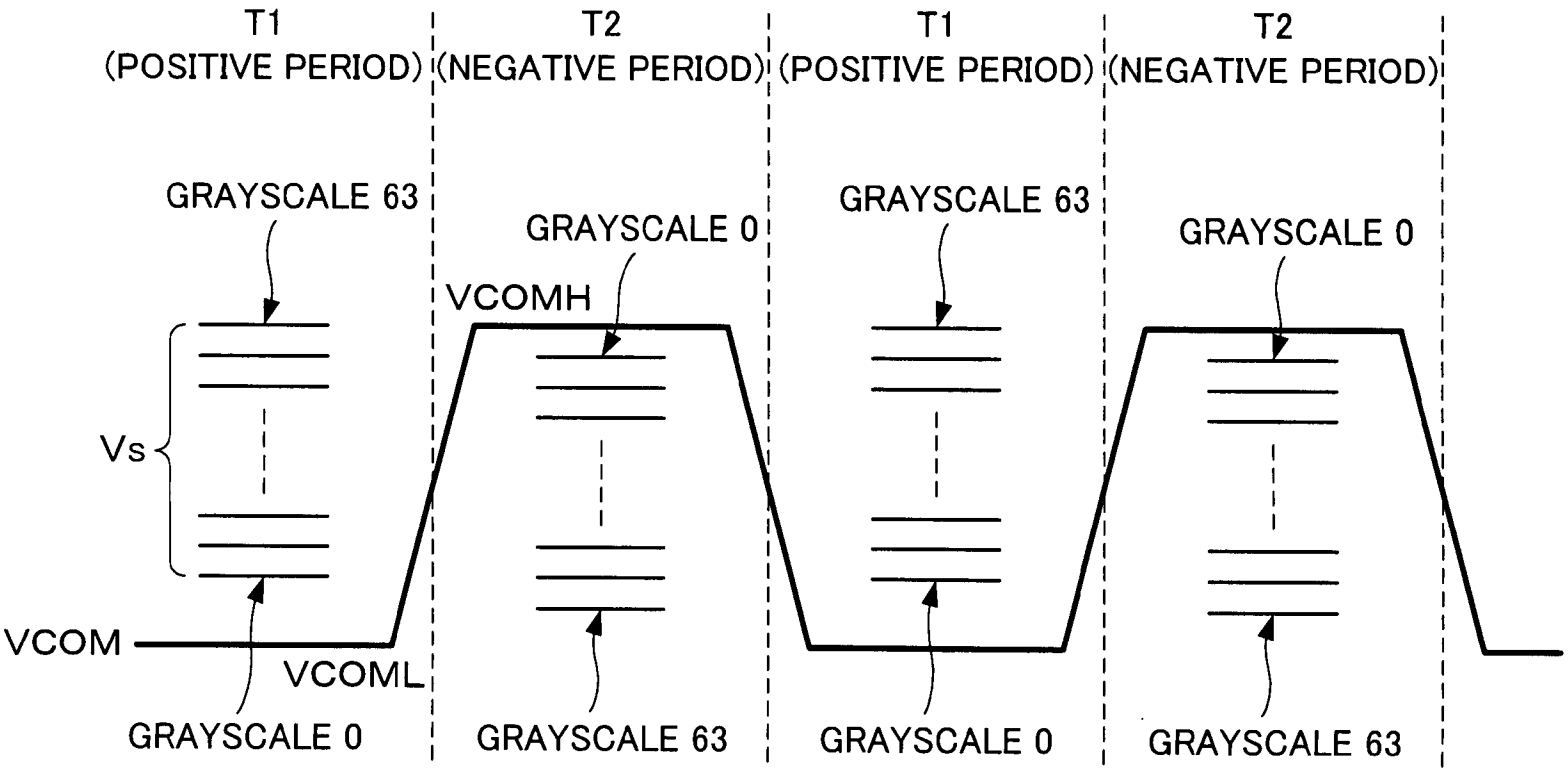
FIG. 5 is illustrative of the case of combining a line inversion drive and a common inversion drive.

FIG. 5 is a detailed diagram illustrative of the case of combining the line inversion drive and the common inversion drive.

In FIG. 5, a positive voltage is applied to the liquid crystal element in the mth scan period (select period of the scan line GLm), a negative voltage is applied to the liquid crystal element in the (m+1)th scan period, and a positive voltage is applied to the liquid crystal element in the (m+2)th scan period, for example. In the next frame, a negative voltage is applied to the liquid crystal element in the mth scan period, a positive voltage is applied to the liquid crystal element in the (m+1)th scan period, and a negative voltage is applied to the liquid crystal element in the (m+2)th scan period. In the line inversion drive, the polarity of the voltage (common voltage) VCOM of the common electrode COM is reversed in scan period units.

In more detail, the common electrode voltage VCOM is set at the high-potential-side voltage VCOMH in a positive period T1 (first period) and is set at the low-potential-side voltage VCOML in a negative period T2 (second period).

The positive period T1 is a period in which the voltage Vs of the data line (pixel electrode) is higher than the common electrode voltage VCOM. In the period T1, a positive voltage is applied to the liquid crystal element. The negative period T2 is a period in which the voltage Vs of the data line is lower than the common electrode voltage VCOM. In the period T2, a negative voltage is applied to the liquid crystal element. The high-potential-side voltage VCOMH may be referred to as a voltage obtained by reversing the polarity of the low-potential-side voltage VCOML with respect to a given voltage.

The voltage necessary for driving the LCD panel can be decreased by reversing the polarity of the common electrode voltage VCOM in this manner. This allows the breakdown voltage of the driver circuit of the LCD panel to be reduced, whereby the manufacturing process of the driver circuit can be simplified and the manufacturing cost can be reduced.

2. Supply Capability Control

The capability of the power supply circuit to supply the common electrode voltage VCOM is determined depending on the load of the common electrode COM. Since the image quality deteriorates if the power supply capability of the power supply circuit is insufficient, the power supply capability is generally determined taking into consideration the maximum value of the amount of electric charge which must be charged into or discharged from the common electrode COM.

However, the voltage Vs of the data line changes depending on a grayscale value indicated by the grayscale data. Since the grayscale value differs in scan line units, the voltage Vs of the data line also differs in scan line units. Since the pixel electrode and the common electrode are capacitively coupled as described above, the supply capability of the common electrode voltage VCOM is unnecessary depending on the voltage applied to the pixel electrode or the amount of change (change) in the applied voltage.

Figure 6A:
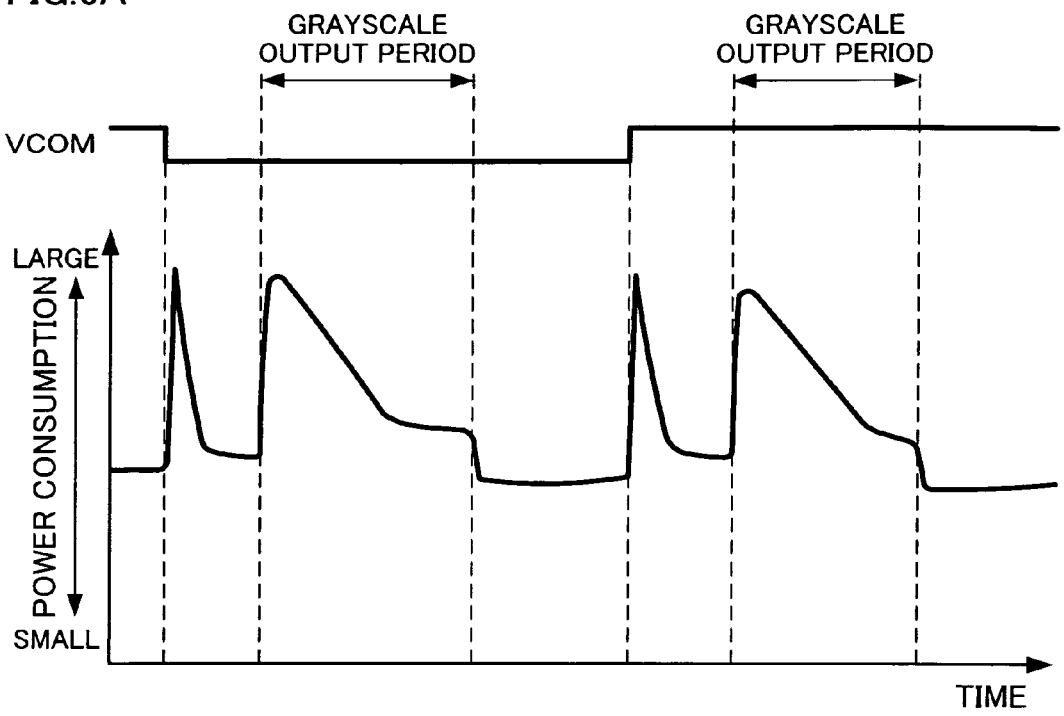
FIGS. 6A and 6B are illustrative of the difference in power consumption depending on grayscale data.
Figure 6B:
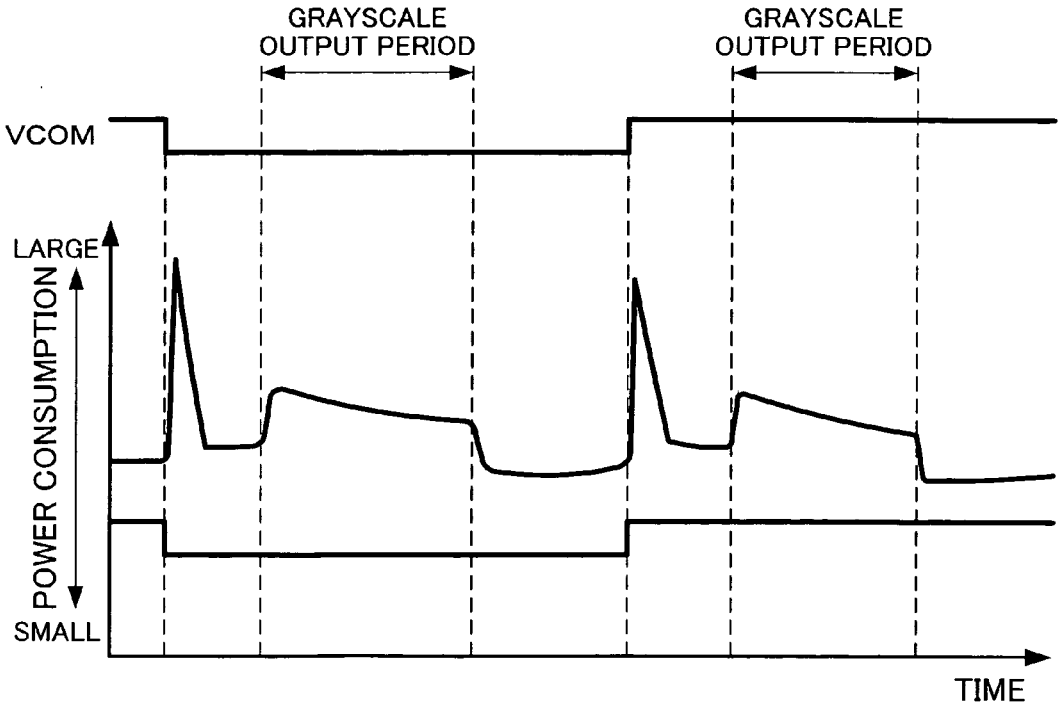

FIGS. 6A and 6B schematically show a change in power consumption of the power supply circuit which supplies the common electrode voltage VCOM.

FIGS. 6A and 6B show the case where the polarity inversion drive is performed by using the line inversion drive in a general normally-white active matrix type LCD panel. FIG. 6A shows a change in power consumption when performing a black display. FIG. 6B shows a change in power consumption when performing a white display.

In a voltage change period in which the voltage level of the common electrode voltage VCOM changes, since the power supply circuit must change the voltage level of the common electrode COM from the high-potential-side voltage VCOMH to the low-potential-side voltage VCOML, a high supply capability is necessary. In the next voltage change period, since the power supply circuit must change the voltage level of the common electrode COM from the low-potential-side voltage VCOML to the high-potential-side voltage VCOMH, a high supply capability is also necessary. A large amount of power is consumed in the voltage change periods.

In a grayscale output period in which voltage is supplied to the data line after the voltage level of the common electrode COM has changed, voltage corresponding to the grayscale value in the horizontal scan period is supplied to the pixel electrode. In this case, electric charge must be supplied to or removed from the common electrode COM capacitively coupled with the pixel electrode so that the change in the voltage applied to the pixel electrode is eliminated.

However, the voltage applied to the pixel electrode must be increased in the black display shown in FIG. 6A in comparison with the white display shown in FIG. 6B. This is because it is necessary to increase the difference between the common electrode voltage VCOM and the voltage applied to the pixel electrode in FIG. 6A in comparison with FIG. 6B.

Therefore, power consumption is increased in FIG. 6A in comparison with FIG. 6B. Specifically, power consumption of the power supply circuit which drives the common electrode COM differs depending on the grayscale value in the horizontal scan period.

However, the power supply capability of a general power supply circuit is determined taking into consideration the maximum value of the amount of electric charge which must be charged into or discharged from the common electrode COM as shown in FIG. 6A. Therefore, unnecessary power consumption occurs in FIG. 6B even though a high power supply capability is not necessary for the power supply circuit.

Therefore, the power supply circuit according to one embodiment of the invention is configured so that the supply capability of the common electrode voltage VCOM can be controlled. This enables the circuit scale and power consumption of the power supply circuit to be reduced without causing deterioration of the image quality of the LCD panel.

Figure 7:
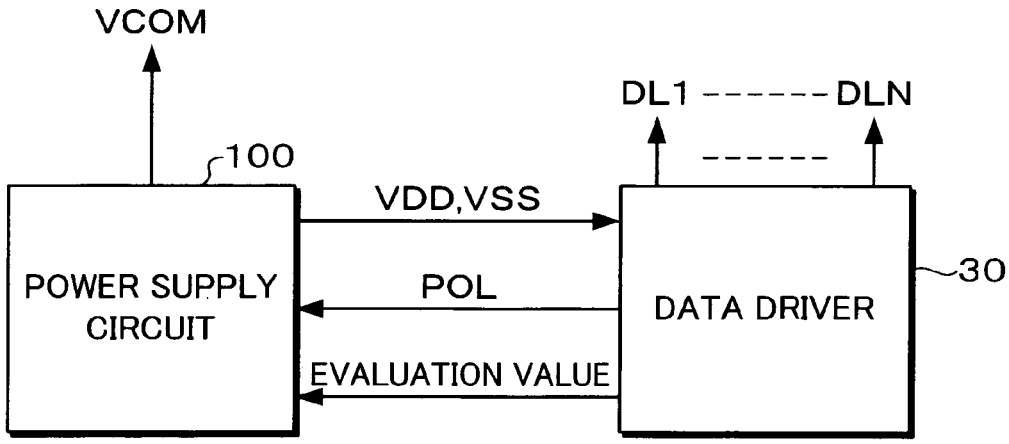
FIG. 7 shows a configuration example of a power supply capability control system including a power supply circuit according to one embodiment of the invention.

FIG. 7 shows a configuration example of a power supply capability control system including the power supply circuit according to one embodiment of the invention.

In FIG. 7, sections the same as the sections shown in FIG. 1 or 2 are indicated by the same symbols. Description of these sections is appropriately omitted. In the power supply capability control system, the power supply circuit 100 supplies the power supply voltages VDD and VSS of the data driver 30, for example. The power supply circuit 100 reverses the polarity of the common electrode voltage VCOM in synchronization with the polarity inversion signal POL from the data driver 30. The power supply circuit 100 receives an evaluation value from the data driver 30, and changes the supply capability of the common electrode voltage VCOM based on the evaluation value.

As the evaluation value, the grayscale data (line data) for one scan line in the horizontal scan period or a value (line value) calculated based on the grayscale data for one scan line may be used. For example, the amount of electric charge which must be charged into or discharged from the common electrode is estimated based on the grayscale data for one scan line in the horizontal scan period, and the supply capability of the common electrode voltage VCOM is changed. Or, the amount of electric charge which must be charged into or discharged from the common electrode may be associated with a change in the voltage applied to the pixel electrode, and the amount of change of the grayscale data for one scan line in the present horizontal scan period from the grayscale data for one scan line in the horizontal scan period immediately before the present horizontal scan period may be used as the evaluation value.

Or, each piece of grayscale data for the number of dots of one scan line may be converted into a converted voltage value according to the grayscale characteristics of the LCD panel 20 when calculating the above evaluation value, and the total value obtained by sequentially adding the converted voltage value may be used as the evaluation value. This enables the supply capability of the common electrode voltage to be controlled taking into consideration the voltage applied to the pixel electrode according to the grayscale characteristics.

The data driver 30 and the power supply circuit 100 which realize the supply capability control of the common electrode voltage according to the grayscale characteristics are described below.

2.1 Data Driver

Figure 8:
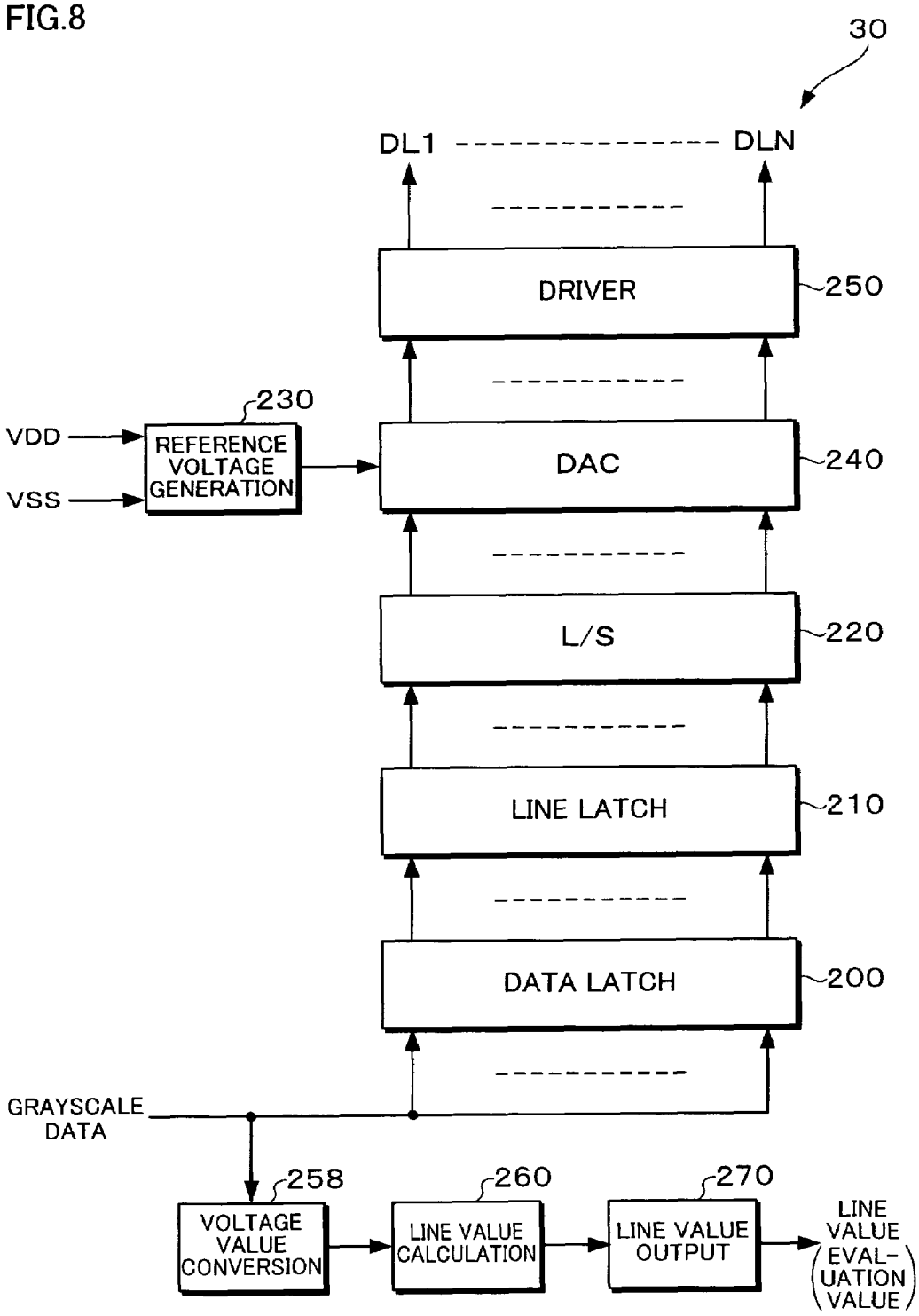
FIG. 8 is a block diagram showing a configuration example of a data driver according to one embodiment of the invention.

FIG. 8 is a block diagram showing a configuration example of the data driver 30 shown in FIG. 1.

The data driver 30 includes a data latch 200, a line latch 210, a level shifter (L/S) 220, a reference voltage generation circuit 230, a digital/analog converter (DAC) (voltage select circuit in a broad sense) 240, and a driver circuit 250.

The data latch 200 includes a plurality of flip-flops connected in series, the flip-flops being provided corresponding to output lines of the data driver 30. The grayscale data is input to each flip-flop, and voltage corresponding to the grayscale data is supplied to each output line. The grayscale data is serially input from the display controller 38 in pixel units (or dot units) in synchronization with a dot clock signal DCK. The data latch 200 acquires the grayscale data for one horizontal scan by shifting the grayscale data in synchronization with the dot clock signal DCK, for example. The dot clock signal DCK is supplied from the display controller 38. When signals for one pixel include a 6-bit R signal, a 6-bit G signal, and a 6-bit B signal, one pixel (=three dots) is made up of 18 bits.

The line latch 210 includes a plurality of flip-flops provided corresponding to the output lines. The line latch 210 latches the grayscale data input to the data latch 200 at the change timing of a horizontal synchronization signal HSYNC.

The L/S 220 includes a plurality of level conversion circuits provided corresponding to the output lines. The level conversion circuit converts the voltage level so that the signal of the grayscale data, which oscillates at a logic voltage of 1.8 V, oscillates at a voltage of 5 V, for example.

The reference voltage generation circuit 230 generates a plurality of reference voltages, each of which corresponds to the grayscale value indicated by the grayscale data. In more detail, the reference voltage generation circuit 230 generates reference voltages V0 to V63, each of which corresponds to 6-bit grayscale data, based on the high-potential-side power supply voltage VDD and the low-potential-side power supply voltage VSS. The high-potential-side power supply voltage VDD and the low-potential-side power supply voltage VSS are generated by the power supply circuit 100, for example.

The DAC 240 includes a plurality of ROM decoder circuits provided corresponding to the output lines. The ROM decoder circuit selects one of the reference voltages V0 to V63 from the reference voltage generation circuit 230 based on the signal of the grayscale data of which the voltage level is converted by the level conversion circuit of the L/S 220. This enables the DAC 240 to generate a data voltage corresponding to the grayscale data in output line units.

The driver circuit 250 drives a plurality of output lines, each of which is connected with the data line of the LCD panel 20. In more detail, the driver circuit 250 includes a plurality of impedance conversion circuits provided corresponding to the output lines. The impedance conversion circuit drives the output line based on the data voltage generated by the DAC 240 in output line units. The impedance conversion circuit is formed by a voltage-follower-connected operational amplifier.

In the data driver 30 having the above-described configuration, the grayscale data for one horizontal scan input to the data latch 200 is latched by the line latch 210, for example. The data voltage is generated in output line units by using the grayscale data latched by the line latch 210. The driver circuit 250 drives each output line based on the data voltage generated by the DAC 240.

Figure 9:
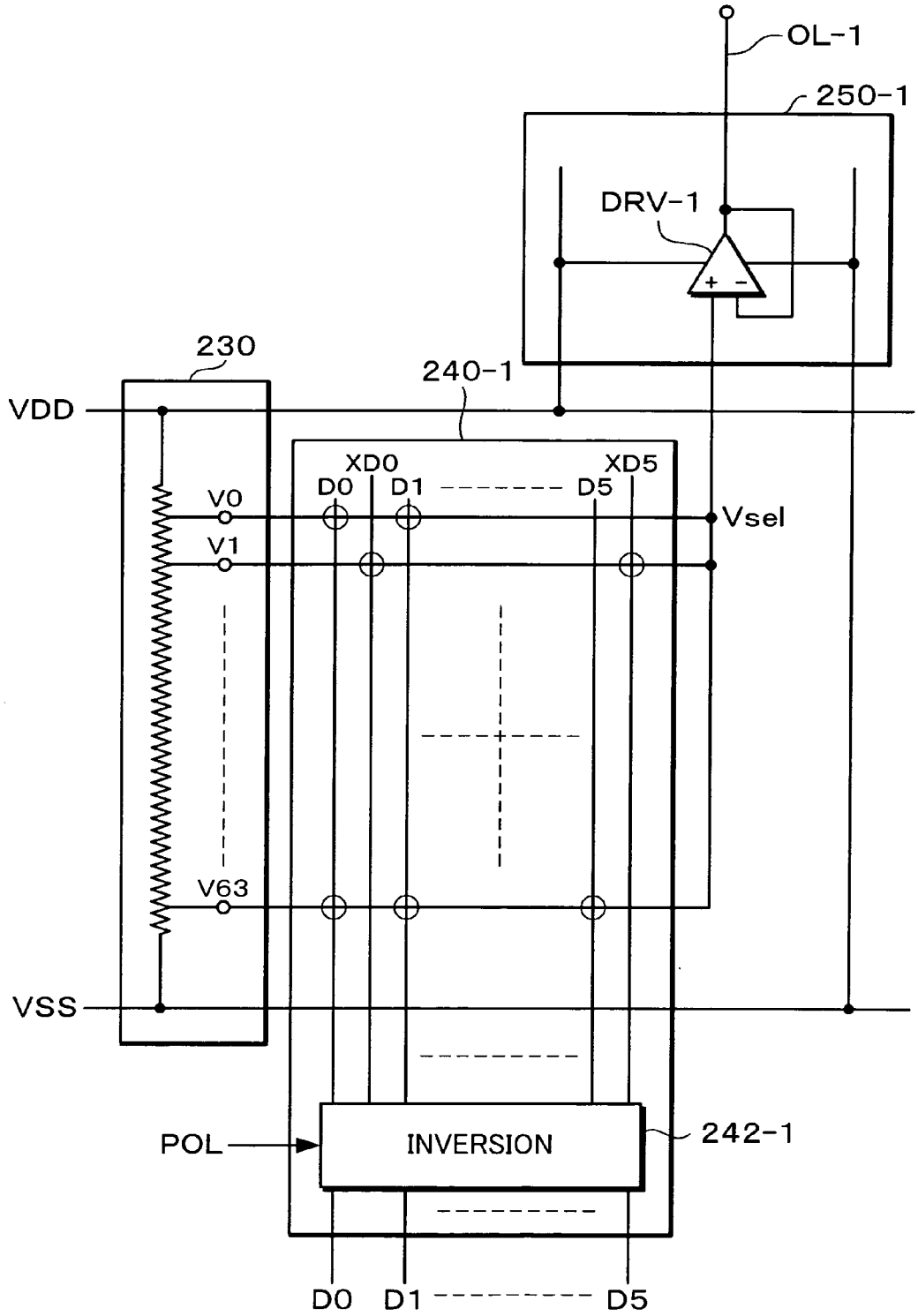
FIG. 9 is a diagram illustrative of the operation of the major portion of the data driver shown in FIG. 8.

FIG. 9 shows an outline of a configuration of the reference voltage generation circuit 230, the DAC 240, and the driver circuit 250. FIG. 9 shows only the configuration corresponding to one output line of the driver circuit 250. However, the same description also applies to other output lines. FIG. 9 shows only the configuration of a driver circuit 250-1 of the driver circuit 250 which drives a data line DL1.

In the reference voltage generation circuit 230, a resistor circuit is connected between the high-potential-side power supply voltage VDD and the low-potential-side power supply voltage VSS. The reference voltage generation circuit 230 generates a plurality of divided voltages obtained by dividing the voltage between the power supply voltages VDD and VSS by using the resistor circuit as the reference voltages V0 to V63. In the polarity inversion drive, since the positive voltage and the negative voltage are not symmetrical in the actual situation, positive reference voltages and negative reference voltages are generated. FIG. 9 shows one of them.

A DAC 240-1 may be realized by a ROM decoder circuit. The DAC 240-1 selects one of the reference voltages V0 to V63 based on the 6-bit grayscale data, and outputs the selected reference voltage to an impedance conversion circuit DRV-1 as a select voltage Vsel. A voltage selected based on the corresponding 6-bit grayscale data is also output to each of the remaining impedance conversion circuits DRV-2 to DRV-N.

The DAC 240-1 includes an inversion circuit 242-1. The inversion circuit 242-1 reverses each bit of the grayscale data based on the polarity inversion signal POL. 6-bit grayscale data D0 to D5 and 6-bit drive inversion grayscale data XD0 to XD5 are input to the ROM decoder circuit. The drive inversion grayscale data XD0 to XD5 is obtained by reversing the logic of the grayscale data D0 to D5, respectively. The ROM decoder circuit selects one of the multi-valued reference voltages V0 to V63 generated by the reference voltage generation circuit 230 based on the grayscale data D0 to D5 and the drive inversion grayscale data XD0 to XD5.

For example, when the polarity inversion signal POL is set at the H level, the reference voltage V2 is selected corresponding to the 6-bit grayscale data D0 to D5 "000010" (=2). When the polarity inversion signal POL is set at the L level, the reference voltage is selected by using the drive inversion grayscale data XD0 to XD5 obtained by reversing the grayscale data D0 to D5. Specifically, the drive inversion grayscale data XD0 to XD5 is "111101" (=61) so that the reference voltage V61 is selected.

The select voltage Vsel selected by the DAC 240-1 is supplied to the impedance conversion circuit DRV-1. The impedance conversion circuit DRV-1 drives the output line OL-1 based on the select voltage Vsel. The power supply circuit 100 changes the common electrode voltage VCOM in synchronization with the polarity inversion signal POL as described above. The polarity of the voltage applied to the liquid crystal is reversed in this manner.

The data driver 30 shown in FIG. 8 may include a voltage value conversion circuit 258, a line value calculation circuit (total value calculation circuit) 260, and a line value output section 270. The line value calculation circuit 260 generates a line value as the evaluation value supplied to the power supply circuit 100 based on a converted voltage value converted by the voltage value conversion circuit 258. The line value output section 270 includes a buffer. The line value output section 270 adjusts the output timing of the line value generated by the line value calculation circuit 260, and supplies the line value of which the output timing has been adjusted to the power supply circuit 100. The common electrode voltage VCOM of the power supply circuit 100 can be changed while associating the common electrode voltage VCOM with the converted voltage values for one scan line corresponding to the grayscale data for one scan line by adjusting the output timing.

FIG. 8 shows the case where the data driver 30 and the power supply circuit 100 are independently provided. However, the data driver 30 shown in FIG. 8 may include the power supply circuit 100.

2.2 Converted Voltage Value

Figure 10:
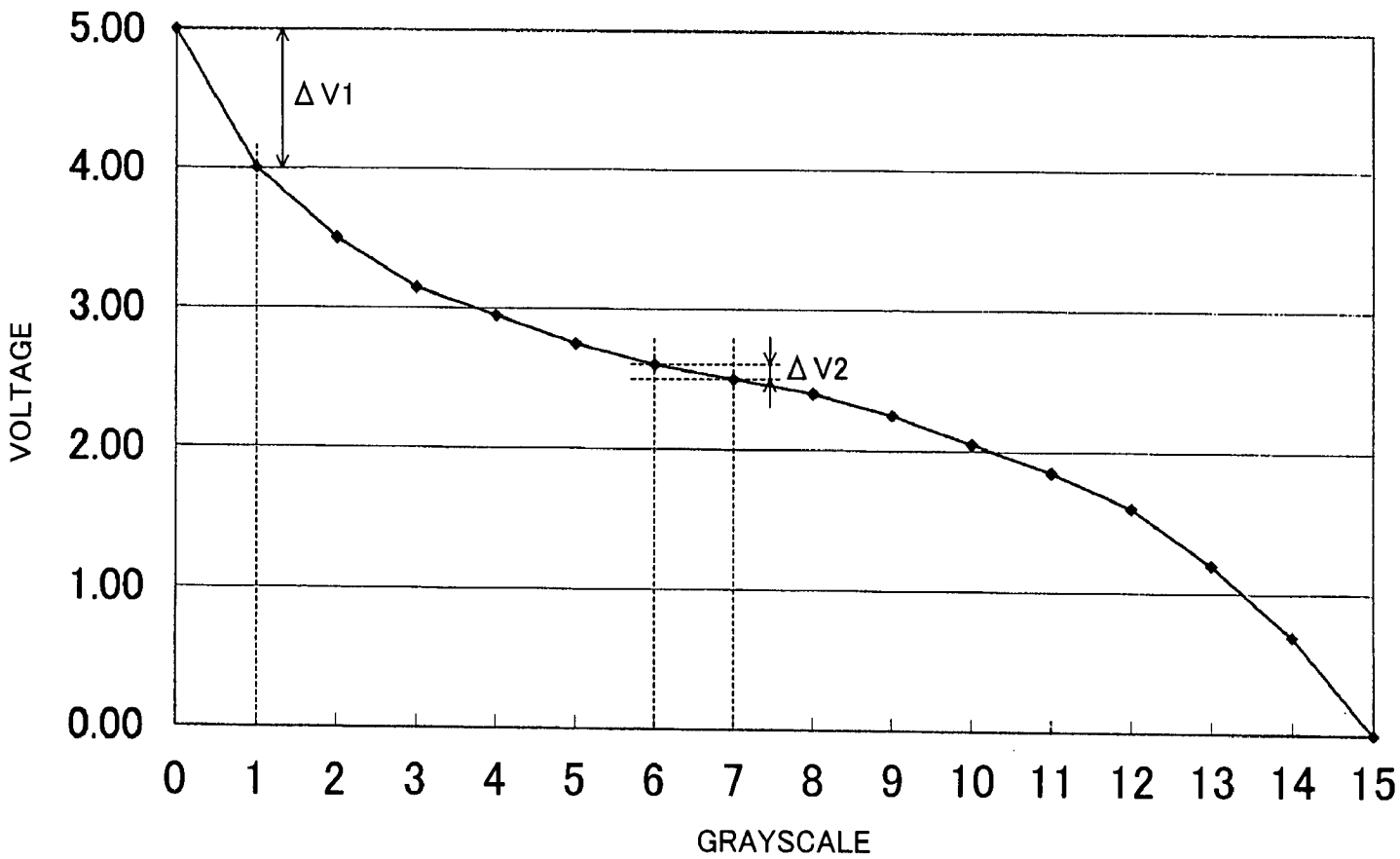
FIG. 10 is illustrative of the grayscale characteristics of a general LCD panel.

FIG. 10 is a diagram illustrative of the grayscale characteristics of a general LCD panel.

In FIG. 10, a voltage of up to 5 V is applied to a pixel electrode of a 16-grayscale LCD panel for convenience of illustration. FIG. 10 shows the grayscale characteristics when the LCD panel is normally white and the common electrode voltage VCOM is set at the L level. Therefore, a white display occurs when the voltage is set at 0 V, and a black display occurs when the voltage is set at 5 V. In the graph showing the grayscale characteristics, the horizontal axis indicates the grayscale, and the vertical axis indicates the voltage. The grayscale is indicated by the grayscale data. The voltage is the data voltage supplied to the data line.

In the grayscale characteristics shown in FIG. 10, the grayscale and the voltage do not have a linear relationship. Therefore, it is necessary to calculate the data voltage in units of grayscale data according to the grayscale characteristics shown in FIG. 10 and supply the calculated data voltage.

Therefore, the voltage value conversion circuit 258 converts each piece of grayscale data for the number of dots of one scan line, the grayscale data of each dot corresponding to the voltage applied to the pixel electrode, into the converted voltage value according to the grayscale characteristics as shown in FIG. 10. The line value is calculated based on the converted voltage value. This enables the supply capability of the common electrode voltage VCOM to be controlled corresponding to the voltage applied to the pixel electrode according to the grayscale characteristics shown in FIG. 10.

As shown in FIG. 10, the difference in voltage per grayscale differs to a large extent depending on the grayscale value. For example, while the difference ? V1 in data voltage between the grayscale value 0 and the grayscale value 1 is 1.0 V, the difference ? V2 in data voltage between the grayscale value 6 and the grayscale value 7 is 0.1 V. Therefore, it is necessary to calculate the data voltage applied to the pixel electrode with an accuracy corresponding to the minimum difference in data voltage in the grayscale characteristics shown in FIG. 10.

Therefore, when controlling the supply capability of the common electrode voltage corresponding to the voltage applied to the pixel electrode for one scan line, it is desirable that the evaluation value be calculated with an accuracy approximately equal to the accuracy corresponding to the minimum difference in data voltage in the grayscale characteristics. Therefore, it is desirable that the voltage value conversion circuit 258 calculate the converted voltage value so that the number of bits of grayscale data is smaller than the number of bits of data indicating the converted voltage value.

FIG. 11 is a diagram illustrative of an example of the operation of the voltage value conversion circuit 258 which generates the converted voltage value according to the grayscale characteristics shown in FIG. 10.

FIG. 11 shows an example in which the grayscale data is four bits and data indicating the converted voltage value is six bits. A converted voltage value corresponding to the grayscale characteristics shown in FIG. 10 can be generated by converting the 4-bit grayscale data into the converted voltage value indicated by 6-bit data.

Figure 12:
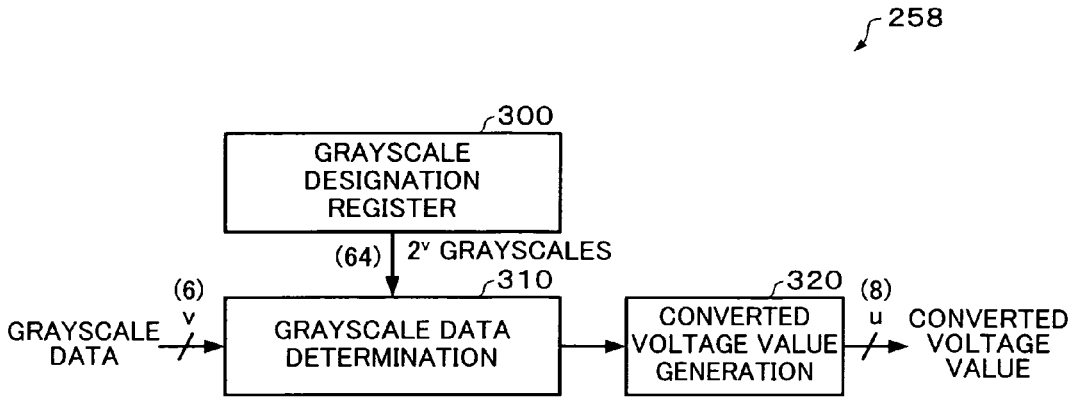
FIG. 12 is a block diagram showing a configuration example of the voltage value conversion circuit shown in FIG. 8.

FIG. 12 is a block diagram showing a configuration example of the voltage value conversion circuit 258 shown in FIG. 8.

The voltage value conversion circuit 258 includes a grayscale designation register 300, a grayscale data determination circuit 310, and a converted voltage value generation circuit 320. In FIG. 12, the voltage value conversion circuit 258 includes the grayscale designation register 300. However, the grayscale designation register 300 may be provided outside the voltage value conversion circuit 258.

Grayscale designation information is set in the grayscale designation register 300. The grayscale designation information is information for selecting $2^v$ ($1 \leqq v \leqq u$, v is an integer) voltages from $2^u$ (u is an integer greater than one) voltages. The following description is given on the assumption that u is eight and v is six so that 64 ($=2^6$) voltages are selected from 256 ($=2^8$) voltages. The grayscale designation information is set by the display controller 38 or the host. The grayscale designation information set in the grayscale designation register 300 is supplied to the grayscale data determination circuit 310.

The grayscale data determination circuit 310 determines one of the $2^8$ voltages which corresponds to the reference voltage corresponding to the 6-bit grayscale data based on the grayscale designation information from the grayscale designation register 300. The converted voltage value generation circuit 320 generates the converted voltage value indicated by 8-bit data based on the determination result of the grayscale data determination circuit 310.

Specifically, the voltage value conversion circuit 258 assigns the grayscale value (grayscale number) indicated by the 6-bit grayscale data to one of the 256 ($=2^8$) converted voltage values indicated by 8-bit data. The voltage value conversion circuit 258 receives the 6-bit grayscale data and outputs the converted voltage value to which the grayscale data is assigned.

Figure 13:
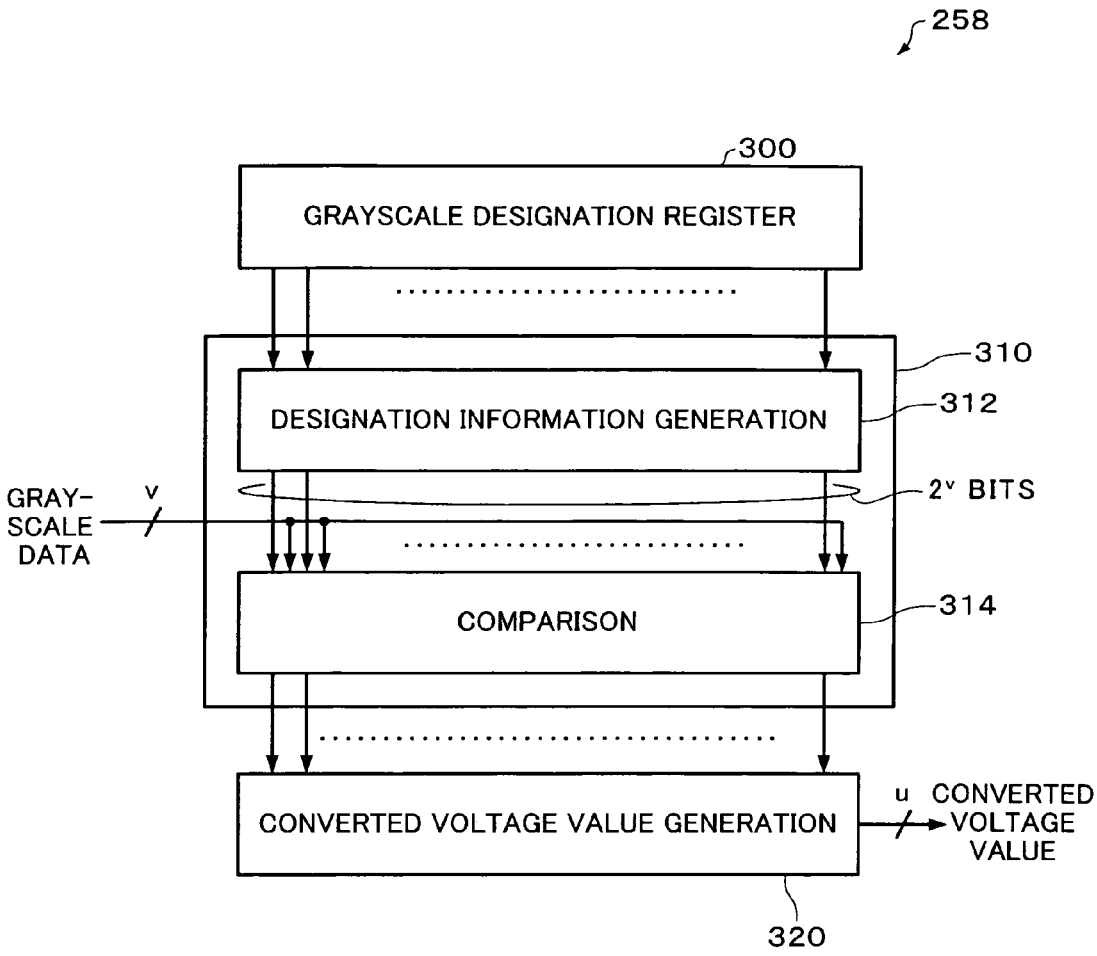
FIG. 13 is a block diagram showing a circuit configuration example of the voltage value conversion circuit shown in FIG. 12.

FIG. 13 is a block diagram showing a circuit configuration example of the voltage value conversion circuit 258 shown in FIG. 12.

In FIG. 13, blocks corresponding to the blocks of the voltage value conversion circuit 258 shown in FIG. 12 are indicated by the same symbols. Description of these blocks is appropriately omitted.

In FIG. 13, the grayscale designation information set in the grayscale designation register 300 is $2^u$ bits. Therefore, the grayscale designation information is 256 bits when u is eight. A flag indicating whether or not the v-bit grayscale data has been assigned to one of the $2^u$ voltages is set in each bit.

Figure 14:
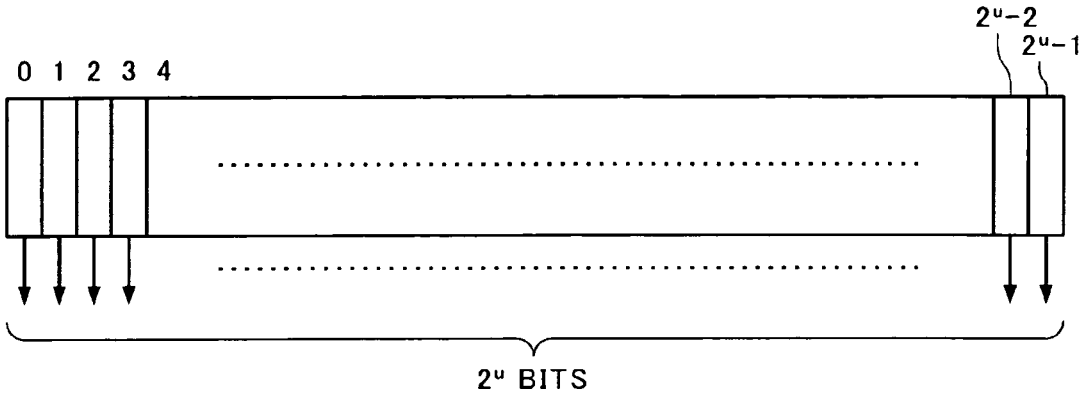
FIG. 14 shows a configuration example of grayscale designation information shown in FIG. 13.

FIG. 14 shows a configuration example of the grayscale designation information set in the grayscale designation register 300 shown in FIG. 13.

In FIG. 14, each bit is assigned to one of the $2^u$ voltage values. "1" is set in a bit to which the voltage value corresponding to the v-bit grayscale data is assigned, and "0" is set in a bit to which the voltage value corresponding to the v-bit grayscale data is not assigned.

For example when u is eight, v is six, and the voltage value corresponding to the 6-bit grayscale data is assigned, only $2^6$ bits of the $2^8$-bit grayscale designation information are set at "1", and the remaining bits are set at "0".

In FIG. 13, the grayscale data determination circuit 310 includes a designation information generation circuit 312 and a comparison circuit 314.

The designation information generation circuit 312 generates $2^v$ types of designation information based on the grayscale designation information. When the number of bits of the grayscale data is v, the designation information generation circuit 312 generates $2^v$ types of designation information based on the grayscale designation information.

The comparison circuit 314 compares the v-bit grayscale data (grayscale number before conversion) with the designation information. This enables a voltage value to which the v-bit grayscale data is assigned to be determined from the $2^u$ voltage values. The converted voltage value generation circuit 320 generates the converted voltage value indicated by the u-bit data based on the comparison result of the comparison circuit 314 as the determination result of the grayscale data determination circuit 310.

An outline of the operation of the configuration example shown in FIG. 13 is described below before describing the configuration of each block shown in FIG. 13.

Figure 15:
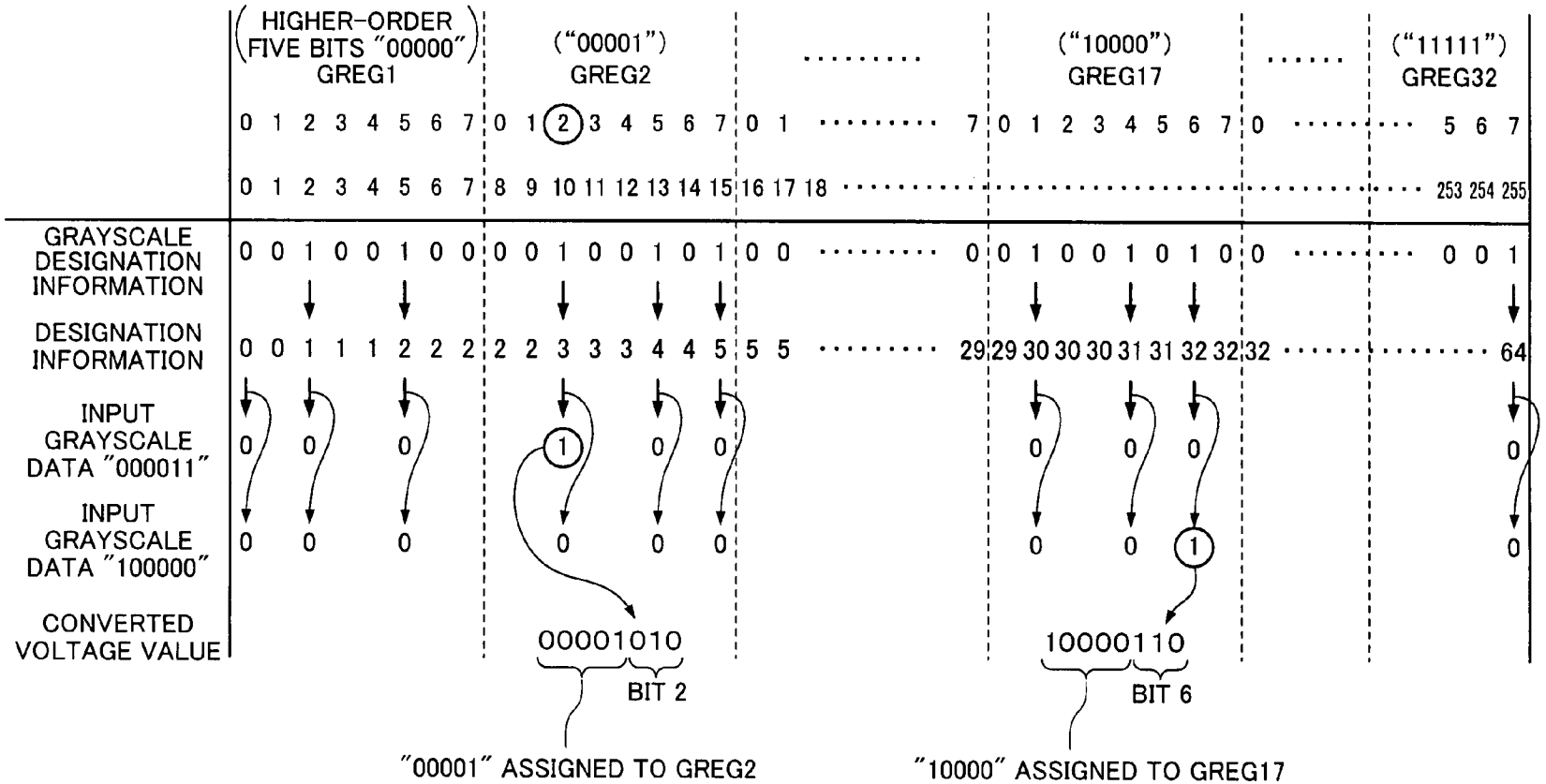
FIG. 15 is illustrative of an outline of the operation of the circuit configuration example of the voltage value conversion circuit shown in FIG. 13.

FIG. 15 is a diagram illustrative of an outline of the operation of the circuit configuration example of the voltage value conversion circuit 258 shown in FIG. 13.

The grayscale designation information is divided into blocks. Then, whether or not the grayscale number before conversion indicated by the v-bit grayscale data coincides with the designation information is determined in block units. The converted voltage value is generated in block units by using the determination result.

In order to generate the converted voltage value, block data specific to each block is assigned to each block. In FIG. 15, the $2^8$-bit grayscale designation information is divided into 32 blocks in eight bit units, and 5-bit block data is assigned to each block. In FIG. 15, block data "00000" is assigned to a block GREG1 to which the zeroth to seventh bits of the 256-bit grayscale designation information belong, for example. In FIG. 15, block data "00001" is assigned to a block GREG2 to which the eighth to fifteenth bits of the 256-bit grayscale designation information belong. In FIG. 15, block data "11111" is assigned to a block GREG32 to which the 248th to 255th bits of the 256-bit grayscale designation information belong.

The designation information generation circuit 312 generates the designation information in the direction from the zeroth bit to the 255th bit of the grayscale designation information based on the state of the flag set in each bit. In more detail, the designation information generation circuit 312 detects whether or not the flag set in each bit is set at "1" in the direction from the zeroth bit to the 255th bit of the grayscale designation information. The designation information generation circuit 312 increments a count value, which is set at "0" at the zeroth bit of the grayscale designation information, on condition that the flag is set at "1", and sets the count value as the designation information. In the example shown in FIG. 15, the count value which is set at "0" at the zeroth bit of the grayscale designation information is incremented to "1" at the second bit, and is incremented to "2" at the fifth bit. The count value is incremented in this manner until the 255th bit is reached. When v is six, the count value becomes "64" at the 255th bit.

The comparison circuit 314 determines the block in which the grayscale data which is the grayscale number before conversion coincides with the designation information as a coincident block. The comparison circuit 314 determines the bit position in the coincident block at which "1" is set (designated) in the flag in the grayscale designation information and the grayscale data coincides with the designation information. In FIG. 15, when 6-bit grayscale data "000011" is input, the comparison circuit 314 determines that the block GREG2 is the coincident block and the second bit in the block GREG2 (tenth bit of the grayscale designation information) is the bit position. The bit data is assigned to the bit position in each block.

It is desirable that the grayscale data determination circuit 310 increment the designation information after the comparison circuit 314 has performed the comparison operation. This enables correct comparison with the designation information even when the 6-bit grayscale data is "0".

The converted voltage value generation circuit 320 generates the converted voltage value based on the block data assigned to the coincident block and the bit data corresponding to the bit position.

In FIG. 15, when 6-bit grayscale data "000011" is input, data "00001010" which specifies the converted voltage value is generated based on the block data "00001" of the block GREG2 and the bit data "010" (binary representation of "2") corresponding to the second bit of the block GREG2. Specifically, the block data is set in the higher-order five bits of the data, and the bit data is set in the lower-order three bits. Thus, 8-bit data which specifies one of the 28 voltage values is generated.

In FIG. 15, when 6-bit grayscale data "100000" is input, the grayscale data is determined to coincide with the designation information "32". Therefore, the comparison circuit 314 determines that the block GREG17 is the coincident block and the sixth bit is the bit position. Since the block data of the block GREG17 is "10000" and the bit data corresponding to the bit position is "110" (binary representation of "6"), 8-bit data "10000110" is generated.

Figure 16:
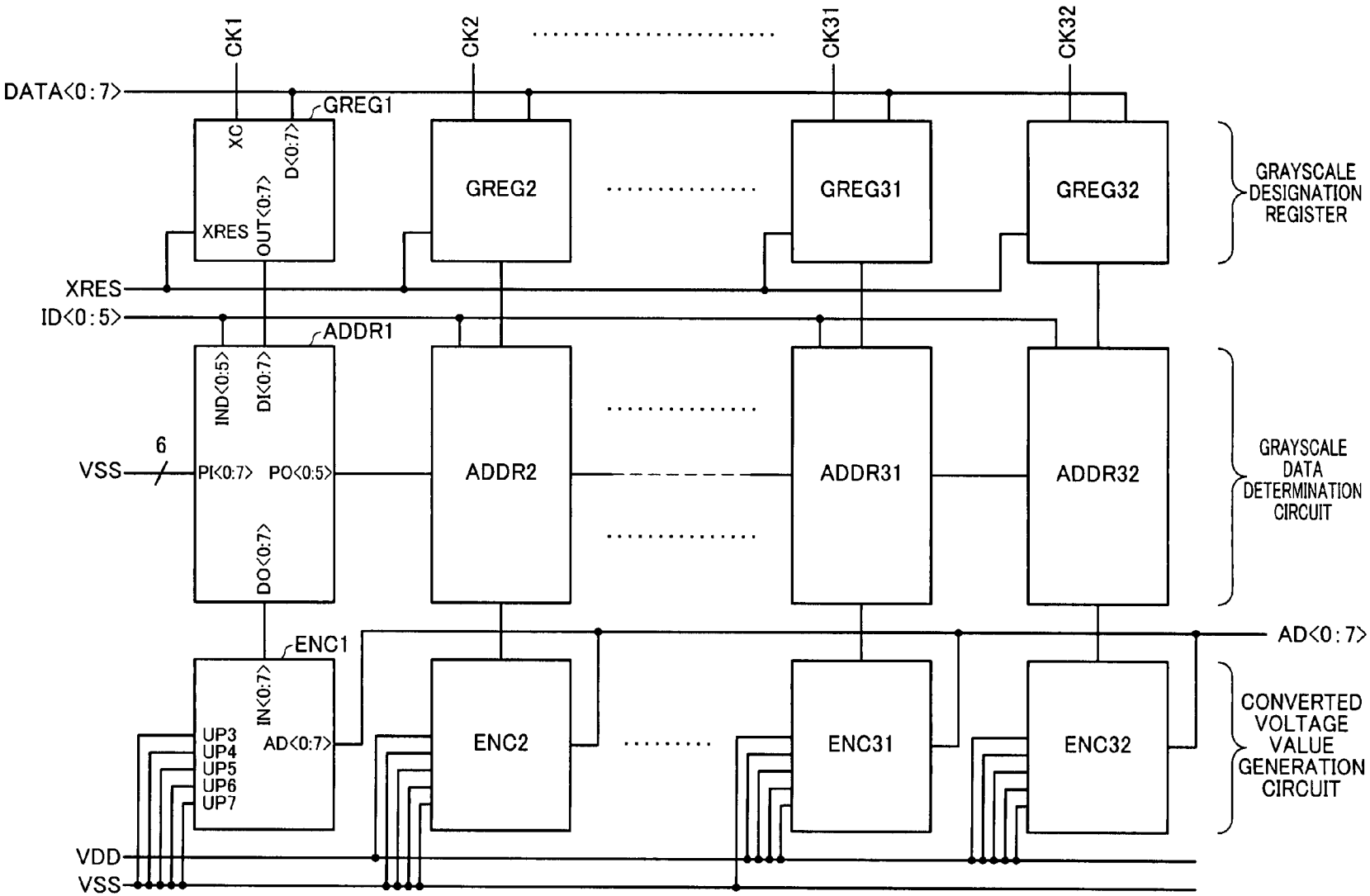
FIG. 16 is a block diagram showing a detailed circuit configuration example of the voltage value conversion circuit shown in FIG. 13.

FIG. 16 is a block diagram showing a detailed circuit configuration example of the voltage value conversion circuit 258 shown in FIG. 13.

In FIG. 16, the grayscale designation information is supplied to each block in 8-bit units by using data DATA<0:7>. The data DATA<0:7> is input to the block GREGq ($1 \leqq q \leqq 32$, q is an integer) at the change timing of a write clock signal CKq. Each of the blocks GREG1 to GREG32 has the same configuration.

The 8-bit grayscale designation information from the block GREGq is supplied to a block ADDRq provided in block units as the grayscale data determination circuit 310. 6-bit grayscale data is input to the block ADDRq as data ID<0:5>, and the block ADDRq outputs the determination result as data DO<0:7>.

The data DO<0:7> is input to a block ENCq provided in block units as the converted voltage value generation circuit 320. 5-bit block data is assigned to each of the blocks ENC1 to ENC32. The block data consists of five bits UP3 to UP7. The block ENCq outputs data AD<0:7> as data for specifying the converted voltage value.

Figure 17:
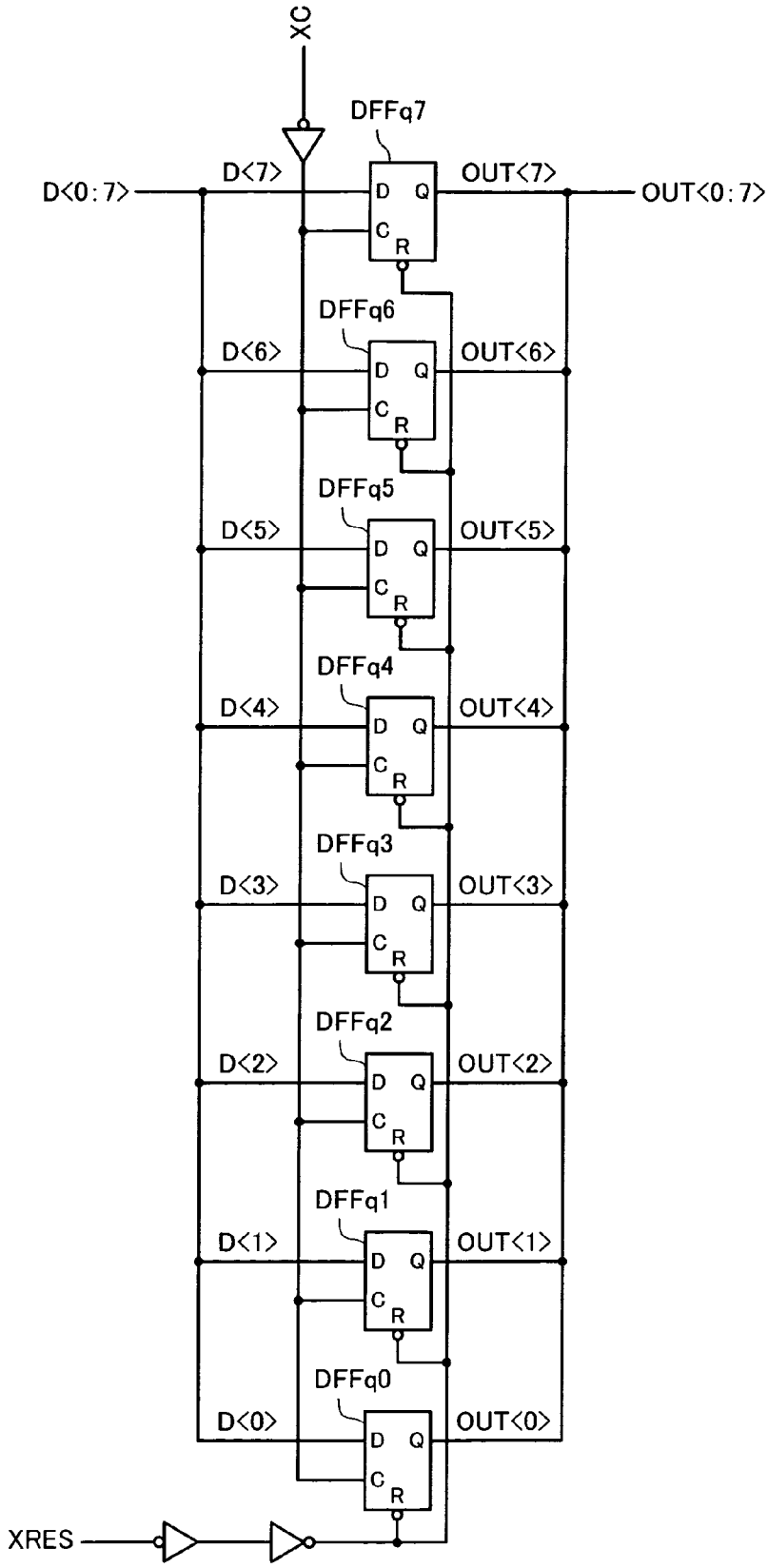
FIG. 17 is a circuit diagram showing a configuration example of a block GREGq shown in FIG. 16.

FIG. 17 is a circuit diagram showing a configuration example of the block GREGq shown in FIG. 16.

The block GREGq includes eight D flip-flops (hereinafter may be abbreviated as "DFF") DFFq0 to DFFq7. The data D<0:7> is supplied to the flip-flops DFFq0 to DFFq7, and data of each bit of the grayscale designation information is input based on an inversion signal XC.

Figure 18:
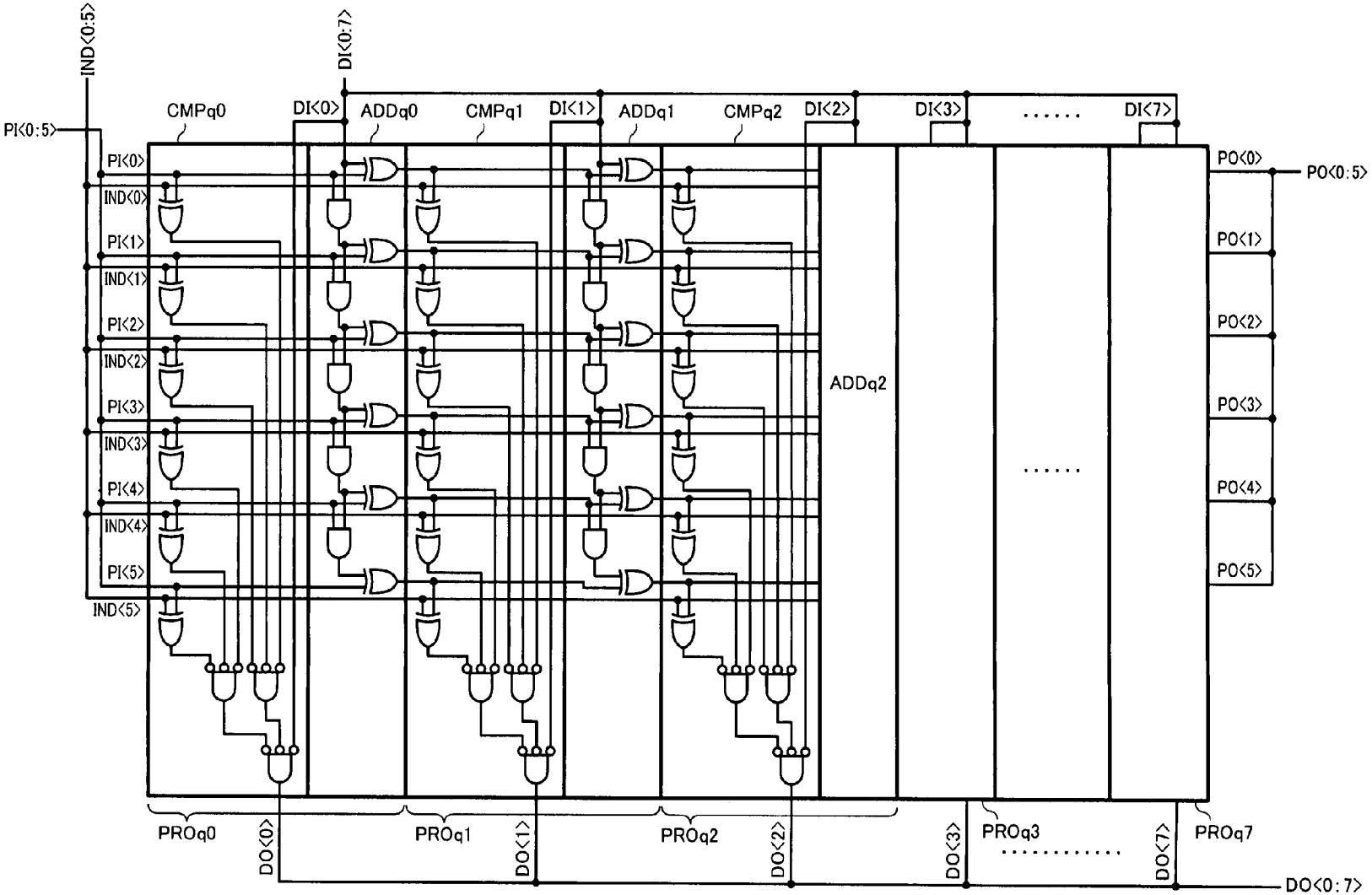
FIG. 18 is a circuit diagram showing a configuration example of a block ADDRq shown in FIG. 16.

FIG. 18 is a circuit diagram showing a configuration example of the block ADDRq shown in FIG. 16.

The block ADDRq includes comparison calculation circuits PROq0 to PROq7 provided in bit units of data DI<0:7>. The comparison calculation circuit PROqr ($0 \leqq r \leqq 7$, r is an integer) includes a comparison circuit CMPqr and an adder circuit ADDqr. Specifically, the comparison calculation circuit PROq0 is provided corresponding to the data DI<0> and includes the comparison circuit CMPq0 and the adder circuit ADDq0. Likewise, the comparison calculation circuit PROq7 is provided corresponding to the data DI<7> and includes the comparison circuit CMPq7 and the adder circuit ADDq7.

A signal IND<0:5> is input to the comparison calculation circuit PROq0 as a signal indicating 6-bit grayscale data. A signal PI<0:5> indicates the designation information. The signal PI<0:5> is output to the comparison calculation circuit either directly or as an incremented value corresponding to data of each bit of the data DI<0:7> which indicates eight bits of the 256-bit grayscale designation information. A signal indicating the designation information "0" is input as the signal PI<0:5> of the comparison calculation circuit PROq0.

The comparison circuit CMPq0 compares the signal PI<0:5> indicating the designation information with the signal IND<0:5> indicating the grayscale data, and outputs the signal DO<0> which is set at the H level when the signal PI<0:5> coincides with the signal IND<0:5> and is set at the L level when the signal PI<0:5> does not coincide with the signal IND<0:5>.

The comparison circuit CMPq0 performs mask control so that, when the signal PI<0:5> coincides with the signal IND<0:5>, the signal DO<0> is set at the H level on condition that the signal DI<0> is set at the H level. This is because, since the signal PI<0:5> indicates the designation information irrespective of the assignment state of the 6-bit grayscale data to the 256 grayscales, it is necessary to prevent the signal DO<0> from being set at the H level at the grayscale of the 256 voltage values to which the 6-bit grayscale data is not assigned. In FIG. 15, the signal PI<0:5> indicating the designation information indicates "3" from the tenth to twelfth bits of the 256-bit grayscale designation information. In this case, a coincidence signal indicating that the grayscale data coincides with the designation information can be set at the H level at the tenth bit at which the bit flag of the grayscale designation information is set at "1", and the coincidence signal can be set at the L level at the eleventh and twelfth bits.

The adder circuit ADDq0 adds the 1-bit data DI<0> of the grayscale designation information and the data PI<0:5>, and supplies the addition result as the data PI<0:5> of the comparison calculation circuit PROq1.

Likewise, the comparison calculation circuit PROq1 compares the data PI<0:5> from the adder circuit ADDq0 with the grayscale data IND<0:5> in the comparison circuit CMPq1, and outputs the comparison result as the data DO<1>. The adder circuit ADDq1 adds the data PI<0:5> and the data DI<1>, and supplies the addition result as the data PI<0:5> of the comparison calculation circuit PROq2.

The data DO<0:7> output in units of comparison calculation circuits is supplied to the block ENCq. The addition result of the adder circuit ADDq7 of the comparison calculation circuit PROq7 is supplied to the comparison circuit CMP (q+1)0 and the adder circuit (q+1)0 of the comparison calculation circuit PRO(q+1)0 in the next block ADDR(q+1) as data PO<0:5>.

Figure 19:
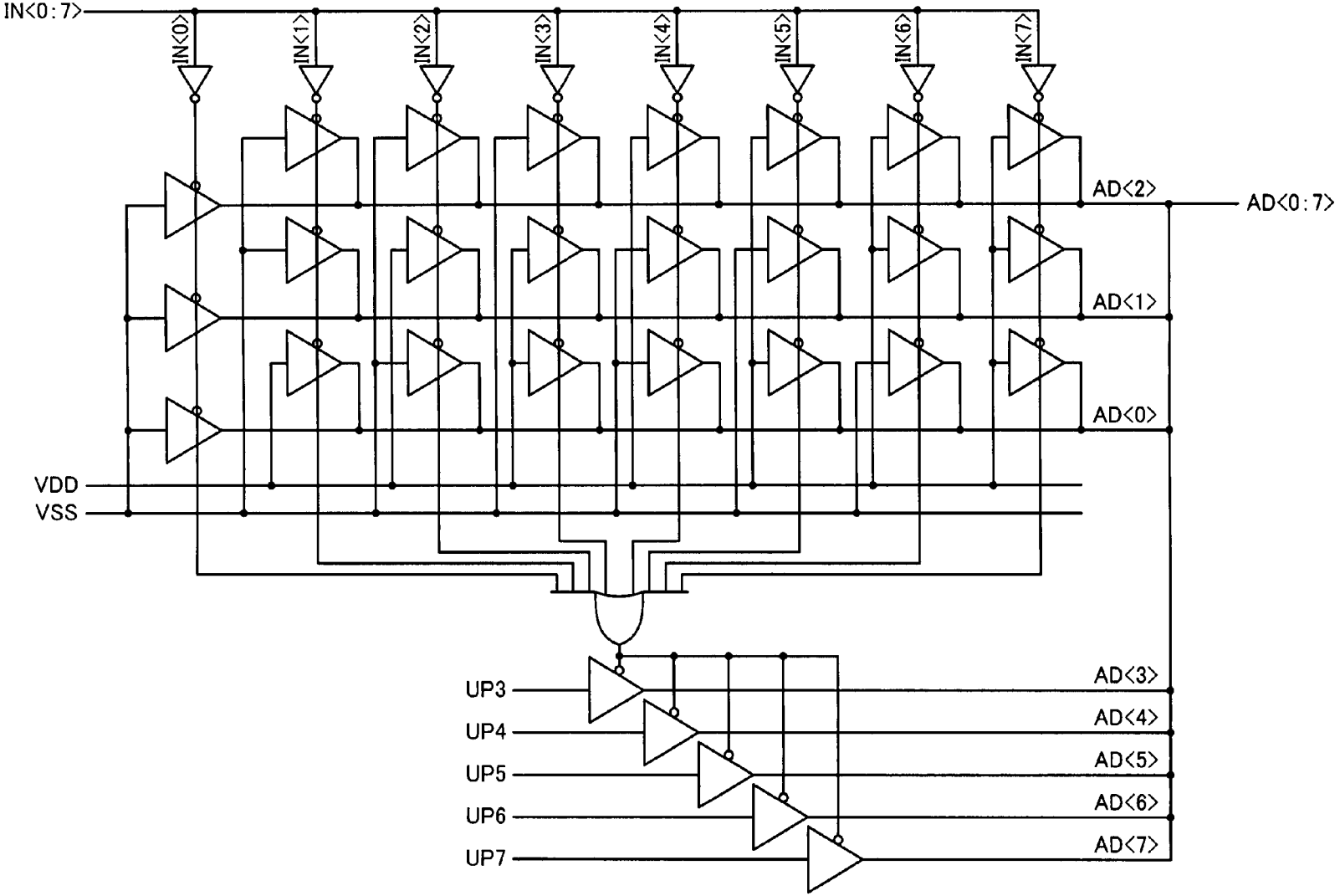
FIG. 19 is a circuit diagram showing a configuration example of a block ENCq shown in FIG. 16.

FIG. 19 is a circuit diagram showing a configuration example of the block ENCq shown in FIG. 16.

The data DO<0:7> from the block ADDRq is input to the block ENCq as data IN<0:7>. The block ENCq encodes the data IN<0:7> with 3-bit data AD<0:2>. This enables the bit data corresponding to the bit position in each block to be output.

The block ENCq determines whether or not one of the bits of the data IN<0:7> is set at the H level. This enables determination of whether or not the block is the coincident block in which the grayscale data, which is the grayscale number before conversion, coincides with the designation information. Specifically, the output of the data UP3 to UP7 is controlled by using the bit-unit logical OR result of the data IN<0:7>. The data UP3 to UP7 is data specific to the block ENCq as the block data.

This configuration allows the block ENCq to set the data AD<0:2> in a high impedance state and sets the data AD<3:7> in a high impedance state when each bit of the data IN<0:7> is set at the L level.

When one of the bits of the data IN<0:7> is set at the H level, the block ENCq outputs the encoding result as the data AD<0:2>. For example, when the data IN<3> is set at the H level, the block ENCq outputs "100" as the data AD<0:2>. The block ENCq outputs the block data as the data AD<3:7>. For example, the block ENC10 outputs "01001" as the data AD<3:7>.

The block ENCq combines the bits of the data AD<0:2> and the data AD<3:7>, and outputs the data AD<0:7> as 8-bit data for specifying the converted voltage value.

The voltage value conversion circuit having the above-described function may be realized by using a read only memory (ROM) circuit. However, since the circuit scale is increased when using the ROM circuit, the chip area of the data driver including the ROM circuit is increased so that cost is increased.

In this case, when manufacturing the ROM circuit by using a 0.25-μm process, the size of one cell of the ROM is 15 $m^2$. Therefore, a cell area of "64 (address)×15 ($\mu m^2$/cell)×8 (cell) =7680 $\mu m^2$" is necessary per color component. Moreover, since an address decoder which decodes the address is necessary, a total area of about 9000 $\mu m^2$ is necessary.

On the other hand, only a width of about 300 μm and a length of about 15 μm are necessary when manufacturing the above-described circuit configuration using the same manufacturing process.

Therefore, a circuit realized according to one embodiment of the invention can significantly reduce the circuit scale in comparison with the ROM circuit. Moreover, since it is unnecessary to use a special manufacturing process in order to reduce the scale of the ROM circuit, the manufacturing cost can be reduced.

2.3 Evaluation Method

In one embodiment of the invention, the common electrode voltage VCOM of the power supply circuit 100 is changed while associating the common electrode voltage VCOM with the grayscale data (line data) for one scan line corresponding to the voltage applied to the pixel electrode. The common electrode voltage VCOM of the power supply circuit 100 may be changed while associating the common electrode voltage VCOM with the amount of change in the grayscale data (line data) for one scan line corresponding to the amount of change in the voltage applied to the pixel electrode.

In one embodiment of the invention described below, the line value calculation circuit 260 shown in FIG. 8 converts the grayscale data forming the line data according to the grayscale characteristics to calculate the converted voltage value. The converted voltage value is sequentially added for one scan line to calculate the total value.

The power supply circuit 100 estimates (evaluates) the voltage applied to the pixel electrode or the amount of change in the applied voltage based on the total value, and changes the supply capability of the common electrode voltage VCOM based on the estimation result (evaluation result). This prevents unnecessary current consumption of the power supply circuit 100. This also applies to the case of changing the supply capability of the common electrode voltage VCOM based on the amount of change in the total value.

Figure 20:
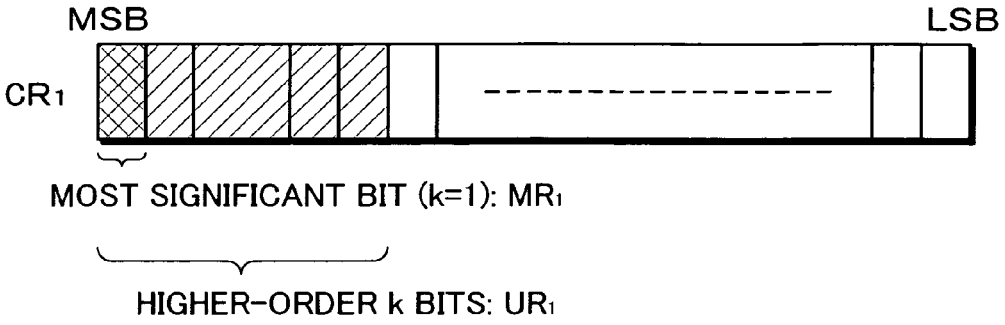
FIG. 20 shows a configuration example of data indicating a converted voltage value per dot.

FIG. 20 shows a configuration example of data indicating the converted voltage value per dot.

FIG. 20 shows a configuration example of the grayscale data corresponding to the voltage supplied to the data line DL1 (output line OL-1). A voltage corresponding to the grayscale data of the R component forming one pixel is supplied to the data line DL1. A converted voltage value obtained by converting the grayscale data according to the grayscale characteristics of the LCD panel 20 is applied as the voltage applied to the pixel electrode.

The number of bits of converted voltage value data $CR_1$ which specifies the converted voltage value obtained by converting the grayscale data of the R component according to the grayscale characteristics is j (j is an integer greater than one). In this case, higher-order k-bit (k<j, k is a natural number) data of the converted voltage value data $CR_1$ includes the most significant bit (MSB) of the converted voltage value data $CR_1$ and is higher-order k-bit data $UR_1$ from the MSB side. When k is "1", the most significant bit of the converted voltage value data CR1 is data $MR_1$ shown in FIG. 20.

Figure 21:
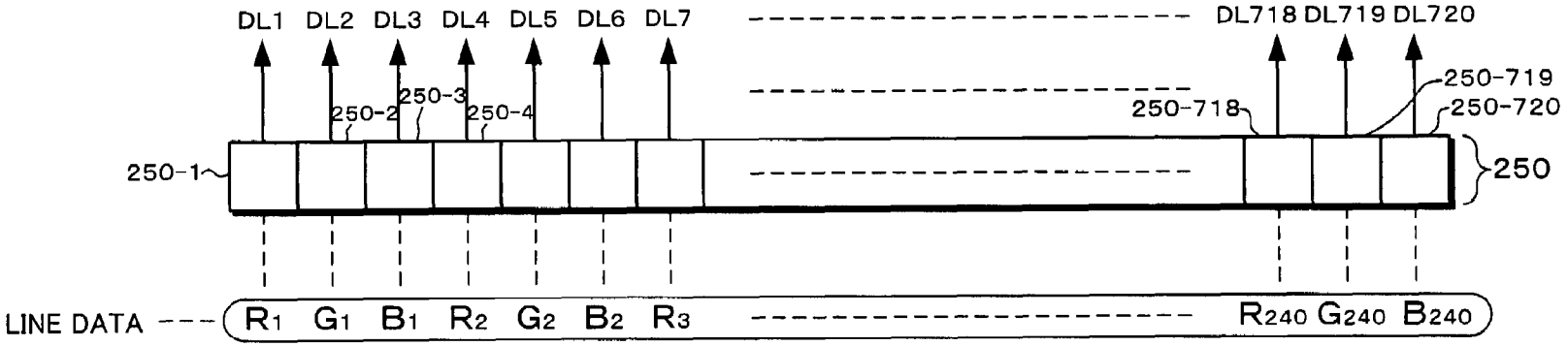
FIG. 21 is illustrative of an example of calculation processing of a line value calculation circuit shown in FIG. 8.

FIG. 21 is a diagram illustrative of an example of calculation processing of the line value calculation circuit 260 shown in FIG. 8.

In FIG. 21, one pixel is formed by three dots, and the number of pixels for one scan line is 240 (=720 dots).

In one embodiment of the invention, the driver circuit 250-1 drives the data line DL1 based on grayscale data of the R component making up one pixel. The driver circuit 250-2 drives the data line DL2 based on grayscale data $R_1$ of the G component making up one pixel. The driver circuit 250-3 drives the data line DL3 based on grayscale data $B_1$ of the B component making up one pixel. The grayscale data for a pixel $P_1$ is made up of the grayscale data $R_1$, $G_1$, and $B_1$.

Likewise, the driver circuit 250-4 drives the data line DL4 based on grayscale data $R_2$ of the R component making up one pixel. The driver circuit 250-5 drives the data line DL5 based on the grayscale data $G_2$ of the G component making up one pixel. The driver circuit 250-6 drives the data line DL6 based on the grayscale data $B_2$ of the B component making up one pixel. The grayscale data for a pixel $P_2$ is made up of the grayscale data $R_2$, $G_2$, and $B_2$.

Likewise, the driver circuit 250-718 drives the data line DL718 based on grayscale data $R_{240}$ of the R component making up one pixel. The driver circuit 250-719 drives the data line DL719 based on the grayscale data $G_{240}$ of the G component making up one pixel. The driver circuit 250-720 drives the data line DL720 based on grayscale data $B_{240}$ of the B component making up one pixel. The grayscale data for a pixel $P_{240}$ is made up of the grayscale data $R_{240}$, $G_{240}$, and $B_{240}$.

The line value calculation circuit 260 calculates a total value TOTAL1, which is obtained by sequentially adding converted voltage value data obtained by converting the grayscale data for the number of dots (=720) of one scan line according to the grayscale characteristics, as the line value. For example, the line value calculation circuit 260 includes an adder and a register. The line value calculation circuit 260 sequentially adds serially input grayscale data, stores the result in the register, and adds the value stored in the register and the subsequent grayscale data. The line value calculation circuit 260 repeatedly performs this operation. In this case, the total value TOTAL1 is shown by the following expression.

$$\text{TOTAL1}=CR_1+CG_1+CB_1+CR_2+CG_2+CB_2+\ldots+CR_{240}+CG_{240}+CB_{240} \quad (1)$$

The line value calculation circuit 260 may calculate a total value TOTAL2, which is obtained by sequentially adding higher-order k-bit data of converted voltage value data obtained by converting the grayscale data for the number of dots (=720) of one scan line according to the grayscale characteristics, as the line value. In this case, the total value TOTAL2 is shown by the following expression.

$$\text{TOTAL2}=UR_1+UG_1+UB_1+UR_2+UG_2+UB_2+\ldots+UR_{240}+UG_{240}+UB_{240} \quad (2)$$

The line value calculation circuit 260 may calculate a total value TOTAL3, which is obtained by sequentially adding the most significant bit (k=1) data of converted voltage value data obtained by converting the grayscale data for the number of dots (=720) of one scan line according to the grayscale characteristics, as the line value. In this case, the total value TOTAL3 is shown by the following expression.

$$\text{TOTAL3}=MR_1+MG_1+MB_1+MR_2+MG_2+MB_2+\ldots+MR_{240}+MG_{240}+MB_{240} \quad (3)$$

The total values TOTAL1, TOTAL2, and TOTAL3 may be associated with the sum total of the voltages applied to the pixel electrode for one scan line according to the grayscale characteristics, and may be used as material for determining whether or not it is necessary to increase the supply capability of the common electrode voltage VCOM or whether or not the voltage level is not changed even if the supply capability is decreased.

When the value obtained by sequentially adding the converted voltage values is indicated by p-bit (p is an integer greater than one) data, a value indicated by higher-order q (q<p, q is a natural number) bits of the value obtained by sequentially adding the converted grayscale data may be employed as the total value.

2.4 Power Supply Circuit

Figure 22:
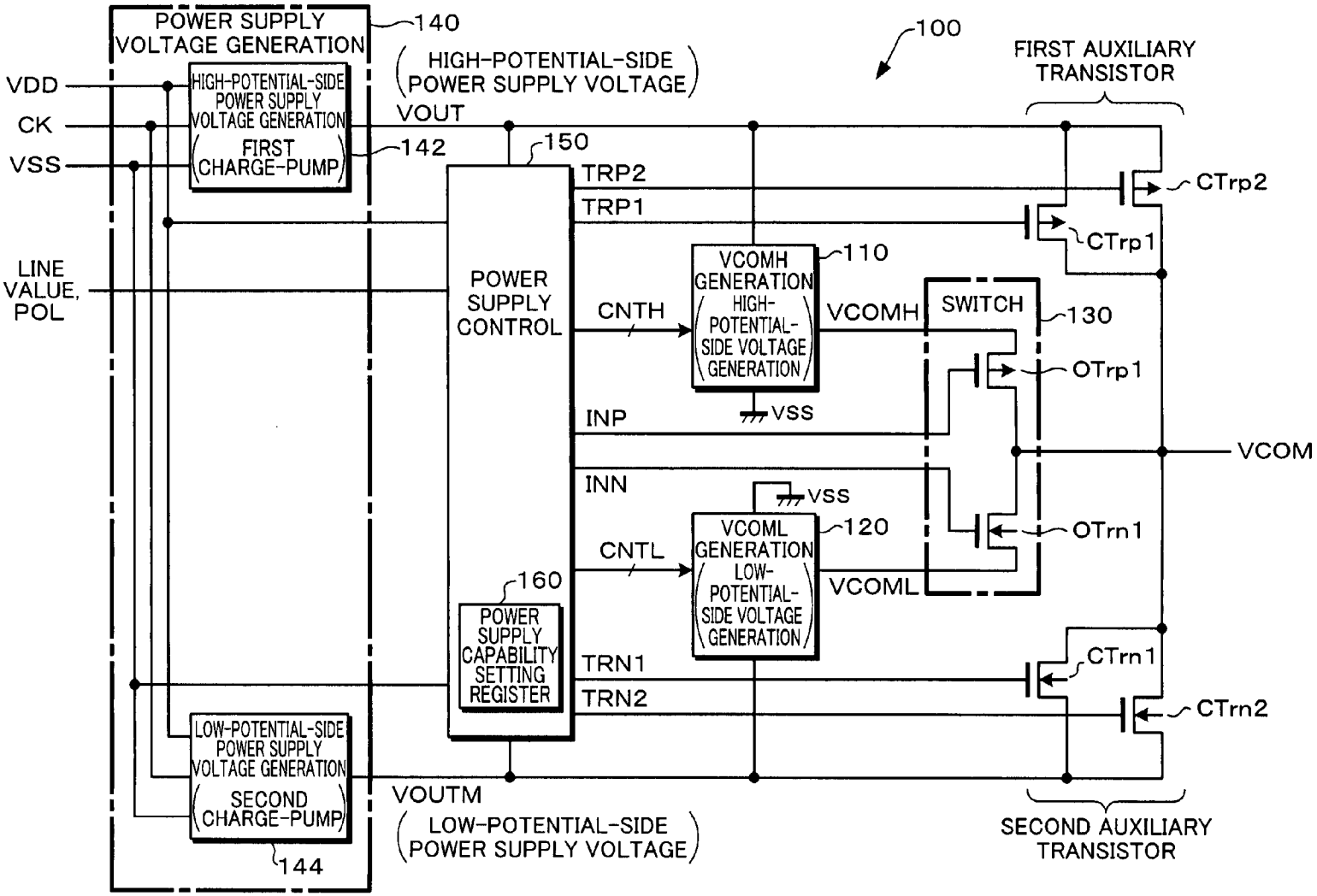
FIG. 22 is a block diagram showing a configuration example of the power supply circuit shown in FIG. 1.

FIG. 22 shows a configuration of the power supply circuit 100 shown in FIG. 1.

The power supply circuit 100 supplies the common electrode voltage VCOM to a common electrode opposite to a pixel electrode through an electro-optical substance. The power supply circuit 100 includes a VCOMH generation circuit (high-potential-side voltage generation circuit) 110, a VCOML generation circuit (low-potential-side voltage generation circuit) 120, and a switch circuit 130. The VCOMH generation circuit 110 generates the high-potential-side voltage VCOMH of the common electrode voltage VCOM. The VCOML generation circuit 120 generates the low-potential-side voltage VCOML of the common electrode voltage VCOM. The switch circuit 130 alternately supplies one of the high-potential-side voltage VCOMH and the low-potential-side voltage VCOML to the common electrode COM as the common electrode voltage VCOM.

The switch circuit 130 may include a P-type (first conductivity type) output metal-oxide-semiconductor (MOS) transistor (MOS transistor is hereinafter abbreviated as "transistor") OTrp1 and an N-type output transistor OTrn1. The high-potential-side voltage VCOMH is supplied to the source of the output transistor OTrp1, and the drain of the output transistor OTrp1 is connected with the drain of the output transistor OTrn1. A gate signal INP is supplied to the gate of the output transistor OTrp1. The low-potential-side voltage VCOML is supplied to the source of the output transistor OTrn1. A gate signal INN is supplied to the gate of the output transistor OTrn1. The drain voltage of the output transistor OTrp1 (drain voltage of the output transistor OTrn1) is output as the common electrode voltage VCOM.

Figure 23:
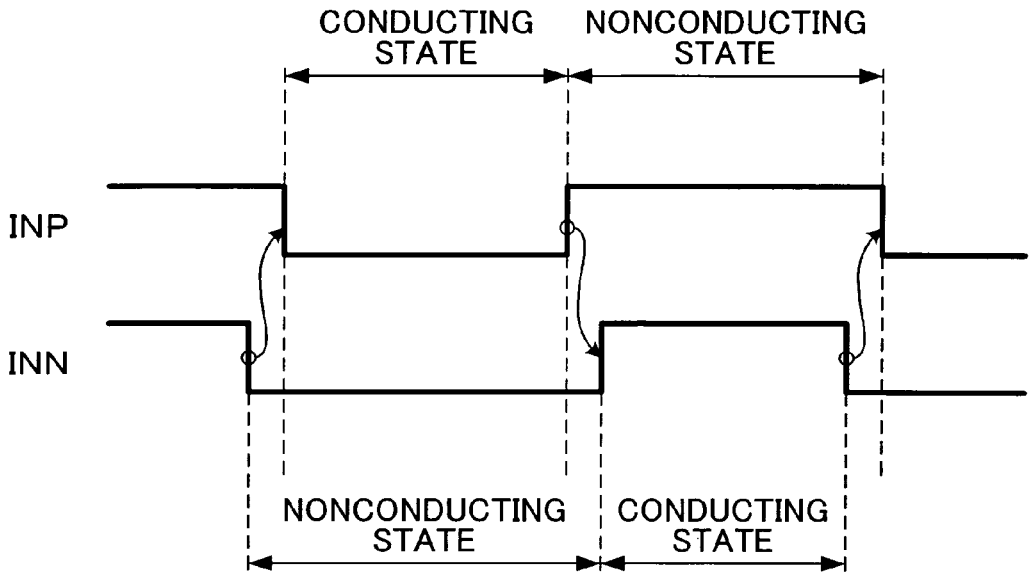
FIG. 23 shows an example of timing of a gate signal shown in FIG. 22.

FIG. 23 shows an example of the timing of the gate signals INP and INN shown in FIG. 22.

The output transistor OTrp1 is set in a conducting state when the gate signal INP is set at the L level, and set in a nonconducting state when the gate signal INP is set at the H level. The output transistor OTrn1 is set in a nonconducting state when the gate signal INN is set at the L level, and set in a conducting state when the gate signal INN is set at the H level.

The gate signals INP and INN are generated so that the output transistors OTrp1 and OTrn1 are not simultaneously set in a conducting state (one or both of the output transistors OTrp1 and OTrn1 are set in a nonconducting state). The gate signals INP and INN are generated so that the period in which the gate signal INP changes from the H level to the L level does not overlap the period in which the gate signal INN changes from the H level to the L level. The gate signals INP and INN are generated so that the period in which the gate signal INP changes from the L level to the H level does not overlap the period in which the gate signal INN changes from the L level to the H level.

This prevents occurrence of a situation in which the source of the output transistor OTrp1 is electrically connected with the source of the output transistor OTrn1, whereby present consumption can be reduced.

The power supply circuit 100 shown in FIG. 22 controls the supply capability of the common electrode voltage VCOM by changing at least one of the current drive capability and the output voltage level of the VCOMH generation circuit (high-potential-side voltage generation circuit) 110 according to the total value obtained by sequentially adding the converted voltage values. The converted voltage value is obtained by converting the grayscale data for the number of dots of one scan line corresponding to the voltage applied to the pixel electrode according to the grayscale characteristics. Or, the power supply circuit 100 controls the supply capability of the common electrode voltage VCOM by changing at least one of the current drive capability and the output voltage level of the VCOML generation circuit (low-potential-side voltage generation circuit) 120 corresponding to the total value. Specifically, the power supply circuit 100 controls the supply capability of the common electrode voltage VCOM by changing at least one of the current drive capability of the VCOMH generation circuit (high-potential-side voltage generation circuit) 110, the output voltage level of the VCOMH generation circuit 110, the current drive capability of the VCOML generation circuit (low-potential-side voltage generation circuit) 120, and the output voltage level of the VCOML generation circuit 120 according to the total value.

The total value is calculated as the line value as described with reference to FIG. 21.

The power supply circuit 100 may include a power supply control circuit 150. The power supply control circuit 150 controls the supply capability of the common electrode voltage VCOM. The power supply control circuit 150 may generate a supply capability control signal for controlling the supply capability. In more detail, the power supply control circuit 150 may generate the supply capability control signal corresponding to the line value from the data driver 30. The power supply control circuit 150 generates the supply capability control signal based on a value set in a power supply capability setting register 160, for example. Control information such as the supply capability control signal which should be output and the output timing is stored in the power supply capability setting register 160 corresponding to the line value from the data driver 30.

The supply capability control signal of the common electrode voltage VCOM includes gate signals TRP1, TRP2, INP, INN, TRN1, and TRN2 and voltage generation control signals CNTH and CNTL. The voltage generation control signal CNTH includes a high-potential-side input voltage LEVINP, a current drive capability control signal BOOSTP, slew rate control signals VREFN1 and VREFN2, and a drive current source control signal REFN for generating the high-potential-side voltage VCOMH. The voltage generation control signal CNTL includes a low-potential-side input voltage LEVINN, a current drive capability control signal BOOSTN, slew rate control signals VREFP1 and VREFP2, and a drive current source control signal REFP for generating the low-potential-side voltage VCOML.

The power supply circuit 100 may include at least one P-type (first conductivity type) first auxiliary transistor to which a high-potential-side power supply voltage VOUT of the VCOM generation circuit (high-potential-side voltage generation circuit) 110 is supplied at the source and which is electrically connected with the output of the switch circuit 130 at the drain. The supply capability may be controlled by controlling the gate voltage of the first auxiliary transistor corresponding to the line value. This enables the current drive capability of the power supply circuit 100 to be increased or decreased. In FIG. 13, P-type transistors CTrp1 and CTrp2 are provided in parallel as the first auxiliary transistors, and controlled by the gate signals TRP1 and TRP2.

The power supply circuit 100 may include at least one N-type (second conductivity type) second auxiliary transistor to which a low-potential-side power supply voltage VOUTM of the VCOML generation circuit (low-potential-side voltage generation circuit) 120 is supplied at the source and which is electrically connected with the output of the switch circuit 130 at the drain. The supply capability may be controlled by controlling the gate voltage of the second auxiliary transistor corresponding to the line value. This enables the current drive capability of the power supply circuit 100 to be increased or decreased. In FIG. 23, N-type transistors CTrn1 and CTrn2 are provided in parallel as the second auxiliary transistors, and controlled by the gate signals TRN1 and TRN2.

The power supply circuit 100 may include a first operational amplifier to which the VCOMH generation circuit 110 (high-potential-side voltage generation circuit) outputs the high-potential-side voltage VCOMH based on the high-potential-side input voltage. When controlling the supply capability of the common electrode voltage VCOM, at least one of the current drive capability and the slew rate of the first operational amplifier may be changed corresponding to the line value. The high-potential-side voltage VCOMH may be changed by changing the high-potential-side input voltage corresponding to the line value. Or, the operating current of the first operational amplifier may be stopped or limited and the input and the output of the first operational amplifier may be electrically connected corresponding to the line value.

The power supply circuit 100 may include a second operational amplifier to which the VCOML generation circuit 120 (low-potential-side voltage generation circuit) outputs the low-potential-side voltage VCOML based on the low-potential-side input voltage. When controlling the supply capability, at least one of the current drive capability and the slew rate of the second operational amplifier may be changed corresponding to the line value. The low-potential-side voltage VCOML may be changed by changing the low-potential-side input voltage corresponding to the line value. Or, the operating current of the second operational amplifier may be stopped or limited and the input and the output of the second operational amplifier may be electrically connected corresponding to the line value.

In FIG. 22, the high-potential-side power supply voltage VOUT and the low-potential-side power supply voltage VOUTM are generated by a power supply voltage generation circuit 140 of the power supply circuit 100. In more detail, the power supply voltage generation circuit 140 includes a high-potential-side power supply voltage generation circuit 142 (first charge-pump circuit) and a low-potential-side power supply voltage generation circuit 144 (second charge-pump circuit). The high-potential-side power supply voltage generation circuit 142 generates the high-potential-side power supply voltage VOUT based on the power supply voltages VDD and VSS. The low-potential-side power supply voltage generation circuit 144 generates the low-potential-side power supply voltage VOUTM based on the power supply voltages VDD and VSS.

The high-potential-side power supply voltage generation circuit 142 generates the high-potential-side power supply voltage VOUT by increasing the voltage between the power supply voltages VDD and VSS in the high-potential direction (positive direction) based on the power supply voltage VSS by a charge-pump operation in synchronization with a first charge clock signal. In this case, the supply capability of the common electrode voltage VCOM may be controlled by stopping the first charge clock signal or reducing the frequency of the first charge clock signal corresponding to the line value.

The low-potential-side power supply voltage generation circuit 144 generates the low-potential-side power supply voltage VOUTM by increasing (decreasing) the voltage between the power supply voltages VDD and VSS in the low-potential direction (negative direction) based on the power supply voltage VSS by a charge-pump operation in synchronization with a second charge clock signal. In this case, the supply capability may be controlled by stopping the second charge clock signal or reducing the frequency of the second charge clock signal corresponding to the line value.

Figure 24:
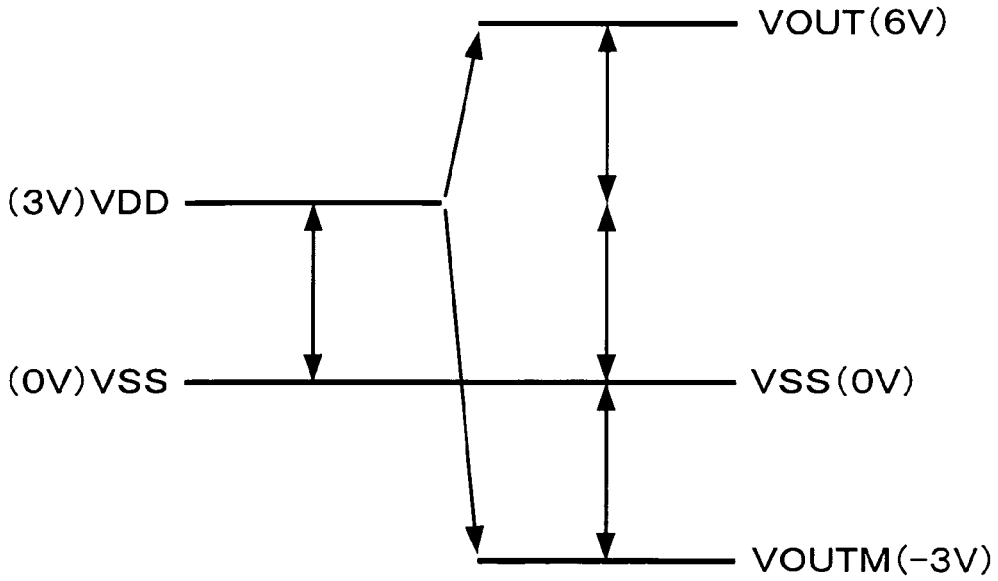
FIG. 24 is schematic illustrative of an operation example of a power supply voltage generation circuit shown in FIG. 22.

FIG. 24 is a schematic diagram illustrative of an operation example of the power supply voltage generation circuit 140 shown in FIG. 22.

The high-potential-side power supply voltage generation circuit 142 generates the high-potential-side power supply voltage VOUT (6 V) by increasing the voltage (3 V) between the power supply voltages VDD and VSS twice in the high-potential direction based on a potential of 0 V (=VSS) by the charge-pump operation in synchronization with the first charge clock signal.

The low-potential-side power supply voltage generation circuit 144 generates the low-potential-side power supply voltage VOUTM (−3 V) by increasing the voltage (3 V) between the power supply voltages VDD and VSS once (=×−1) in the low-potential direction based on a potential of 0 V (=VSS) by the charge-pump operation in synchronization with the second charge clock signal.

In FIG. 22, one charge clock signal is used as the first and second charge clock signals so that the high-potential-side power supply voltage generation circuit 142 and the low-potential-side power supply voltage generation circuit 144 perform the charge-pump operation in synchronization with one charge clock signal CK.

The power supply circuit 100 may perform at least one of the above-described supply capability control operations only in a period calculated based on the line value.

The power supply circuit 100 may perform at least one of the above-described supply capability control operations corresponding to the amount of change between the line value in the present horizontal scan period and the line value in the horizontal scan period immediately before the present horizontal scan period. The power supply circuit 100 may perform at least one of the above-described supply capability control operations for a period corresponding to the amount of change between the line value in the present horizontal scan period and the line value in the horizontal scan period immediately before the present horizontal scan period.

When the grayscale data of each dot is j (j is an integer greater than one) bits, the line value may be a value obtained by sequentially adding higher-order k-bit (k<j, k is a natural number) data of data indicating the converted voltage value obtained by converting the grayscale data of each dot according to the grayscale characteristics. k may be one.

The major portion of the configuration of the power supply circuit 100 shown in FIG. 22 is described below in detail.

Figure 25:
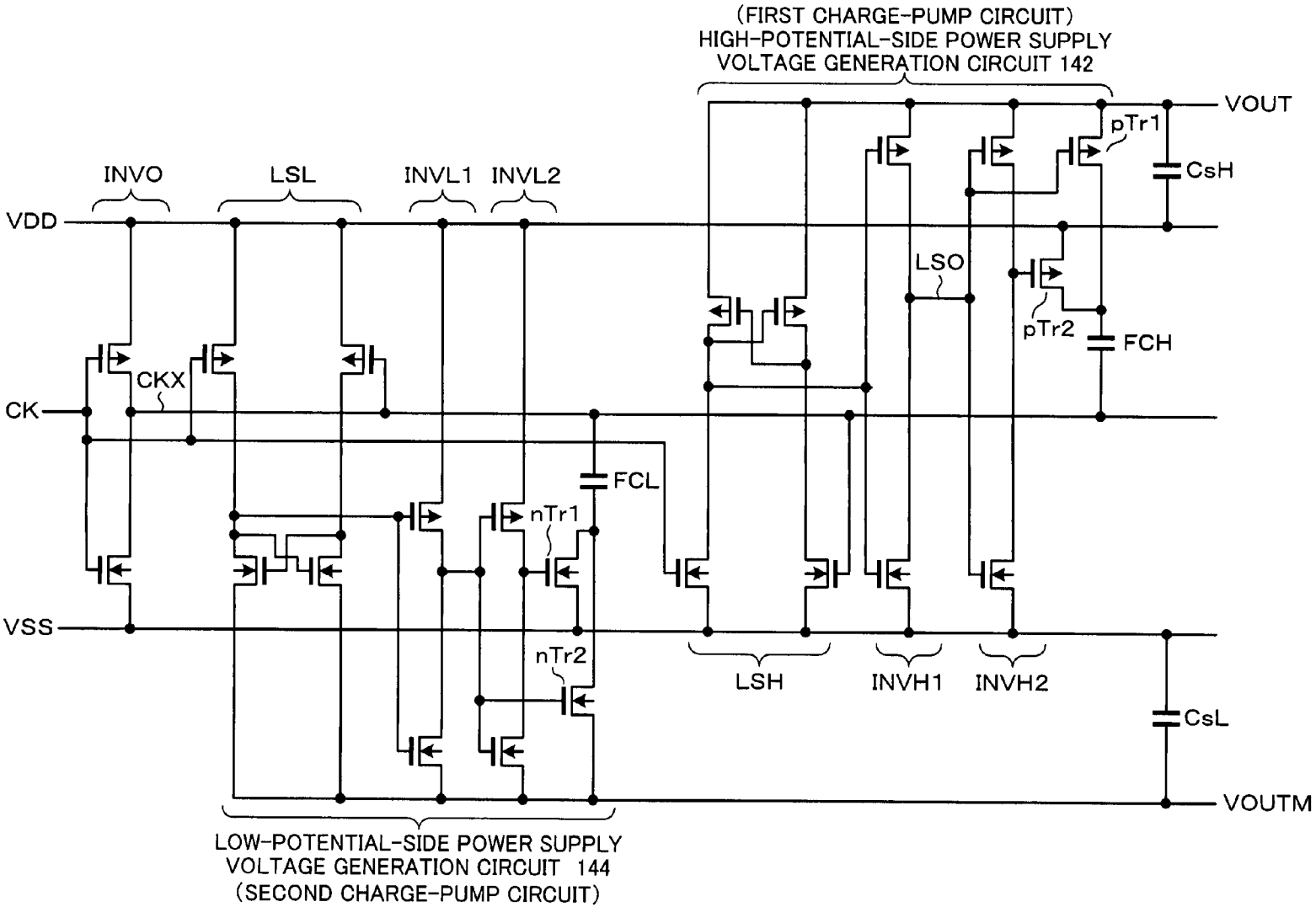
FIG. 25 is a circuit diagram showing a configuration example of the power supply voltage generation circuit shown in FIG. 22.

FIG. 25 is a circuit diagram showing a configuration example of the power supply voltage generation circuit 140 shown in FIG. 22.

The high-potential-side power supply voltage generation circuit 142 includes a level shifter LSH, inverters INVH1 and INVH2, and switching transistors pTr1 and pTr2. In FIG. 25, a flying capacitor FCH and a storage capacitor CsH are connected outside the power supply circuit 100. However, at least one of these capacitors may be provided in the power supply circuit 100 (high-potential-side power supply voltage generation circuit 142).

Figure 26:
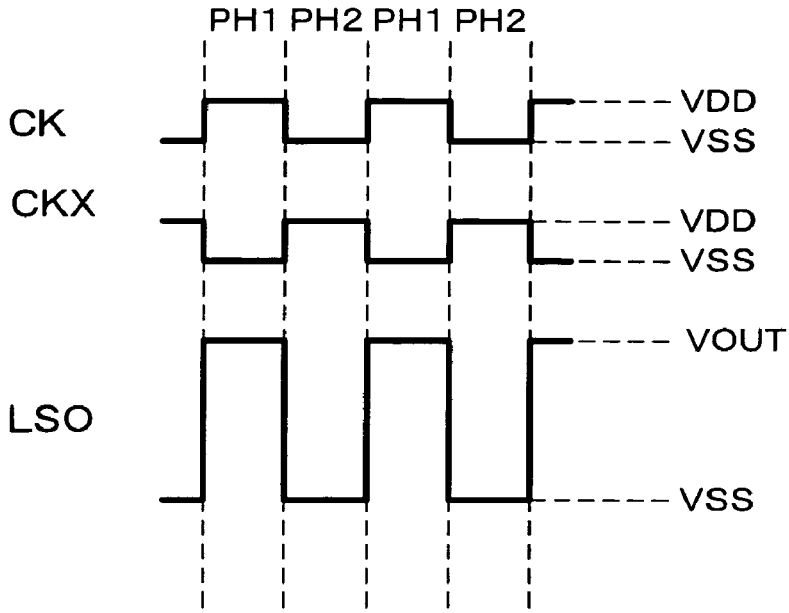
FIG. 26 is a timing diagram illustrative of the operation of a high-potential-side power supply voltage generation circuit.

FIG. 26 is a timing diagram illustrative of the operation of the high-potential-side power supply voltage generation circuit 142.

The charge clock signal CK having the voltage between the power supply voltages VDD and VSS as the amplitude voltage is supplied to the level shifter LSH. When one of two N-type transistors forming the level shifter LSH is set in a conducting state, the other N-type transistor is set in a nonconducting state. For example, the drain voltage of the P-type transistor is determined so that a drain current occurs in the N-type transistor to which the charge clock signal CK is supplied at its gate. The logic level of the output signal of the level shifter LSH is reversed by the inverter INVH1 so that an output signal LSO is obtained. The logic level of the output signal LSO is reversed by the inverter INVH2. The output signal LSO is supplied to a gate of the P-type transistor pTr1. The inversion signal of the output signal LSO is supplied to a gate of the P-type transistor pTr2.

The period in which the logic level of the output signal LSO is set at the H level is called a period PH1, and the period in which the logic level of the output signal LSO is set at the L level is called a period PH2. In the period PH1, the transistor pTr1 is set in a nonconducting state, and the transistor pTr2 is set in a conducting state. Therefore, the voltage VSS of an inversion charge clock signal CKX is supplied to one end of the flying capacitor FCH, and the voltage VDD is supplied to the other end of the flying capacitor FCH. In the period PH2, the transistor pTr1 is set in a conducting state, and the transistor pTr2 is set in a nonconducting state. Therefore, the voltage VDD of the inversion charge clock signal CKX is supplied to one end of the flying capacitor FCH, and the other end is electrically connected with the high-potential-side output power supply line. Since an electric charge corresponding to the voltage between the power supply voltage VDD and VSS has been stored in the flying capacitor FCH in the period PH1, the voltage of the high-potential-side output power supply line is set at a voltage "VDD×2" in the period PH2. The voltage of the high-potential-side output power supply line is output as the voltage VOUT. The voltage level of the high-potential-side output power supply line is retained by the storage capacitor CsH in the period PH1.

The low-potential-side power supply voltage generation circuit 144 includes a level shifter LSL, inverters INVL1 and INVL2, and switching transistors nTr1 and nTr2. In FIG. 16, a flying capacitor FCL and a storage capacitor CsL are connected outside the power supply circuit 100. However, at least one of these capacitors may be provided in the power supply circuit 100 (low-potential-side power supply voltage generation circuit 144).

The operation of the low-potential-side power supply voltage generation circuit 144 is a charge-pump operation similar to that of the high-potential-side power supply voltage generation circuit 142. Therefore, detailed description is omitted. Since an electric charge corresponding to the voltage between the power supply voltages VDD and VSS has been stored in the flying capacitor FCL, the low-potential-side power supply voltage generation circuit 144 supplies a voltage VOUTM in the negative direction with respect to the voltage VSS to the low-potential-side output power supply line. The voltage of the low-potential-side output power supply line is the voltage VOUTM, and the voltage level of the low-potential-side output power supply line is held by the storage capacitor CsL.

In the high-potential-side power supply voltage generation circuit 142 and the low-potential-side power supply voltage generation circuit 144 having such a configuration, the charge clock signal is stopped or the frequency of the charge clock signal is reduced corresponding to the line value or the amount of change in the line value. This enables the supply capability of the common electrode voltage VCOM to be controlled by changing the voltage supply capability of the high-potential-side voltage VCOMH or the low-potential-side voltage VCOML.

Figure 27A:
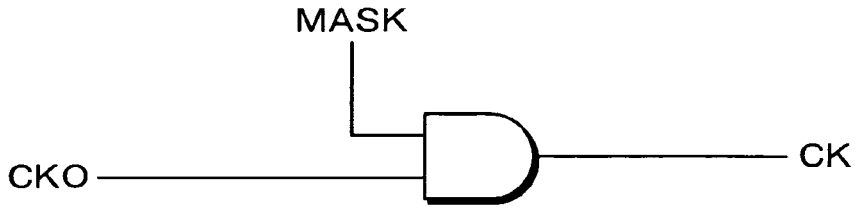
FIGS. 27A and 27B show configuration examples realizing control of a charge clock signal of the power supply voltage generation circuit shown in FIG. 25.
Figure 27B:
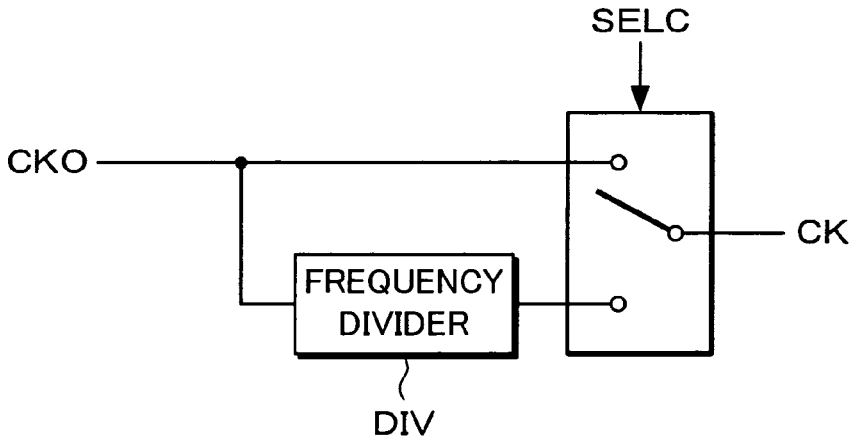

FIGS. 27A and 27B show configuration examples which realize control of the charge clock signal of the power supply voltage generation circuit 140 shown in FIG. 25.

FIG. 27A shows a configuration for masking an original clock signal CKO by using a mask signal MASK generated based on the line value or the amount of change in the line value. In this case, the operation or suspension of the charge clock signal CK is controlled by using the mask signal MASK.

FIG. 27B shows a configuration for reducing the frequency of the charge clock signal CK by using a select signal SELC generated based on the line value or the amount of change in the line value. A frequency divider DIV divides the frequency of the original clock signal CKO by S(S is a number of two or more). One of the original clock signal CKO and the output of the frequency divider DIV selected based on the select signal SELC is output as the charge clock signal CK.

A configuration example of the VCOMH generation circuit 110 and the VCOML generation circuit 120 is described below.

Figure 28:
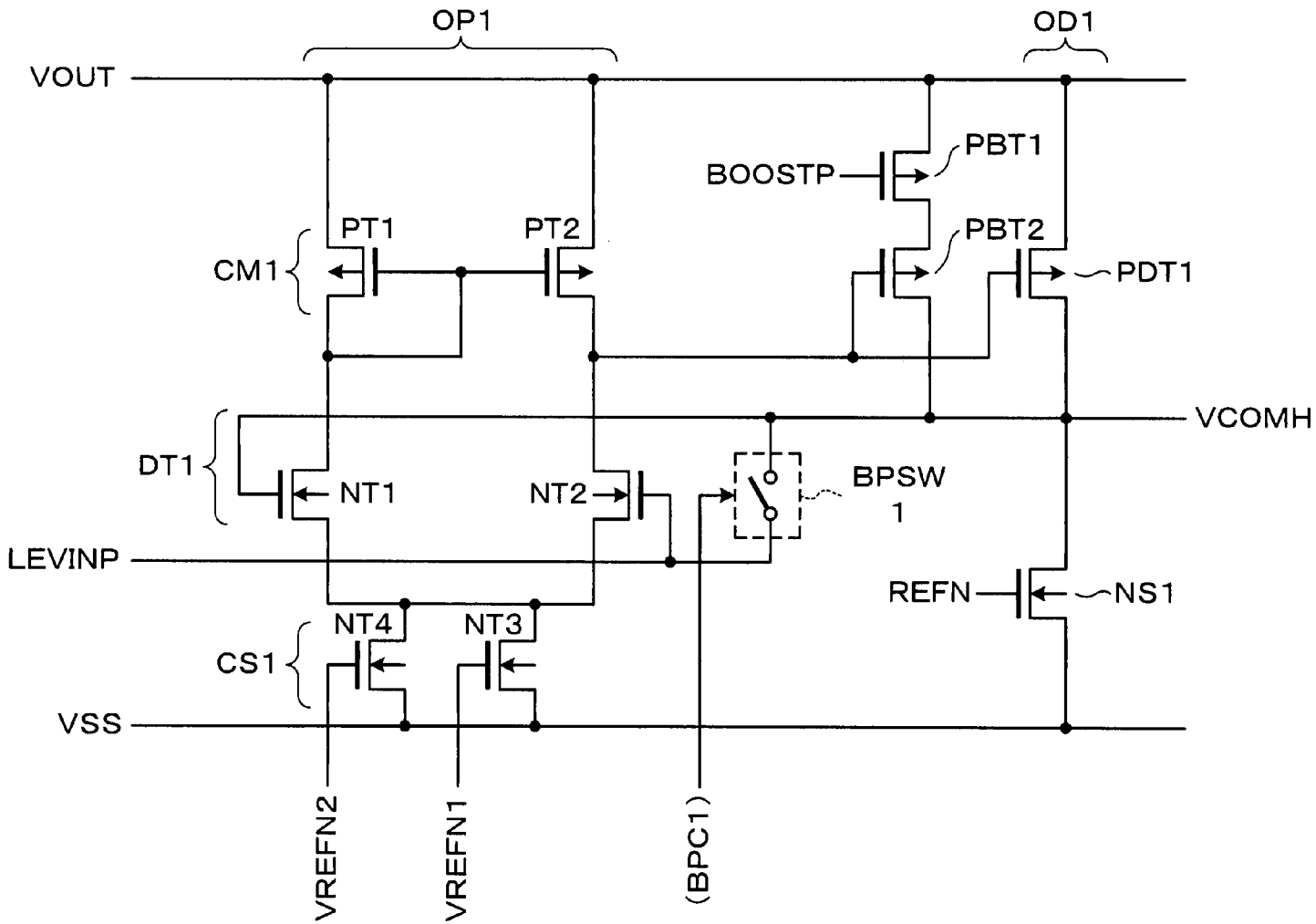
FIG. 28 is a circuit diagram showing a configuration example of a VCOMH generation circuit shown in FIG. 22.

FIG. 28 is a circuit diagram showing a configuration example of the VCOMH generation circuit 110 shown in FIG. 22.

The VCOMH generation circuit 110 includes a differential section OP1 forming the first operational amplifier and an output section OD1.

The differential section OP1 includes a current mirror circuit CM1, a differential transistor pair DT1, and a current source CS1. The current mirror circuit CM1 includes P-type transistors PT1 and PT2 to which the power supply voltage VOUT is supplied at the source. The gates of the transistors PT1 and PT2 are connected, and the gate and the drain of the transistor PT1 are connected.

The differential transistor pair DT1 includes N-type transistors NT1 and NT2. The output voltage VCOMH of the output section OD1 is supplied to the gate of the transistor NT1. A high-potential-side input voltage LEVINP is supplied to the gate of the transistor NT2. The drain of the transistor NT1 is connected with the drain of the transistor PT1. The drain of the transistor NT2 is connected with the drain of the transistor PT2.

The current source CS1 is inserted between the sources of the N-type transistors NT1 and NT2 and the power supply line to which the power supply voltage VSS is supplied. In the current source CS1, two N-type transistors NT3 and NT4 are connected in parallel. The slew rate control signals VREFN1 and VREFN2 are respectively supplied to the gates of the N-type transistors NT3 and NT4. Therefore, the current value of the current source CS1 is controlled corresponding to the slew rate control signals VREFN1 and VREFN2.

The output section OD1 includes a P-type driver transistor PDT1 and an N-type current source transistor NS1. The high-potential-side power supply voltage VOUT is supplied to the source of the P-type driver transistor PDT1. The low-potential-side power supply voltage VSS is supplied to the source of the N-type current source transistor NS1. The voltage of the connection node between the transistor NT2 and the transistor PT2 is supplied to the gate of the P-type driver transistor PDT1. The drive current source control signal REFN is supplied to the gate of the N-type current source transistor NS1. A drain of the P-type driver transistor PDT1 is connected with the drain of the N-type current source transistor NS1. This drain voltage is the output voltage VCOMH.

The output section OD1 includes boost P-type driver transistors PBT1 and PBT2 connected in series and provided in parallel with the P-type driver transistor PDT1. In more detail, the boost P-type driver transistors PBT1 and PBT2 are connected in parallel with the P-type driver transistor PDT1 when a current drive capability control signal BOOSTP is set at the L level. This enables the capability of causing current to flow toward the output to be increased corresponding to the current drive capability control signal BOOSTP.

The VCOMH generation circuit 110 may include a bypass switch BPSW1 which bypasses the input and the output of the differential section OP1. The high-potential-side voltage VCOMH can be set at the high-potential-side input voltage LEVINP by setting the bypass switch BPSW1 in a conducting state by using a bypass control signal BPC1 which ON/OFF controls the bypass switch BPSW1. In this case, it is preferable to stop the current of the current source CS1 and the N-type current source transistor NS1 by using the slew rate control signals VREFN1 and VREFN2 and the drive current source control signal REFN.

The high-potential-side input voltage LEVINP, the slew rate control signals VREFN1 and VREFN2, the current drive capability control signal BOOSTP, the drive current source control signal REFN, and the bypass control signal BPC1 input to the VCOMH generation circuit 110 are supplied from the power supply control circuit 150 shown in FIG. 13.

In the VCOMH generation circuit 110 having such a configuration, suppose that the bypass switch BPSW1 is set in a nonconducting state, the boost P-type driver transistor PBT1 is set in a nonconducting state, and the high-potential-side input voltage LEVINP is higher than the output voltage VCOMH. In this case, since the impedance of the transistor NT1 becomes higher than that of the transistor NT2, the gate voltage of the transistors PT1 and PT2 is increased, so that the impedance of the transistor PT2 is increased. Therefore, the gate voltage of the P-type driver transistor PDT1 is decreased, so that the P-type driver transistor PDT1 approaches the ON state. Therefore, the output voltage VCOMH is increased.

On the other hand, consider the case where the high-potential-side input voltage LEVINP is lower than the output voltage VCOMH. In this case, since the impedance of the transistor NT1 becomes lower than that of the transistor NT2, the gate voltage of the transistors PT1 and PT2 is decreased, so that the impedance of the transistor PT2 is decreased. Therefore, the gate voltage of the P-type driver transistor PDT1 is increased, so that the P-type driver transistor PDT1 approaches the OFF state. Therefore, the output voltage VCOMH is decreased.

As a result of the above-described operation, the VCOMH generation circuit 110 transitions to an equilibrium in which the high-potential-side input voltage LEVINP becomes approximately equal to the output voltage VCOMH.

In the differential section OP1, the reaction rate of each transistor forming the current mirror circuit CM1 and the differential transistor pair DT1 can be increased as the current value of the current source CS1 is increased. Therefore, the slew rate of the VCOMH generation circuit 110 can be increased. The slew rate used herein is the value indicating the maximum inclination of the output voltage per unit time.

In the output section OD1, the capability of causing current to flow toward the node to which the output voltage VCOMH is supplied can be increased by setting the boost P-type driver transistor PBT1 in a conducting state.

Figure 29:
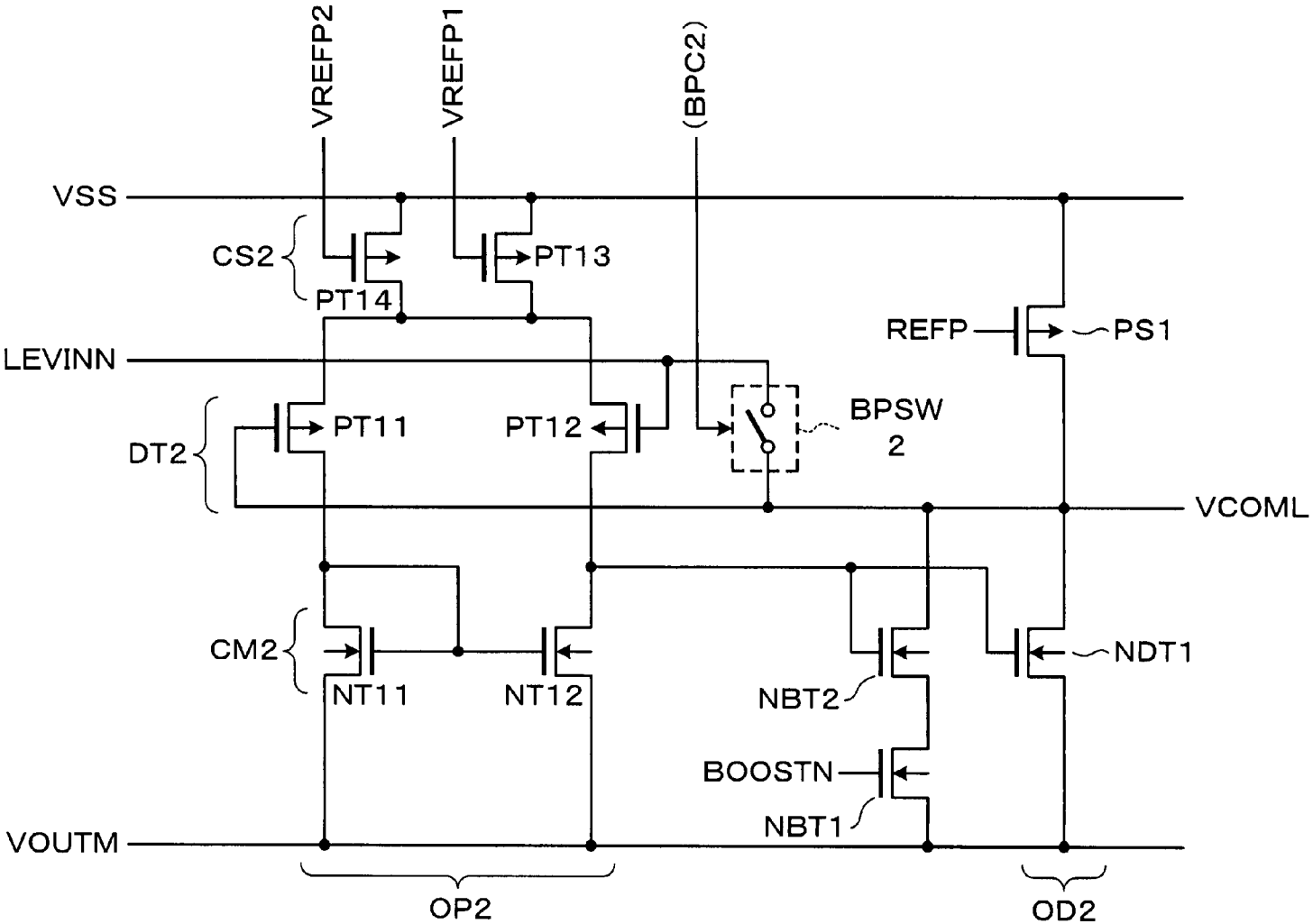
FIG. 29 is a circuit diagram showing a configuration example of a VCOML generation circuit shown in FIG. 22.

FIG. 29 is a circuit diagram showing a configuration example of the VCOML generation circuit 120 shown in FIG. 22.

The VCOML generation circuit 120 includes a differential section OP2 forming the second operational amplifier and an output section OD2.

The differential section OP2 includes a current mirror circuit CM2, a differential transistor pair DT2, and a current source CS2. The current mirror circuit CM2 includes N-type transistors NT1 and NT2 to which the power supply voltage VOUTM is supplied at the source. The gates of the transistors NT1 and NT2 are connected, and the gate and the drain of the transistor NT1 are connected.

The differential transistor pair DT2 includes P-type transistors PT11 and PT12. The output voltage VCOML of the output section OD2 is supplied to the gate of the transistor PT11. A low-potential-side input voltage LEVINN is supplied to the gate of the transistor PT12. The drain of the transistor PT11 is connected with the drain of the transistor NT11. The drain of the transistor PT12 is connected with the drain of the transistor NT12.

The current source CS2 is inserted between the sources of the P-type transistors PT11 and PT12 and the power supply line to which the power supply voltage VSS is supplied. In the current source CS2, two P-type transistors PT13 and PT14 are connected in parallel. The slew rate control signals VREFP1 and VREFP2 are respectively supplied to gates of the P-type transistors PT13 and PT14. Therefore, the current value of the current source CS2 is controlled corresponding to the slew rate control signals VREFP1 and VREFP2.

The output section OD2 includes an N-type driver transistor NDT1 and a P-type current source transistor PS1. The power supply voltage VOUTM is supplied to the source of the N-type driver transistor NDT1. The power supply voltage VSS is supplied to the source of the P-type current source transistor PS1. The voltage of the connection node between the transistor PT12 and the transistor NT12 is supplied to the gate of the N-type driver transistor NDT1. The drive current source control signal REFP is supplied to the gate of the P-type current source transistor PS1. The drain of the N-type driver transistor NDT1 is connected with the drain of the P-type current source transistor PS1. This drain voltage is the output voltage VCOML.

The output section OD2 includes boost N-type driver transistors NBT1 and NBT2 connected in series and provided in parallel with the N-type driver transistor NDT1. In more detail, the boost N-type driver transistors NBT1 and NBT2 are connected in parallel with the N-type driver transistor NDT1 when a current drive capability control signal BOOSTN is set at the H level. This enables the capability of drawing current from the output to be increased corresponding to the current drive capability control signal BOOSTN.

The VCOML generation circuit 120 may include a bypass switch BPSW2 which bypasses the input and the output of the differential section OP2. The low-potential-side voltage VCOML can be set at the low-potential-side input voltage LEVINN by setting the bypass switch BPSW2 in a conducting state by using a bypass control signal BPC2 which ON/OFF controls the bypass switch BPSW2. In this case, it is preferable to stop the current of the current source CS2 and the P-type current source transistor PS1 by using the slew rate control signals VREFP1 and VREFP2 and the drive current source control signal REFP.

The high-potential-side input voltage LEVINN, the slew rate control signals VREFP1 and VREFP2, the current drive capability control signal BOOSTN, the drive current source control signal REFP, and the bypass control signal BPC2 input to the VCOML generation circuit 120 are supplied from the power supply control circuit 150 shown in FIG. 22.

In the VCOML generation circuit 120 having such a configuration, consider the case where the bypass switch BPSW2 is set in a nonconducting state, the boost N-type driver transistor NBT1 is set in a nonconducting state, and the low-potential-side input voltage LEVINN is higher than the output voltage VCOML. In this case, since the impedance of the transistor PT11 becomes higher than that of the transistor PT12, the gate voltage of the transistors NT11 and NT12 is increased, so that the impedance of the transistor NT12 is increased. Therefore, the gate voltage of the N-type driver transistor NDT1 is decreased, so that the N-type driver transistor NDT1 approaches the OFF state. Therefore, the output voltage VCOML is increased.

On the other hand, consider the case where the low-potential-side input voltage LEVINN is lower than the output voltage VCOML. In this case, since the impedance of the transistor PT11 becomes higher than that of the transistor PT12, the gate voltage of the transistors NT11 and NT12 is decreased, so that the impedance of the transistor NT12 is increased. Therefore, the gate voltage of the N-type driver transistor NDT1 is increased, so that the N-type driver transistor NDT1 approaches the ON state. Therefore, the output voltage VCOML is decreased.

As a result of the above-described operation, the VCOML generation circuit 120 transitions to an equilibrium in which the low-potential-side input voltage LEVINN becomes approximately equal to the output voltage VCOML.

In the differential section OP2, the reaction rate of each transistor forming the current mirror circuit CM2 and the differential transistor pair DT2 can be increased as the current value of the current source CS2 is increased. Therefore, the slew rate of the VCOML generation circuit 120 can be increased.

In the output section OD2, the capability of drawing current from the node to which the output voltage VCOML is supplied can be increased by setting the boost N-type driver transistor NBT1 in a conducting state.

2.4.1 Power Supply Capability Setting Register

The power supply control circuit 150 controls the supply capability of the common electrode voltage VCOM as described above based on the value set in the power supply capability setting register 160.

FIG. 30 shows an example of the power supply capability setting register 160 shown in FIG. 22.

FIG. 30 shows an example of controlling the gate signals of the first and second auxiliary transistors CTrp1, CTrp2, CTrn1, and CTrn2, the slew rate control signals VREFN1 and VREFN2, offset of the high-potential-side input voltage LEVINP, and the charge clock signals CK. The same description also applies to other control signals and the like. All of or only some of the control signals may be controlled as described below.

The power supply capability setting register 160 stores the control information for generating the control signal for controlling the supply capability of the common electrode voltage VCOM while associating the supply capability with the line value from the data driver 30. The control information is set by the host or the display controller.

In FIG. 30, the control information is stored while being associated with the line value. However, the control information may be stored while being associated with the amount of change in the line value.

FIG. 31 shows another example of the power supply capability setting register 160.

In FIG. 31, the control information set in the power supply capability setting register 160 is information which designates the ON timing and the OFF timing of the control signal for controlling the supply capability of the common electrode voltage VCOM.

Figure 32:
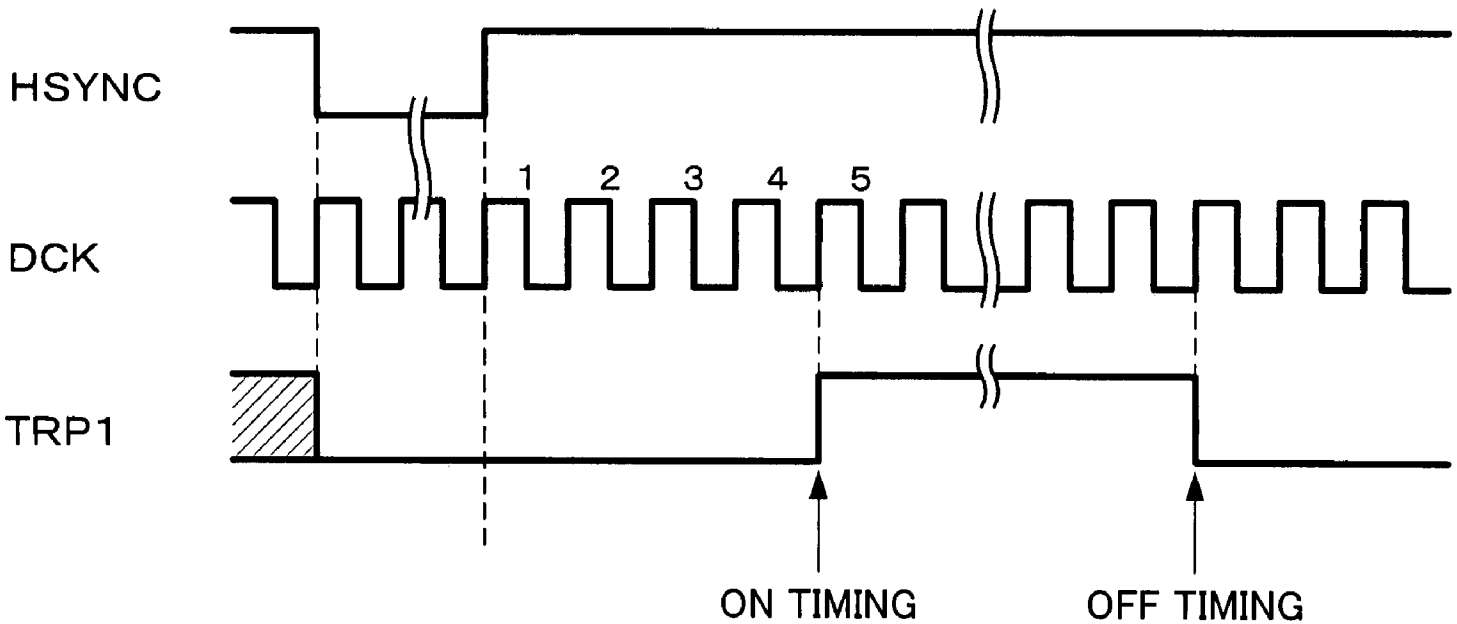
FIG. 32 is illustrative of control information set in the power supply capacity setting register shown in FIG. 31.

FIG. 32 is a diagram illustrative of the control information set in the power supply capability setting register shown in FIG. 31.

For example, the control information may include the ON timing specified by the number of dot clock signals DCK with respect to the falling edge of the horizontal synchronization signal HSYNC, and the OFF timing specified by the number of dot clock signals DCK with respect to the falling edge.

In FIG. 31, the control information is stored while being associated with the line value. However, the control information may be stored while being associated with the amount of change in the line value.

This enables the supply capability of the common electrode voltage VCOM to be controlled in a period determined based on the line value or the amount of change in the line value.

In the above-described power supply capability setting register, the control information including the type and time of control signal which should be controlled is determined depending on the load of the common electrode of the LCD panel 20 and the output configuration of the data driver 30.

2.5 First Configuration Example

A first configuration example shows the case of controlling the supply capability of the common electrode voltage VCOM when performing a line inversion drive. In the first configuration example, the supply capability of the common electrode voltage VCOM is controlled by receiving the line value from the data driver 30.

Figure 33:
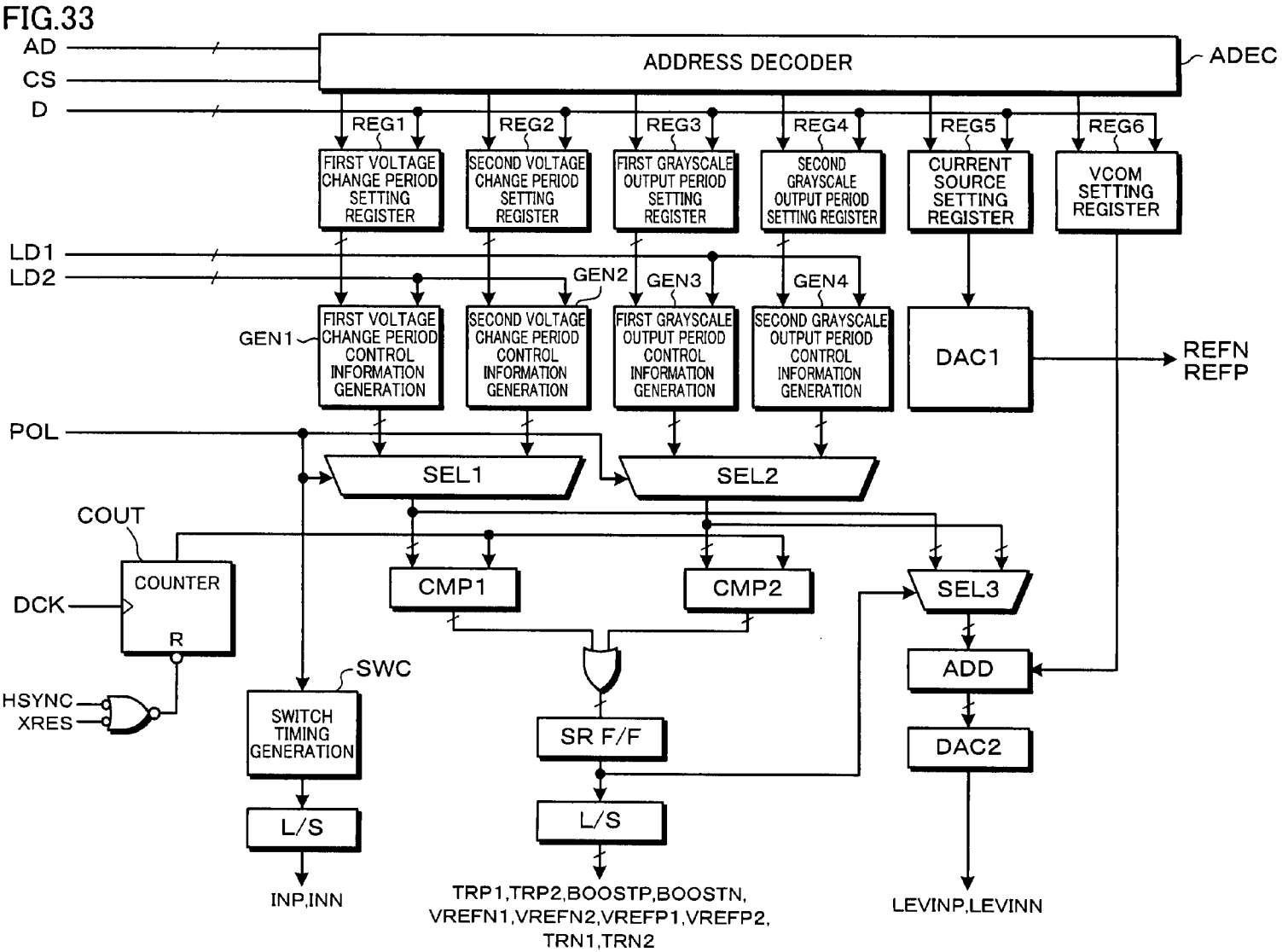
FIG. 33 is a block diagram showing a configuration example of a power supply control circuit according to a first configuration example.

FIG. 33 is a block diagram showing a configuration example of a power supply control circuit according to the first configuration example. The power supply control circuit corresponds to the power supply control circuit 150 shown in FIG. 22.

When performing a line inversion drive, the supply capability control of the common electrode voltage VCOM corresponding to the line value or the like is caused to differ between the voltage change period immediately after the common electrode voltage VCOM changes and the subsequent grayscale output period.

Therefore, the power supply capability setting register stores control information for the positive voltage change period and grayscale output period and control information for the negative voltage change period and grayscale output period. The power supply control circuit acquires a voltage change period line value and a grayscale output period line value from the data driver 30, and controls the supply capability of the common electrode voltage VCOM based on the acquired line value.

In FIG. 33, the power supply capability setting register includes first and second voltage change period setting registers REG1 and REG2, first and second grayscale output period setting registers REG3 and REG4, a current source setting register REG5, and a VCOM setting register REG6. Information set in the first voltage change period setting register REG1 is used for the positive voltage change period. Information set in the first grayscale output period setting register REG3 is used for the positive grayscale output period. Information set in the second voltage change period setting register REG2 is used for the negative voltage change period. Information set in the second grayscale output period setting register REG3 is used for the negative grayscale output period.

The current source setting register REG5 stores control information for generating the drive current source control signals REFN and REFP. Specifically, a digital/analog converter DAC1 generates signals at voltage levels corresponding to the control information set in the current source setting register REG5, and outputs the generated signals as the drive current source control signals REFN and REFP.

The VCOM setting register REG6 stores control information for generating the high-potential-side input voltage LEVINP and the low-potential-side input voltage LEVINN. The high-potential-side input voltage LEVINP and the low-potential-side input voltage LEVINN are generated after an offset value has been added to the control information. The offset value is generated corresponding to the line value as shown in FIG. 21.

The information is set in the first and second voltage change period setting registers REG1 and REG2, the first and second grayscale output period setting registers REG3 and REG4, the current source setting register REG5, and the VCOM setting register REG6 by the host or the display controller. The host or the display controller outputs address data AD which specifies one of the registers and a chip select CS. When the chip select CS is set to active, an address decoder ADEC sets access data D from the host or the display controller in one of the registers specified based on the address data AD. The access data D is the control information.

In the first configuration example, a voltage change period line value LD2 and a grayscale output period line value LD1 are independently supplied from the data driver 30.

FIG. 34 shows an example of the line value in each period supplied from the data driver 30.

In the voltage change period, the line value is a preceding line value. The preceding line value is a line value in the horizontal scan period immediately before the present horizontal scan period. The line value is calculated as shown in FIG. 21. In the voltage change period, since a voltage is not applied to the pixel electrode based on the line data in the present horizontal scan period, the line data in the present horizontal scan period is not taken into consideration.

In the grayscale output period, the line value is calculated based on the value obtained by adding the present line value to the value obtained by adding a corresponding correction value to the preceding line value. The present line value is the line value in the present horizontal scan period.

Figure 35:
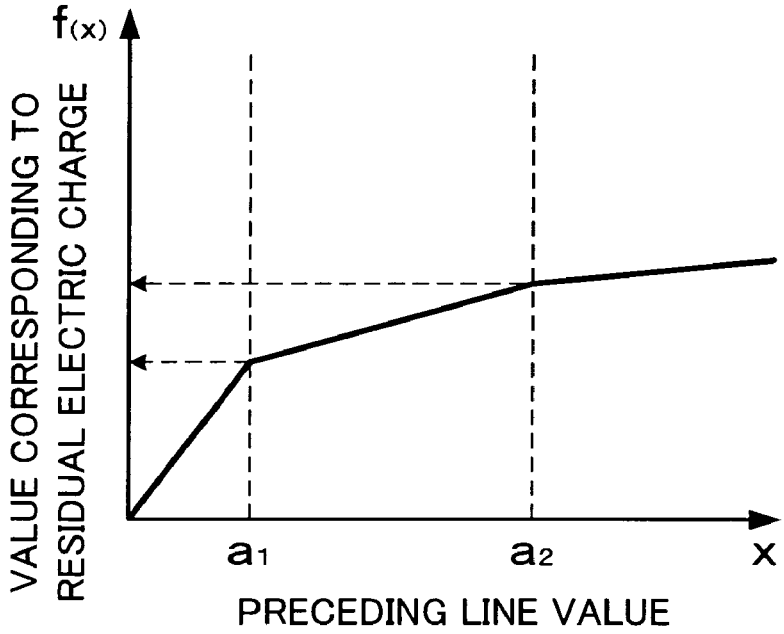
FIG. 35 is a diagram illustrative of a correction value corresponding to a preceding line value.

FIG. 35 is a diagram illustrative of the correction value corresponding to the preceding line value.

When the preceding line value is indicated by x, the correction value corresponds to f(x) as shown in FIG. 35. The correction value is a value taking into consideration the amount of electric charge remaining in the present horizontal scan period due to the remaining electric charge supplied to the pixel electrode or the data line in the horizontal scan period immediately before the present horizontal scan period. The amount of residual electric charge can be associated with the voltage applied to the pixel electrode in the horizontal scan period immediately before the present horizontal scan period. Therefore, the correction value can be associated with the preceding line value.

In FIG. 35, the preceding line value is linearly approximate to f(x) as $a_1$ and $a_2$ as boundaries. The preceding line value $a_1$ is determined according to the grayscale characteristics of the LCD panel 20. In the grayscale characteristics, a change in voltage per grayscale increases in the region in which the grayscale value is large or small, and a change in voltage per grayscale decreases in the intermediate region of the grayscale value. The preceding line value $a_1$ is a value corresponding to the boundary between the region in which a change in voltage is large (grayscale value is small) and the intermediate region in which a change in voltage is small in the grayscale characteristics.

The preceding line value $a_2$ is a value corresponding to the voltage clamped by an output protection diode or the like of the data driver 30 which drives the data line. Specifically, since current flows through the diode or the like at a voltage higher than the voltage generated by the grayscale data corresponding to the preceding line value $a_2$, the slope of the linear approximation is caused to differ.

In FIG. 33, the voltage change period line value LD2 is supplied to first and second voltage change period control information generation sections GEN1 and GEN2. The first voltage change period control information generation section GEN1 extracts the control information corresponding to the line value LD2 from the control information set in the first voltage change period setting register REG1. The second voltage change period control information generation section GEN2 extracts the control information corresponding to the line value LD2 from the control information set in the first voltage change period setting register REG2.

Based on the polarity inversion signal POL from the data driver 30, a selector SEL1 selects the output of the first voltage change period control information generation section GEN1 in the positive period and selects the output of the second voltage change period control information generation section GEN2 in the negative period.

The grayscale output period line value LD1 is supplied to the first and second grayscale output period control information generation sections GEN3 and GEN4. The first grayscale output period control information generation section GEN3 extracts the control information corresponding to the line value LD1 from the control information set in the first grayscale output period setting register REG3. The second grayscale output period control information generation section GEN4 extracts the control information corresponding to the line value LD1 from the control information set in the second grayscale output period setting register REG4.

Based on the polarity inversion signal POL, a selector SEL2 selects the output of the first grayscale output period control information generation section GEN3 in the positive period and selects the output of the second grayscale output period control information generation section GEN4 in the negative period.

A counter COUT increments a counter value, which is initialized at the edge of the horizontal synchronization signal HSYNC or the edge of a reset signal XRES, in synchronization with the dot clock signal DCK.

A comparator CMP1 compares the control information selected by the selector SEL1 with the counter value, and outputs a pulse when the control information coincides with the counter value. A comparator CMP2 compares the control information selected by the selector SEL2 with the counter value, and outputs a pulse when the control information coincides with the counter value. A set-reset flip-flop is set or reset by the logical OR result of these pulses. The output of the set-reset flip-flop is converted in voltage level by a level shifter, and output as various control signals which realize the supply capacity control of the common electrode voltage VCOM.

FIG. 33 shows only the configuration of generating one control signal. A similar configuration is provided in units of control signals which realize the supply capacity control of the electrode voltage VCOM.

In FIG. 33, period designation information which designates the voltage change period and the grayscale output period in polarity units is stored in one of the first and second voltage change period setting registers REG1 and REG2 and the first and second grayscale output period setting registers REG3 and REG4. The period designation information output from the set-reset flip-flop is supplied to a selector SEL3. Control information for changing the offset value which changes the high-potential-side voltage VCOMH and the low-potential-side voltage VCOML is supplied to the selector SEL3 from the selectors SEL1 and SEL2. The selector SEL3 outputs one piece of the control information based on the period designation information.

An adder ADD adds the control information and the control information set in the VCOM setting register REG6. A digital/analog converter DAC2 generates signals at voltage levels corresponding to the addition result of the adder ADD, and output the generated signals as the high-potential-side input voltage LEVINP and the low-potential-side input voltage LEVINN. This enables the high-potential-side input voltage LEVINP or the low-potential-side input voltage LEVINN to be changed corresponding to the line value or the amount of change in the line value, so that the voltage level of the common electrode voltage VCOM can be changed.

The polarity inversion signal POL is supplied to a switch timing generation circuit SWC. The switch timing generation circuit SWC generates the gate signals INP and INN which change at the timing shown in FIG. 14 based on the polarity inversion signal POL, and outputs the gate signals INP and INN to the switch circuit 130 after voltage level conversion.

Figure 36:
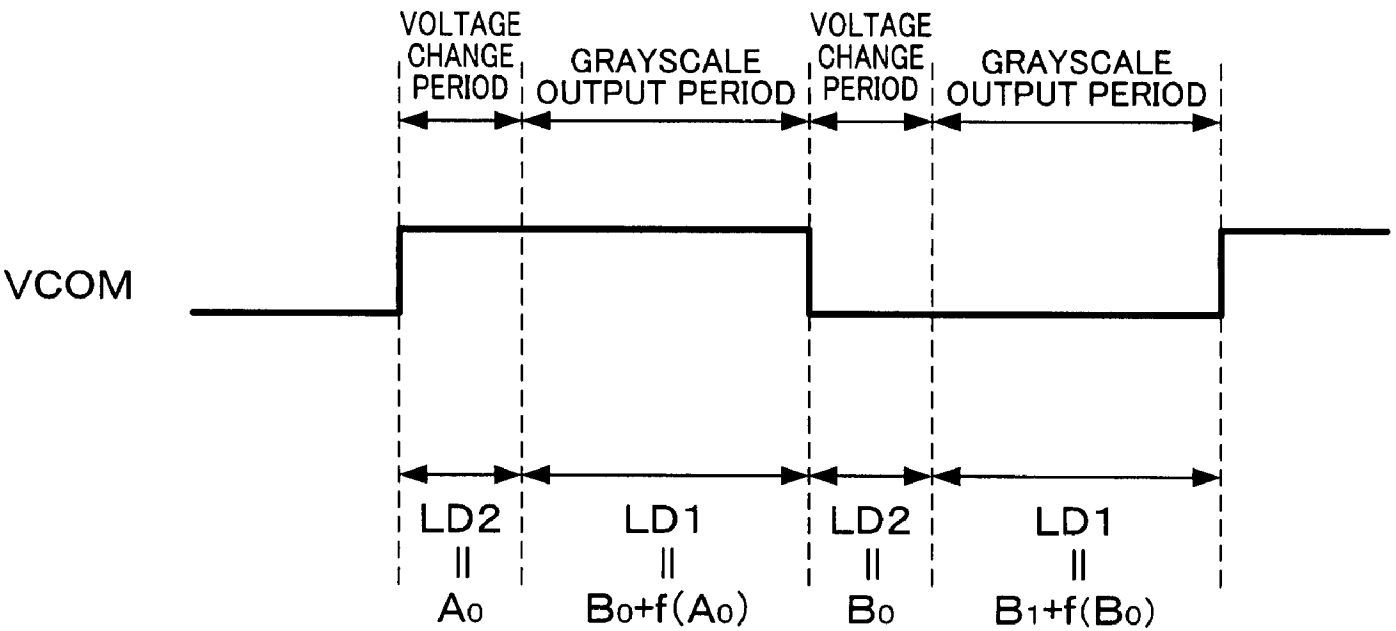
FIG. 36 is illustrative of an operation example in the first configuration example.

FIG. 36 is a diagram illustrative of an operation example in the first configuration example.

FIG. 36 shows an example of a line inversion drive in which the polarity is reversed in units of one horizontal scan period.

The voltage change period starts when the common electrode voltage VCOM changes to the H level. The line value LD2 in the voltage change period is indicated by $A_0$. $A_0$ is the line value (preceding line value) in the horizontal scan period immediately before the common electrode voltage VCOM changes from the L level to the H level. Therefore, the supply capability of the high-potential-side voltage VCOMH is controlled based on the control information set in the power supply capability setting register 160 in which the line value corresponds to $A_0$. The supply capability control includes at least one of the above-described control operations.

In the subsequent grayscale output period, $(B_0+f(A_0))$ is input as the line value LD1. $B_0$ is the line value in the present horizontal scan period. Therefore, the supply capability of the high-potential-side voltage VCOMH is controlled based on the control information set in the power supply capability setting register 160 in which the line value corresponds to $(B_0+f(A_0))$. The supply capability control includes at least one of the above-described control operations.

The voltage change period again starts when the common electrode voltage VCOM changes to the L level. In this voltage change period, the preceding line value $B_0$ is input as the line value LD2. Therefore, the supply capability of the low-potential-side voltage VCOML is controlled based on the control information set in the power supply capability setting register 160 in which the line value corresponds to $B_0$. The supply capability control includes at least one of the above-described control operations.

In the subsequent grayscale output period, $(B_1+f(B_0))$ is input as the line value LD1. $B_1$ is the line value in the present horizontal scan period. Therefore, the supply capability of the low-potential-side voltage VCOML is controlled based on the control information set in the power supply capability setting register 160 in which the line value corresponds to $(B_1+f(B_0))$. The supply capability control includes at least one of the above-described control operations.

2.6 Second Configuration Example

A second configuration example shows the case of controlling the supply capability of the common electrode voltage VCOM when performing a field inversion drive.

Figure 37:
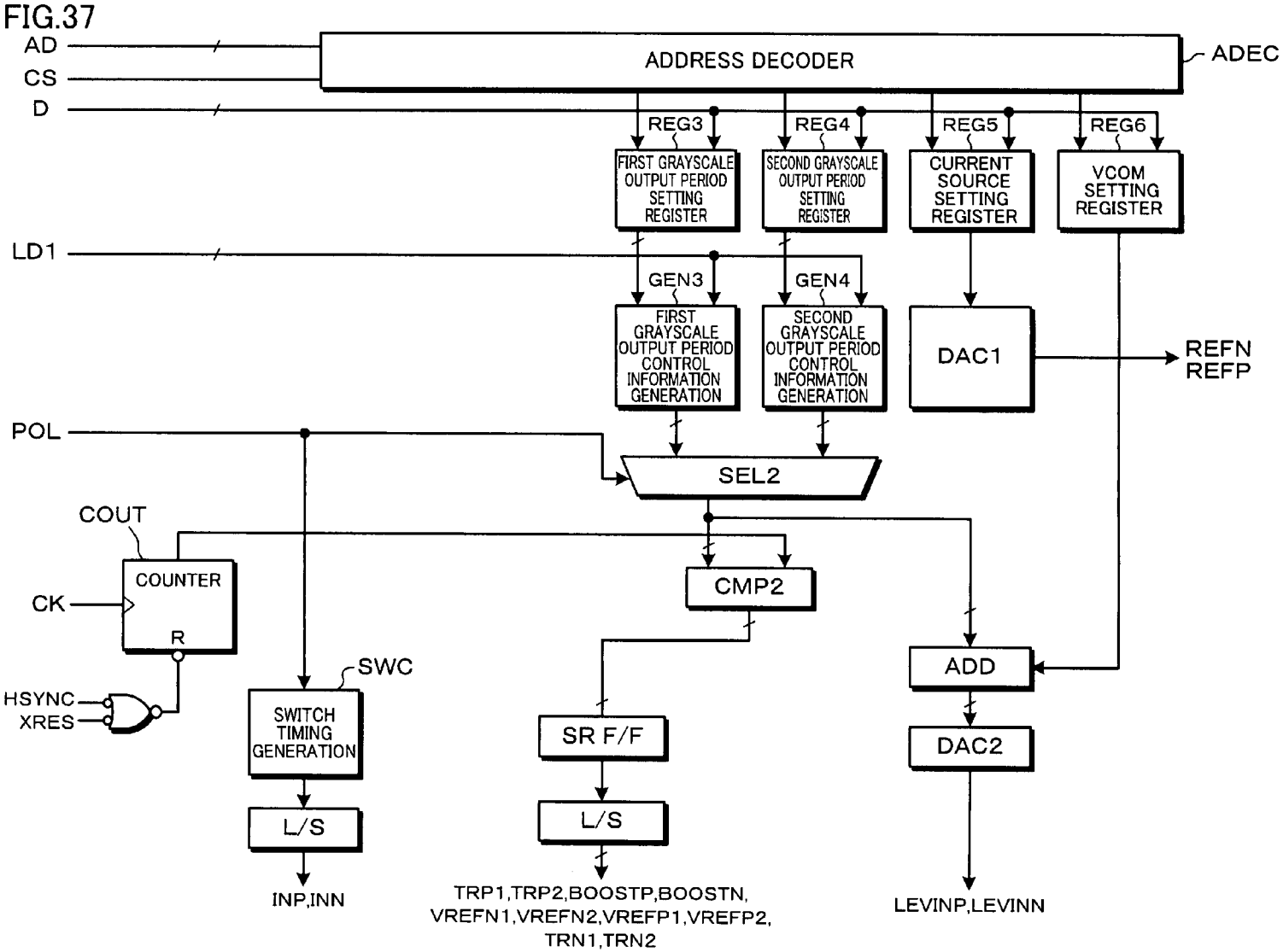
FIG. 37 is a block diagram showing a configuration example of a power supply control circuit according to a second configuration example.

FIG. 37 is a block diagram showing a configuration example of a power supply control circuit according to the second configuration example. The power supply control circuit corresponds to the power supply control circuit 150 shown in FIG. 22. In FIG. 37, sections the same as the sections shown in FIG. 33 are indicated by the same symbols. Description of these sections is appropriately omitted.

In FIG. 37, the positive and negative voltage change period control information is not set in the power supply capability setting register shown in FIG. 33. The power supply control circuit acquires the grayscale output period line value LD1 from the data driver 30, and controls the supply capability of the common electrode voltage VCOM based on the acquired line value.

When performing a field inversion drive, the supply capability of the common electrode voltage VCOM is controlled corresponding to the line value or the like only in the grayscale output period. In the field inversion drive, the polarity of the common electrode voltage VCOM does not change between the preceding horizontal scan period and the present horizontal scan period. Therefore, the line value may be a value obtained by subtracting the preceding line from the present line value or a value obtained by correcting the resulting value.

Other details are the same as those of the grayscale output period control information shown in FIG. 33. Therefore, detailed description is omitted.

Figure 38:
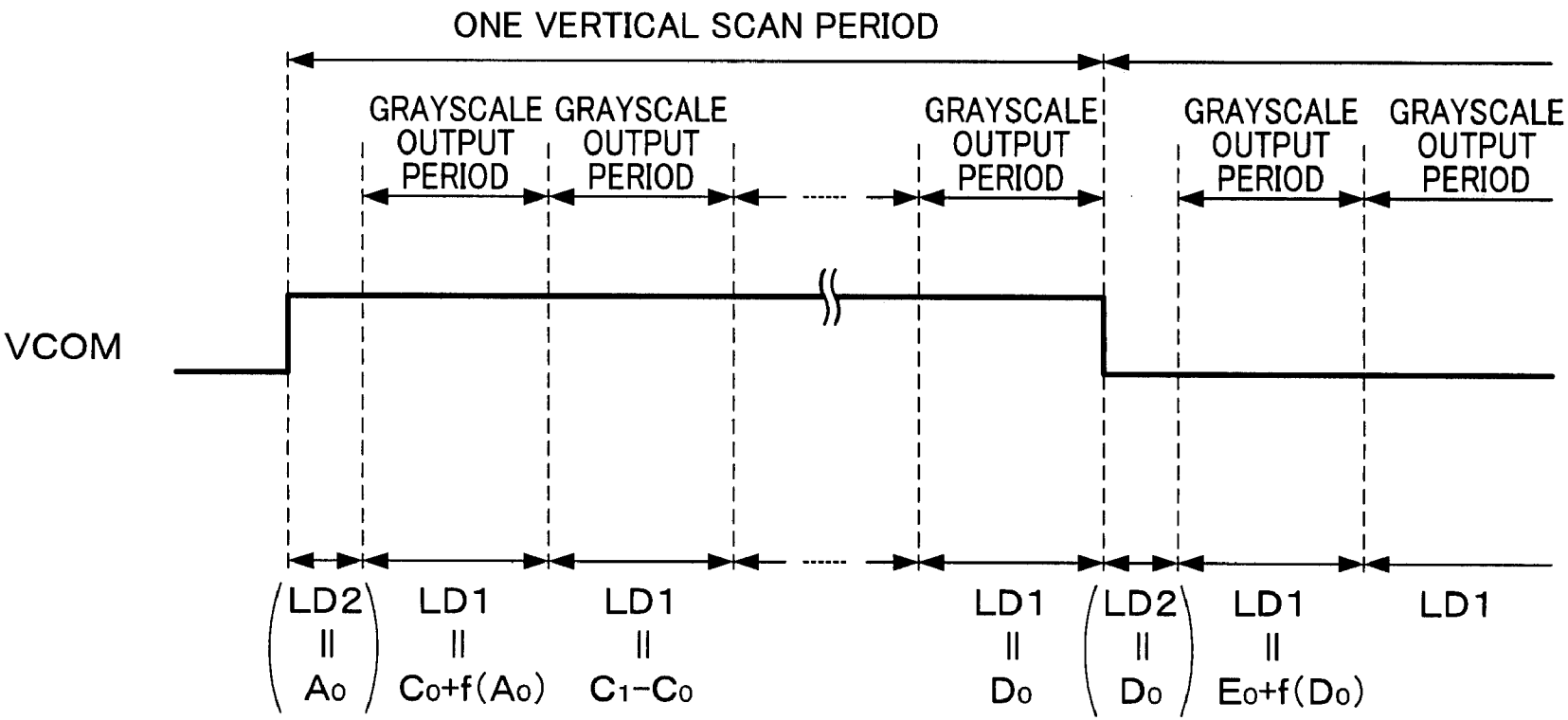
FIG. 38 is illustrative of an operation example in the second configuration example.

FIG. 38 is a diagram illustrative of an operation example in the second configuration example.

The grayscale output period starts when a certain period has elapsed after the common electrode voltage VCOM has changed to the H level. In the grayscale output period, $(C_0+f(A_0))$ is input as the line value LD1. $C_0$ is the line value in the present horizontal scan period. $A_0$ is the preceding line value. Therefore, the supply capability of the high-potential-side voltage VCOMH is controlled based on the control information set in the power supply capability setting register 160 in which the line value corresponds to $(C_0+f(A_0))$. The supply capability control includes at least one of the above-described control operations.

The next horizontal scan period is also the grayscale output period. Therefore, $(C_1-C_0)$ is input as the line value LD1. $C_1$ is the line value in the present horizontal scan period. Therefore, the supply capability of the high-potential-side voltage VCOMH is controlled based on the control information set in the power supply capability setting register 160 in which the line value corresponds to $(C_1-C_0)$). The supply capability control includes at least one of the above-described control operations.

Likewise, the supply capability of the high-potential-side voltage VCOMH is controlled in each grayscale output period in the present vertical scan period.

When the next vertical scan period starts, the common electrode voltage VCOM changes to the L level. In the grayscale output period, $(E_0+f(D_0))$ is input as the line value LD1. $E_0$ is the line value in the present horizontal scan period. $D_0$ is the preceding line value. Therefore, the supply capability of the low-potential-side voltage VCOML is controlled based on the control information set in the power supply capability setting register 160 in which the line value corresponds to $(E_0+f(D_0))$. The supply capability control includes at least one of the above-described control operations.

Likewise, the supply capability of the high-potential-side voltage VCOMH is controlled in each grayscale output period in the present vertical scan period.

In the voltage change period in which the common electrode voltage VCOM changes, the supply capability may be controlled in the same manner as in the voltage change period during the line inversion drive described with reference to FIGS. 33 to 36.

FIG. 36 shows an example of reversing the polarity in units of one horizontal scan period. When reversing the polarity in units of two or more horizontal scan periods, the supply capability may be controlled in the horizontal scan period after the grayscale output period in the same manner as in the field inversion drive shown in FIG. 38.

3. Electronic Instrument

Figure 39:
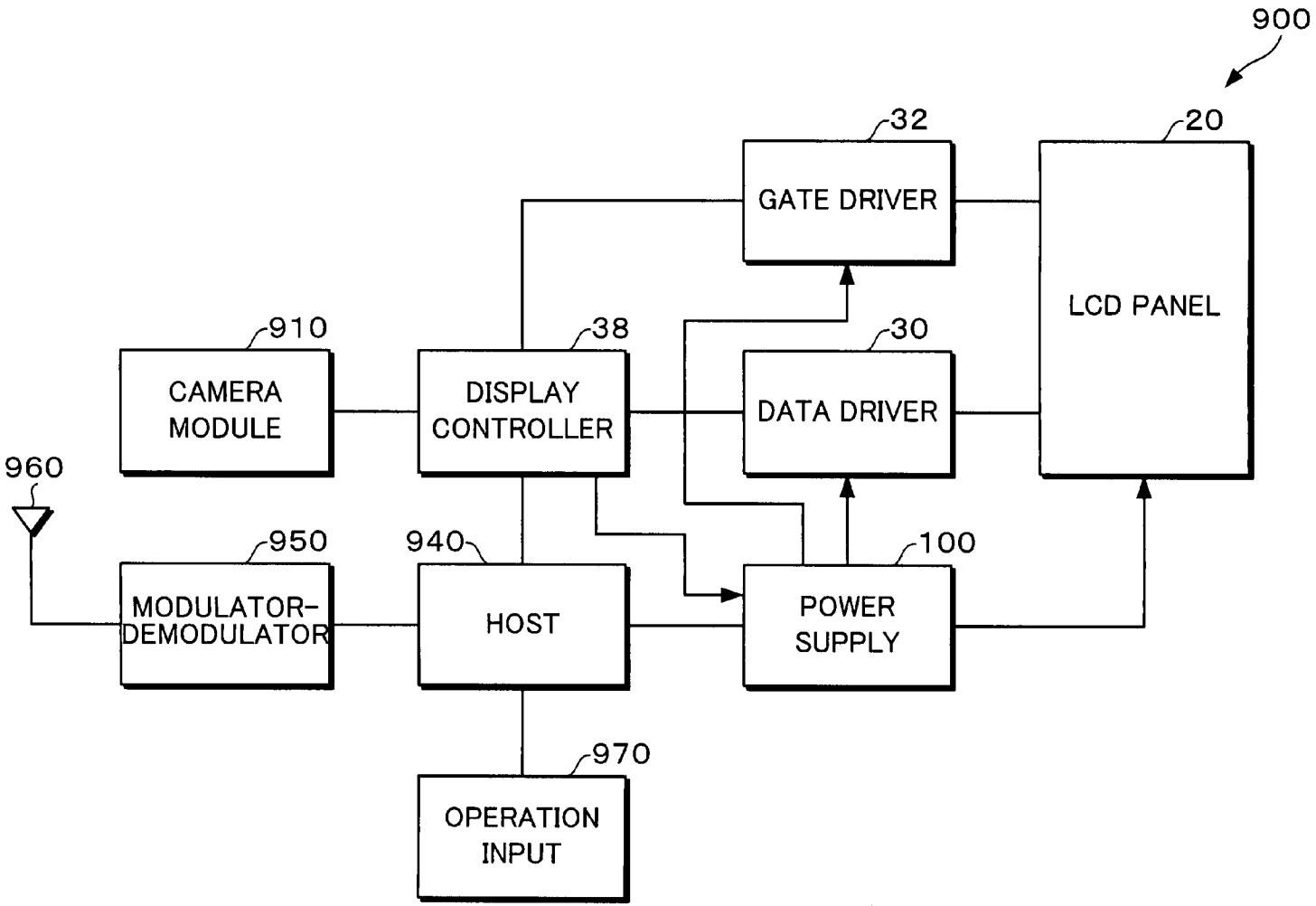
FIG. 39 is a block diagram showing a configuration example of an electronic instrument according to one embodiment of the invention.

FIG. 39 is a block diagram showing a configuration example of an electronic instrument according to one embodiment of the invention. FIG. 39 is a block diagram showing a configuration example of a portable telephone as an example of the electronic instrument. In FIG. 39, sections the same as the sections shown in FIG. 1 or 2 are indicated by the same symbols. Description of these sections is appropriately omitted.

A portable telephone 900 includes a camera module 910. The camera module 910 includes a CCD camera, and supplies data of an image captured by using the CCD camera to the display controller 38 in a YUV format.

The portable telephone 900 includes the display panel 20. The LCD panel 20 is driven by the data driver 30 and the gate driver 32. The LCD panel 20 includes scan lines, source lines, and pixels.

The display controller 38 is connected with the data driver 30 and the gate driver 32, and supplies grayscale data to the data driver 30 in an RGB format.

The power supply circuit 100 is connected with the data driver 30 and the gate driver 32, and supplies drive power supply voltages to the data driver 30 and the gate driver 32. The power supply circuit 100 supplies the common electrode voltage VCOM to the common electrode of the LCD panel 20.

A host 940 is connected with the display controller 38. The host 940 controls the display controller 38. The host 940 demodulates grayscale data received through an antenna 960 using a modulator-demodulator section 950, and supplies the demodulated grayscale data to the display controller 38. The display controller 38 causes the data driver 30 and the gate driver 32 to display an image in the LCD panel 20 based on the grayscale data.

The host 940 modulates grayscale data generated by the camera module 910 using the modulator-demodulator section 950, and directs transmission of the modulated data to another communication device through the antenna 960.

The host 940 performs transmission/reception processing of grayscale data, imaging using the camera module 910, and display processing of the LCD panel 20 based on operational information from an operation input section 970.

The invention is not limited to the above-described embodiments. Various modifications and variations may be made within the spirit and scope of the invention. The above-described embodiments illustrate the power supply circuit which supplies voltage to the common electrode. However, the invention is not limited to the power supply circuit which supplies voltage to the common electrode.

The invention according to the dependent claim may have a configuration in which some of the constituent elements of the claim on which the invention is dependent are omitted. It is possible to allow a feature of the invention according to one independent claim to depend on another independent claim.

Although only some embodiments of the invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A power supply circuit which supplies voltage to a common electrode which is opposite to a pixel electrode, an electro-optical substance being interposed between the common electrode and the pixel electrode, the power supply circuit comprising:

a first voltage generation circuit which generates a first voltage supplied to the common electrode;

a second voltage generation circuit which generates a second voltage supplied to the common electrode, the second voltage being lower than the first voltage; and a switch circuit which alternately supplies the first voltage and the second voltage to the common electrode as a common electrode voltage, wherein the power supply circuit performs supply capability control of the common electrode voltage which changes at least one of current drive capability of the first voltage generation circuit, an output voltage level of the first voltage generation circuit, current drive capability of the second voltage generation circuit, and an output voltage level of the second voltage generation circuit according to a total value generated based on grayscale data for the number of dots of one scan line, each dot corresponding to voltage applied to the pixel electrode; and wherein the total value is a value obtained by adding at least part of converted values obtained by converting each piece of the grayscale data for the number of dots of one scan line according to a given grayscale characteristic.

2. The power supply circuit as defined in claim 1, comprising:

a first conductivity type first auxiliary transistor to which a first power supply voltage of the first voltage generation circuit is supplied at a source and which is electrically connected to an output of the switch circuit at a drain, wherein the supply capability control is performed by controlling a gate voltage of the first auxiliary transistor corresponding to the total value.

3. The power supply circuit as defined in claim 1, comprising:

a second conductivity type second auxiliary transistor to which a second power supply voltage of the second voltage generation circuit is supplied at a source and which is electrically connected to an output of the switch circuit at a drain, wherein the supply capability control is performed by controlling a gate voltage of the second auxiliary transistor corresponding to the total value.

4. The power supply circuit as defined in claim 1, wherein the first voltage generation circuit includes a first operational amplifier which outputs the first voltage based on a first input voltage.

5. The power supply circuit as defined in claim 4, wherein the supply capability control is performed by changing at least one of current drive capability and a slew rate of the first operational amplifier according to the total value.

6. The power supply circuit as defined in claim 4, wherein the supply capability control is performed by changing the first input voltage according to the total value.

7. The power supply circuit as defined in claim 4, wherein the supply capability control is performed by stopping or limiting an operating current of the first operational amplifier and electrically connecting an input and an output of the first operational amplifier according to the total value.

8. The power supply circuit as defined in claim 1, comprising:

a first charge-pump circuit which generates a first power supply voltage of the first voltage generation circuit by a charge-pump operation in synchronization with a first charge clock signal, wherein the supply capability control is performed by stopping the first charge clock signal or reducing frequency of the first charge clock signal according to the total value.

9. The power supply circuit as defined in claim 1, wherein the second voltage generation circuit includes a second operational amplifier which outputs the second voltage based on a second input voltage.

10. The power supply circuit as defined in claim 9, wherein the supply capability control is performed by changing at least one of current drive capability and a slew rate of the second operational amplifier according to the total value.

11. The power supply circuit as defined in claim 9, wherein the supply capability control is performed by changing the second input voltage according to the total value.

12. The power supply circuit as defined in claim 9, wherein the supply capability control is performed by stopping or limiting an operating current of the second operational amplifier and electrically connecting an input and an output of the second operational amplifier according to the total value.

13. The power supply circuit as defined in claim 1, comprising:

a second charge-pump circuit which generates a second power supply voltage of the second voltage generation circuit by a charge-pump operation in synchronization with a second charge clock signal, wherein the supply capability control is performed by stopping the second charge clock signal or reducing frequency of the second charge clock signal according to the total value.

14. The power supply circuit as defined in claim 1, wherein the supply capability control is performed in a period determined based on the total value.

15. The power supply circuit as defined in claim 1, wherein the supply capability control is performed according to an amount of change between the total value in a present horizontal scan period and the total value in a horizontal scan period immediately before the present horizontal scan period, instead of the total value.

16. The power supply circuit as defined in claim 15, wherein the supply capability control is performed in a period corresponding to the amount of change between the total value in the present horizontal scan period and the total value in the horizontal scan period immediately before the present horizontal scan period.

17. The power supply circuit as defined in claim 16, wherein, when performing a field inversion drive in which polarity of the common electrode voltage is changed based on a given reference potential in units of one vertical scan period, the amount of change is calculated based on a value obtained by subtracting the total value in the horizontal scan period immediately before the present horizontal scan period from the total value in the present horizontal scan period; and wherein, when performing a line inversion drive in which polarity of the common electrode voltage is changed based on a given reference potential in units of one horizontal scan period, the amount of change is calculated based on a value obtained by adding the total value in the present horizontal scan period and a correction value corresponding to the total value.

18. The power supply circuit as defined in claim 15, wherein, when performing a field inversion drive in which polarity of the common electrode voltage is changed based on a given reference potential in units of one vertical scan period, the amount of change is calculated based on a value obtained by subtracting the total value in the horizontal scan period immediately before the present horizontal scan period from the total value in the present horizontal scan period; and wherein, when performing a line inversion drive in which polarity of the common electrode voltage is changed based on a given reference potential in units of one horizontal scan period, the amount of change is calculated based on a value obtained by adding the total value in the present horizontal scan period and a correction value corresponding to the total value.

19. The power supply circuit as defined in claim 1, wherein, when the grayscale data of each dot is j bits (j is an integer greater than one), the total value is a value obtained by adding converted values obtained by converting higher-order k-bit data (k<j, k is a natural number) of each of the grayscale data for the number of dots of one scan line according to the given grayscale characteristic.

20. The power supply circuit as defined in claim 19, wherein k is one.

21. The power supply circuit as defined in claim 1, wherein, when the value obtained by adding the at least part of the converted values is p bits (p is an integer greater than one), the total value is a value indicated by higher-order q bits (q<p, q is a natural number) of the value obtained by adding the at least part of the converted values.

22. The power supply circuit as defined in claim 1, wherein the number of bits of the grayscale data is smaller than the number of bits of data indicating the converted values.

23. A display driver comprising:

a voltage value conversion circuit which generates converted values obtained by converting grayscale data of each dot corresponding to voltage applied to a pixel electrode according to a given grayscale characteristic;

a total value calculation circuit which generates a total value based on the converted values for the number of dots of one scan line;

a driver circuit which supplies a drive voltage corresponding to the grayscale data to a data line electrically connected to the pixel electrode; and the power supply circuit as defined in claim 1 which performs the supply capability control by using the total value generated by the total value calculation circuit.

24. An electro-optical device comprising:

a plurality of scan lines;

a plurality of data lines;

a plurality of pixel electrodes, each of the pixel electrodes being specified by one of the scan lines and one of the data lines;

a common electrode which is opposite to the pixel electrodes, an electro-optical substance being interposed between the common electrode and the pixel electrodes;

a data driver which drives the data lines; and the power supply circuit as defined in claim 1 which alternately supplies the first voltage and the second voltage to the common electrode.

25. An electronic instrument comprising the power supply circuit as defined in claim 1.

26. A power supply circuit which supplies voltage to a common electrode which is opposite to a pixel electrode, an electro-optical substance being interposed between the common electrode and the pixel electrode, the power supply circuit comprising:

a circuit which alternately supplies a first voltage and a second voltage to the common electrode, wherein the power supply circuit performs supply capability control of the common electrode voltage which changes at least one of current drive capability of a first voltage generation circuit generating the first voltage, an output voltage level of the first voltage generation circuit, current drive capability of a second voltage generation circuit generating the second voltage lower than the first voltage, and an output voltage level of the second voltage generation circuit according to a total value generated based on grayscale data for the number of dots of one scan line, each dot corresponding to voltage applied to the pixel electrode; and wherein the total value is a value obtained by adding at least part of converted values obtained by converting each of the grayscale data for the number of dots of one scan line according to a given grayscale characteristic.

27. The power supply circuit as defined in claim 26, wherein the supply capability control is performed in a period determined based on the total value.

28. The power supply circuit as defined in claim 26, wherein the supply capability control is performed according to an amount of change between the total value in a present horizontal scan period and the total value in a horizontal scan period immediately before the present horizontal scan period, instead of the total value.

29. The power supply circuit as defined in claim 28, wherein the supply capability control is performed in a period corresponding to the amount of change between the total value in the present horizontal scan period and the total value in the horizontal scan period immediately before the present horizontal scan period.

30. The power supply circuit as defined in claim 29, wherein, when performing a field inversion drive in which polarity of the common electrode voltage is changed based on a given reference potential in units of one vertical scan period, the amount of change is calculated based on a value obtained by subtracting the total value in the horizontal scan period immediately before the present horizontal scan period from the total value in the present horizontal scan period; and wherein, when performing a line inversion drive in which polarity of the common electrode voltage is changed based on a given reference potential in units of one horizontal scan period, the amount of change is calculated based on a value obtained by adding the total value in the present horizontal scan period and a correction value corresponding to the total value.

31. The power supply circuit as defined in claim 28, wherein, when performing a field inversion drive in which polarity of the common electrode voltage is changed based on a given reference potential in units of one vertical scan period, the amount of change is calculated based on a value obtained by subtracting the total value in the horizontal scan period immediately before the present horizontal scan period from the total value in the present horizontal scan period; and wherein, when performing a line inversion drive in which polarity of the common electrode voltage is changed based on a given reference potential in units of one horizontal scan period, the amount of change is calculated based on a value obtained by adding the total value in the present horizontal scan period and a correction value corresponding to the total value.

32. The power supply circuit as defined in claim 26, wherein, when the grayscale data of each dot is j bits (j is an integer greater than one), the total value is a value obtained by adding converted values obtained by converting higher-order k-bit data (k<j, k is a natural number) of each of the grayscale data for the number of dots of one scan line according to the given grayscale characteristic.

33. The power supply circuit as defined in claim 32, wherein k is one.

34. The power supply circuit as defined in claim 26, wherein, when the value obtained by adding the at least part of the converted values is p bits (p is an integer greater than one), the total value is a value indicated by higher-order q bits (q<p, q is a natural number) of the value obtained by adding the at least part of the converted values.

35. The power supply circuit as defined in claim 26, wherein the number of bits of the grayscale data is smaller than the number of bits of data indicating the converted values.

36. A display driver comprising:

a voltage value conversion circuit which generates converted values obtained by converting grayscale data of each dot corresponding to voltage applied to a pixel electrode according to a given grayscale characteristic;

a total value calculation circuit which generates a total value based on the converted values for the number of dots of one scan line;

a driver circuit which supplies a drive voltage corresponding to the grayscale data to a data line electrically connected to the pixel electrode; and the power supply circuit as defined in claim 26 which performs the supply capability control by using the total value generated by the total value calculation circuit.

37. An electro-optical device comprising:

a plurality of scan lines;

a plurality of data lines;

a plurality of pixel electrodes, each of the pixel electrodes being specified by one of the scan lines and one of the data lines;

a common electrode which is opposite to the pixel electrodes, an electro-optical substance being interposed between the common electrode and the pixel electrodes;

a data driver which drives the data lines; and the power supply circuit as defined in claim 26 which alternately supplies the first voltage and the second voltage to the common electrode.

38. An electronic instrument comprising the power supply circuit as defined in claim 26.

39. A method of controlling a power supply circuit including a first voltage generation circuit and a second voltage generation circuit, the first voltage generation circuit generating a first voltage to be supplied to a common electrode which is opposite to a pixel electrode, an electro-optical substance being interposed between the common electrode and the pixel electrode, the second voltage generation circuit generating a second voltage lower than the first voltage to be supplied to the common electrode, and the method comprising:

converting each of grayscale data for the number of dots of one scan line into converted values according to a given grayscale characteristic, each dot corresponding to voltage applied to the pixel electrode;

changing at least one of current drive capability of the first voltage generation circuit, an output voltage level of the first voltage generation circuit, current drive capability of the second voltage generation circuit, and an output voltage level of the second voltage generation circuit according to a total value obtained by adding at least part of the converted values; and alternately supplying the first voltage and the second voltage to the common electrode.

40. The method of controlling a power supply circuit as defined in claim 39, wherein at least one of the current drive capability of the first voltage generation circuit, the output voltage level of the first voltage generation circuit, the current drive capability of the second voltage generation circuit, and the output voltage level of the second voltage generation circuit is changed in a period determined based on the total value.

41. The method of controlling a power supply circuit as defined in claim 39, wherein at least one of the current drive capability of the first voltage generation circuit, the output voltage level of the first voltage generation circuit, the current drive capability of the second voltage generation circuit, and the output voltage level of the second voltage generation circuit is changed according to an amount of change between the total value in a present horizontal scan period and the total value in a horizontal scan period immediately before the present horizontal scan period.

42. The method of controlling a power supply circuit as defined in claim 41, wherein at least one of the current drive capability of the first voltage generation circuit, the output voltage level of the first voltage generation circuit, the current drive capability of the second voltage generation circuit, and the output voltage level of the second voltage generation circuit is changed in a period corresponding to the amount of change between the total value in the present horizontal scan period and the total value in the horizontal scan period immediately before the present horizontal scan period.

43. The method of controlling a power supply circuit as defined in claim 41, wherein, when performing a field inversion drive in which polarity of the common electrode voltage is changed based on a given reference potential in units of one vertical scan period, the amount of change is calculated based on a value obtained by subtracting the total value in the horizontal scan period immediately before the present horizontal scan period from the total value in the present horizontal scan period; and wherein, when performing a line inversion drive in which polarity of the common electrode voltage is changed based on a given reference potential in units of at least one horizontal scan period, the amount of change is calculated based on a value obtained by adding the total value in the present horizontal scan period and a correction value corresponding to the total value.

44. The method of controlling a power supply circuit as defined in claim 39, wherein, when the grayscale data of each dot is j bits (j is an integer greater than one), the total value is a value obtained by adding converted values obtained by converting higher-order k-bit data (k<j, k is a natural number) of each of the grayscale data for the number of dots of one scan line according to the given grayscale characteristic.

45. The method of controlling a power supply circuit as defined in claim 44, wherein k is one.

46. The method of controlling a power supply circuit as defined in claim 39, wherein, when the value obtained by adding the at least part of the converted values is p bits (p is an integer greater than one), the total value is a value indicated by higher-order q bits (q<p, q is a natural number) of the value obtained by adding the at least part of the converted values.

47. The method of controlling a power supply circuit as defined in claim 39, wherein the number of bits of the grayscale data is smaller than the number of bits of data indicating the converted values.

* * * * *